US007193594B1

(12) United States Patent
Yamazaki et al.

(10) Patent No.: US 7,193,594 B1
(45) Date of Patent: Mar. 20, 2007

(54) DISPLAY DEVICE

(75) Inventors: Shunpei Yamazaki, Tokyo (JP); Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 09/522,428

(22) Filed: Mar. 9, 2000

(30) Foreign Application Priority Data

Mar. 18, 1999 (JP) ..... 11-072889

(51) Int. Cl.
*G09G 3/36* (2006.01)

(52) U.S. Cl. ..... 345/89

(58) Field of Classification Search ..... 345/690–694, 345/696, 88–89, 605, 76, 77, 80, 84, 87, 345/90, 91–100, 101–103, 589, 590, 591
See application file for complete search history.

(56) References Cited

U.S. PATENT DOCUMENTS

| | | | | |
|---|---|---|---|---|
| 3,675,232 A | | 7/1972 | Strout | 340/324 |
| 3,792,919 A | * | 2/1974 | Holmes et al. | 352/72 |
| 4,042,854 A | * | 8/1977 | Luo et al. | 313/505 |
| 4,090,219 A | | 5/1978 | Ernstoff et al. | 348/742 |
| 4,750,813 A | | 6/1988 | Ohwada et al. | 345/87 |
| 4,864,390 A | | 9/1989 | McKechnie et al. | 348/751 |
| 4,907,862 A | | 3/1990 | Suntola | 349/61 |
| 5,122,784 A | | 6/1992 | Canova | 345/605 |
| 5,122,792 A | | 6/1992 | Stewart | 345/692 |
| 5,247,190 A | | 9/1993 | Friend et al. | 257/40 |
| 5,272,471 A | | 12/1993 | Asada et al. | 345/694 |
| 5,327,229 A | | 7/1994 | Konno et al. | 348/742 |
| 5,337,171 A | | 8/1994 | Mase et al. | 349/74 |
| 5,349,366 A | * | 9/1994 | Yamazaki et al. | 345/92 |
| 5,363,118 A | * | 11/1994 | Okumura | 345/95 |
| 5,399,502 A | | 3/1995 | Friend et al. | 437/1 |
| 5,414,442 A | | 5/1995 | Yamazaki et al. | 345/89 |
| 5,428,366 A | | 6/1995 | Eichenlaub et at. | 345/102 |
| 5,455,489 A | * | 10/1995 | Bhargava | 315/69.4 |
| 5,528,262 A | | 6/1996 | McDowall et al. | 345/664 |
| 5,583,530 A | | 12/1996 | Mano et al. | 345/89 |
| 5,594,569 A | | 1/1997 | Konuma et al. | 349/122 |

(Continued)

FOREIGN PATENT DOCUMENTS

CN 1122934 A 5/1996

(Continued)

OTHER PUBLICATIONS

Yoshida, T. et al, "A Full-Color Thresholdless Antiferroelectric LCD Exhibiting Wide Viewing Angle with Fast Response Time," *SID 97 Digest*, pp. 841-844, 1997.

(Continued)

*Primary Examiner*—Nitin Patel
(74) *Attorney, Agent, or Firm*—Cook, Alex, McFarron, Manzo, Cummings & Mehler, Ltd.

(57) ABSTRACT

An object of the present invention is to provide a display device which enables multi-gray scale display without complicating the structure of D/A converter circuit.

The measure taken to achieve the object is to use n bit of information among m bit digital video data inputted from external for voltage gray scale method, and (m–n) bit of information for time ratio gray scale.

114 Claims, 33 Drawing Sheets

U.S. PATENT DOCUMENTS

| | | | | |
|---|---|---|---|---|
| 5,606,437 | A * | 2/1997 | Mosier | 349/106 |
| 5,610,741 | A * | 3/1997 | Kimura | 349/113 |
| 5,642,129 | A | 6/1997 | Zavracky et al. | 345/100 |
| 5,643,826 | A | 7/1997 | Ohtani et al. | 437/88 |
| 5,648,277 | A | 7/1997 | Zhang et al. | 437/21 |
| 5,673,061 | A * | 9/1997 | Okada et al. | 345/89 |
| 5,677,704 | A | 10/1997 | Kusano et al. | 345/89 |
| 5,712,651 | A | 1/1998 | Tomiyasu | 345/88 |
| 5,724,058 | A | 3/1998 | Choi et al. | 345/89 |
| 5,761,485 | A * | 6/1998 | Munyan | 345/839 |
| 5,784,040 | A | 7/1998 | Kobayashi et al. | 345/89 |
| 5,784,073 | A | 7/1998 | Yamazaki et al. | 345/537 |
| 5,835,139 | A * | 11/1998 | Yun et al. | 349/58 |
| 5,874,933 | A | 2/1999 | Hirai et al. | 345/89 |
| 5,892,496 | A | 4/1999 | Wakeland | 345/694 |
| 5,893,798 | A * | 4/1999 | Stambolic et al. | 463/46 |
| 5,917,471 | A | 6/1999 | Choi | 345/690 |
| 5,923,962 | A | 7/1999 | Ohtani et al. | 438/150 |
| 5,953,002 | A | 9/1999 | Hirai et al. | 345/204 |
| 5,956,105 | A | 9/1999 | Yamazaki et al. | 349/43 |
| 5,959,603 | A | 9/1999 | Ito et al. | 345/100 |
| 5,990,629 | A | 11/1999 | Yamada et al. | 315/169.3 |
| 6,020,869 | A | 2/2000 | Sasaki et al. | 345/89 |
| 6,028,588 | A | 2/2000 | Yoon | 345/153 |
| 6,049,367 | A | 4/2000 | Sharp et al. | 349/117 |
| 6,067,066 | A | 5/2000 | Kubota et al. | 345/98 |
| 6,069,609 | A | 5/2000 | Ishida et al. | 345/596 |
| 6,072,454 | A * | 6/2000 | Nakai et al. | 345/97 |
| 6,078,304 | A | 6/2000 | Miyazawa | 345/88 |
| 6,085,112 | A * | 7/2000 | Kleinschmidt et al. | 455/556 |
| 6,094,243 | A * | 7/2000 | Yasunishi | 349/33 |
| 6,108,058 | A | 8/2000 | Uchida | 349/61 |
| 6,127,991 | A | 10/2000 | Uehara et al. | 345/60 |
| 6,160,533 | A | 12/2000 | Tamai et al. | 345/89 |
| 6,165,824 | A | 12/2000 | Takano et al. | 438/160 |
| 6,167,208 | A * | 12/2000 | Sato | 396/532 |
| 6,184,874 | B1 | 2/2001 | Smith et al. | 345/204 |
| 6,188,379 | B1 | 2/2001 | Kaneko | 345/102 |
| 6,215,466 | B1 | 4/2001 | Yamazaki et al. | 345/89 |
| 6,222,515 | B1 * | 4/2001 | Yamaguchi et al. | 345/89 |
| 6,229,583 | B1 | 5/2001 | Yasunishi | 349/33 |
| 6,232,941 | B1 | 5/2001 | Ode et al. | 345/95 |
| 6,239,781 | B1 | 5/2001 | Fujisawa | 345/147 |
| 6,245,256 | B1 * | 6/2001 | Wu et al. | 252/299.6 |
| 6,245,257 | B1 * | 6/2001 | Sakai et al. | 252/299.62 |
| 6,292,168 | B1 | 9/2001 | Venable et al. | 345/605 |
| 6,297,813 | B1 | 10/2001 | Okada et al. | 345/204 |
| 6,300,927 | B1 | 10/2001 | Kubota et al. | 345/92 |
| 6,320,565 | B1 | 11/2001 | Albu et al. | 345/98 |
| 6,320,568 | B1 | 11/2001 | Zavracky | 345/101 |
| 6,323,871 | B1 | 11/2001 | Fujiyoshi et al. | 345/598 |
| 6,326,941 | B1 | 12/2001 | Yamazaki et al. | 345/95 |
| 6,331,844 | B1 | 12/2001 | Okumura et al. | 345/87 |
| 6,335,716 | B1 * | 1/2002 | Yamazaki et al. | 345/92 |
| 6,335,717 | B2 | 1/2002 | Hasegawa et al. | 345/97 |
| 6,353,435 | B2 | 3/2002 | Kudo et al. | 345/204 |
| 6,369,785 | B1 * | 4/2002 | Imai | 345/76 |
| 6,380,917 | B2 * | 4/2002 | Matsueda et al. | 345/89 |
| 6,452,583 | B1 | 9/2002 | Takeuchi et al. | 345/108 |
| 6,459,416 | B1 | 10/2002 | Sasaki et al. | 345/89 |
| 6,462,728 | B1 | 10/2002 | Janssen et al. | 345/100 |
| 6,590,581 | B1 | 7/2003 | Koyama et al. | 345/600 |
| 6,753,854 | B1 | 6/2004 | Koyama et al. | 345/204 |
| 2002/0047852 | A1 | 4/2002 | Inukai et al. | 345/629 |
| 2003/0058210 | A1 | 3/2003 | Yamazaki et al. | 345/89 |

FOREIGN PATENT DOCUMENTS

| | | |
|---|---|---|
| EP | 0 433 054 A2 | 6/1991 |
| EP | 0 484 159 A2 | 5/1992 |
| EP | 0 655 726 A1 | 5/1995 |
| EP | 0 853 254 A2 | 7/1998 |
| EP | 0 875 881 | 11/1998 |
| JP | 7-130652 | 5/1995 |
| JP | 7-135318 | 5/1995 |
| JP | 8-078329 | 3/1996 |
| JP | 10-092576 | 4/1998 |
| JP | 10-214060 | 8/1998 |
| JP | 10-232649 | 9/1998 |
| JP | 10-312173 | 11/1998 |
| WO | WO 90/13148 | 11/1990 |

OTHER PUBLICATIONS

Furue, H. et al, "Characteristics and Driving Scheme of Polymer-Stabilized Monostable FLCD Exhibiting Fast Response Time and High Contrast Ratio with Gray-Scale Capability," *SID 98 Digest*, pp. 782-785, 1998.

Inui, S. et al, "Thresholdless Antiferroelectricity in Liquid Crystals and its Application to Displays," *J. Mater. Chem.*, vol. 6, No. 4, pp. 671-673, 1996.

Schenk, H. et al, "Polymers for Light Emitting Diodes," *EuroDisplay '99: Proceedings of the 19th International Display Research Conference*, Sep. 6-9, 1999, Berlin, Germany, pp. 33-37.

English abstract re Japanesse patent application No. 10-092576, published Apr. 10, 1998.

European Search Report re application No. EP 00 10 5500, dated Dec. 5, 2000.

English abstract re Japanese Patent Application No. JP 7-130652, published May 19, 1995.

English abstract re Japanese Patent Application No. JP 7-135318, published May 23, 1995.

English abstract re Japanese Patent Application No. JP 8-078329, published Mar. 22, 1996.

U.S. Appl. No. 09/507,825 (pending) to Yamazaki et al, filed Feb. 22, 2000, including specification, claims, drawings and PTO filing receipt.

U.S. Appl. No. 09/534,812 (pending) to Yamazaki et al, filed Mar. 24, 2000, including specification, claims, drawings and PTO filing receipt.

U.S. Appl. No. 09/536,782 (pending) to , filed Mar. 28, 2000, including specification, claims, drawings and PTO filing receipt.

Miyashita, T. et al., "Properties of the OCB Mode for Active-Matrix LCDs wtih Wide Viewing Angle," SID 95 Digest, pp. 797-800 (1995).

* cited by examiner

DISPLAY DEVICE

BACKGROUND OF THE INVENTION

1. Field of the Invention

The present invention relates to a display device, more specifically, a display device in which gray scale display is made by both the voltage gray scale method and the time ratio gray scale.

2. Description of the Related Art

A technique that has recently accomplished rapid development is to manufacture a semiconductor device in which semiconductor thin films are formed on an inexpensive glass substrate, for example, a thin film transistor (TFT). This rapid development is caused by a growing demand for active matrix type display devices.

In an active matrix display device, a pixel TFT is placed in each of pixel regions as many as several hundred thousands to several millions arranged in matrix, and electric charge that flows into and out of a pixel electrode connected to each pixel TFT is controlled by the switching function of the pixel TFT.

As images are displayed with higher definition and higher resolution, demand for multi-gray scale display, desirably, in full color, has been established in recent years.

Accompanying the movement regarding display devices towards higher definition and higher resolution, the active matrix display device that has drawn attention most is a digital driven active matrix display device that can be driven at a high speed.

The digital driven active matrix display device needs a D/A converter circuit (DAC) for converting digital video data inputted from the external into analogue data (voltage gray scale). There are various kinds of D/A converter circuits.

The multi-gray scale display capability of the digital driver active matrix display device is dependent on the capacity of this D/A converter circuit, namely, how many bits of digital video data the D/A converter circuit can convert into analogue data. For instance, in general, a display device having a D/A converter circuit that processes 2 bit digital video data is capable of $2^2=4$ gray scale display. If the circuit processes 8 bit data, the device is capable of $2^8=256$ gray scale display, if n bit, $2^n$ gray scale display.

However, enhancement of the capacity of the D/A converter circuit costs complicated circuit structure and enlarged layout area for the D/A converter circuit. According to a lately reported display device, a D/A converter circuit is formed on the same substrate where an active matrix circuit is formed, using a polysilicon TFT. In this case, the structure of the D/A converter circuit is complicated to lower the yield of the D/A converter circuit, resulting in yield decrease of the display device. In addition, increased layout area of the D/A converter circuit makes it difficult to downsize the display device.

SUMMARY OF THE INVENTION

The present invention has been made in view of the problems above and, therefore, an object of the present invention is to provide a display device capable of multi-gray scale display.

First, reference is made to FIG. 1. FIG. 1 is a structural diagram schematically showing a display device of the present invention. Reference numeral 101 denotes a display panel comprising digital drivers. Denoted by 101-1 is a source-driver, 101-2 and 101-3 denote gate drivers, and

101-4 designates an active matrix circuit with a plurality of pixel TFTs arranged in matrix. The source driver 101-1 and the gate drivers 101-2, 101-3 drive the active matrix circuit. Reference numeral 102 denotes a digital video data time ratio gray scale processing circuit. Note that, display devices and display panels are discriminated from one another in this specification, but note that a display panel including a digital video data time ratio gray scale circuit may also be referred to as a display device.

The digital video data time ratio gray scale processing circuit 102 converts, among m bit digital video data inputted from the external, n bit digital video data into n bit digital video data for voltage gray scale. Gray scale information of (m−n) bit data of the m bit digital video data is expressed by time ratio gray scale.

The n bit digital video data converted by the digital video data time ratio gray scale processing circuit 102 is inputted to the display panel 101. The n bit digital video data inputted to the display panel 101 is then inputted to the source driver and converted into analogue gray scale data by the D/A converter circuit within the source driver and then sent to each source signal line.

Shown next in FIG. 2 is another example of the display device of the present invention. In FIG. 2, reference numeral 201 denotes a display panel having analogue drivers. Reference numeral 201-1 denotes a source driver, 201-2 and 201-3 denote gate drivers, and 2014 denotes an active matrix circuit with a plurality of pixel TFTs arranged in matrix. The source driver 201-1 and the gate drivers 201-2 and 201-3 drive the active matrix circuit. Denoted by 202 is an A/D converter circuit that converts analogue video data sent from the external into m bit digital video data. Reference numeral 203 denotes a digital video data time ratio gray scale processing circuit. The digital video data time ratio gray scale processing circuit 203 converts, among inputted m bit digital video data, n bit digital video data into n bit digital video data for voltage gray scale. Gray scale information of (m−n) bit of the inputted m bit digital video data is expressed by time ratio gray scale. The n bit digital video data converted by the digital video data time ratio gray scale processing circuit 203 is inputted to a D/A converter circuit 204 to be converted into analogue video data. The analogue video data converted by the D/A converter circuit 204 is inputted to the display panel 201. The analogue video data inputted to the display panel 201 is then inputted to the source driver, sampled by a sampling circuit within the source driver and sent to each source signal line.

Now, a description is given on the structure of the present invention.

According to the present invention, there is provided a display device comprising:

an active matrix circuit comprising a plurality of pixel TFTs arranged in matrix and a source driver and a gate driver that drive the active matrix circuit, characterized in that, among m bit digital video data inputted from the external, n bit data and (m−n) bit data are respectively used for voltage gray scale information and time ratio gray scale information, (m and n are both positive integers equal to or larger than 2 and satisfy m>n), to thereby conduct the voltage gray scale method and the time ratio gray scale, simultaneously.

According to the present invention, there is provided a display device comprising:

an active matrix circuit comprising a plurality of pixel TFTs arranged in matrix and a source driver and a gate driver that drive the active matrix circuit, characterized in that, among m bit digital video data inputted from the external, n bit data and (m−n) bit data are respectively used for voltage gray scale information and time ratio gray scale information, (m and n are both positive integers equal to or larger than 2 and satisfy m>n), to thereby conduct first the voltage gray scale method and then the time ratio gray scale, or conduct one immediately before conducting the other.

According to the present invention, there is provided a liquid crystal display device comprising:

an active matrix circuit having a plurality of pixel TFTs arranged in matrix;

a source driver and a gate driver that drive the active matrix circuit; and a circuit which converts m bit digital video data inputted from the external into n bit digital video data, and supplies the source driver with the n bit digital video data (m and n are both positive integers equal to or larger than 2, and satisfy m>n), characterized in that:

display is made by conducting the voltage gray scale method and the time ratio gray scale simultaneously, and by forming one frame of image from $2^{m-n}$ sub-frames.

According to the present invention, there is provided a display device comprising:

an active matrix circuit having a plurality of pixel TFTs arranged in matrix;

a source driver and a gate driver that drive the active matrix circuit; and a circuit which converts m bit digital video data inputted from the external into n bit digital video data, and supplies the source driver with the n bit digital video data (m and n are both positive integers equal to or larger than 2, and satisfy m>n), characterized in that display is made by conducting first the voltage gray scale method and then the time ratio gray scale or conducting one immediately before the other, and by forming one frame of image from $2^{m-n}$ sub-frames.

According to the present invention, there is provided a display device comprising:

an active matrix circuit with a plurality of pixel TFTs arranged in matrix, and a source driver and a gate driver for driving the active matrix circuit, characterized in that, among m bit digital video data inputted from the external, n bit data and (m−n) bit data are respectively used for voltage gray scale information and time ratio gray scale information, (m and n are both positive integers equal to or larger than 2 and satisfy m>n), to thereby conduct the voltage gray scale method and the time ratio gray scale, simultaneously, obtaining $(2^m-(2^{m-n}-1))$ patterns of gray scale display.

According to the present invention, there is provided a display device comprising:

an active matrix circuit having a plurality of pixel TFTs arranged in matrix and a source driver and a gate driver that drive the active matrix circuit, characterized in that, among m bit digital video data inputted from the external, n bit data and (m−n) bit data are respectively used for voltage gray scale information and time ratio gray scale information, (m and n are both positive integers equal to or larger than 2 and satisfy m>n), to thereby conduct first the voltage gray scale method and then the time ratio gray scale or conduct one immediately before the other, obtaining $(2^m-(2^{m-n}-1))$ patterns of gray scale display.

According to the present invention, there is provided a display device comprising:

an active matrix circuit with a plurality of pixel TFTs arranged in matrix;

a source driver and a gate driver that drive the active matrix circuit; and a circuit which converts m bit digital video data inputted from the external into n bit digital video data, and supplies the source driver with the n bit digital video data (m and n are both positive integers equal to or larger than 2, and satisfy m>n), characterized in that the voltage gray scale method and the time ratio gray scale are conducted simultaneously, and one frame of image consists of $2^{m-n}$ sub-frames, thereby obtaining $(2^m-(2^{m-n}-1))$ patterns of gradation display.

According to the present invention, there is provided a display device comprising:

an active matrix circuit having a plurality of pixel TFTs arranged in matrix;

a source driver and a gate driver that drive the active matrix circuit; and a circuit which converts m bit digital video data inputted from the external into n bit digital video data, and supplies the source driver with the n bit digital video data (m and n are both positive integers equal to or larger than 2, and satisfy m>n), characterized in that the voltage gray scale method is first conducted and the time ratio gray scale is conducted next or one is conducted immediately before the other, and one frame of image consists of $2^{m-n}$ sub-frames, thereby obtaining $(2^m-(2^{m-n}-1))$ patterns of gray scale display.

The above-mentioned display device may use thresholdless anti-ferroelectric mixed liquid crystal with electro-optical characteristic of V shape.

The above-mentioned m and n may be 8 and 2, respectively.

The above-mentioned m and n may be 12 and 4, respectively.

DETAILED DESCRIPTION OF THE PREFERRED EMBODIMENT

A description will be made in the following on a display device of the present invention using preferred embodiments. However, the display device of the present invention is not limited to the embodiments below.

Embodiment Mode 1

Figure 1:
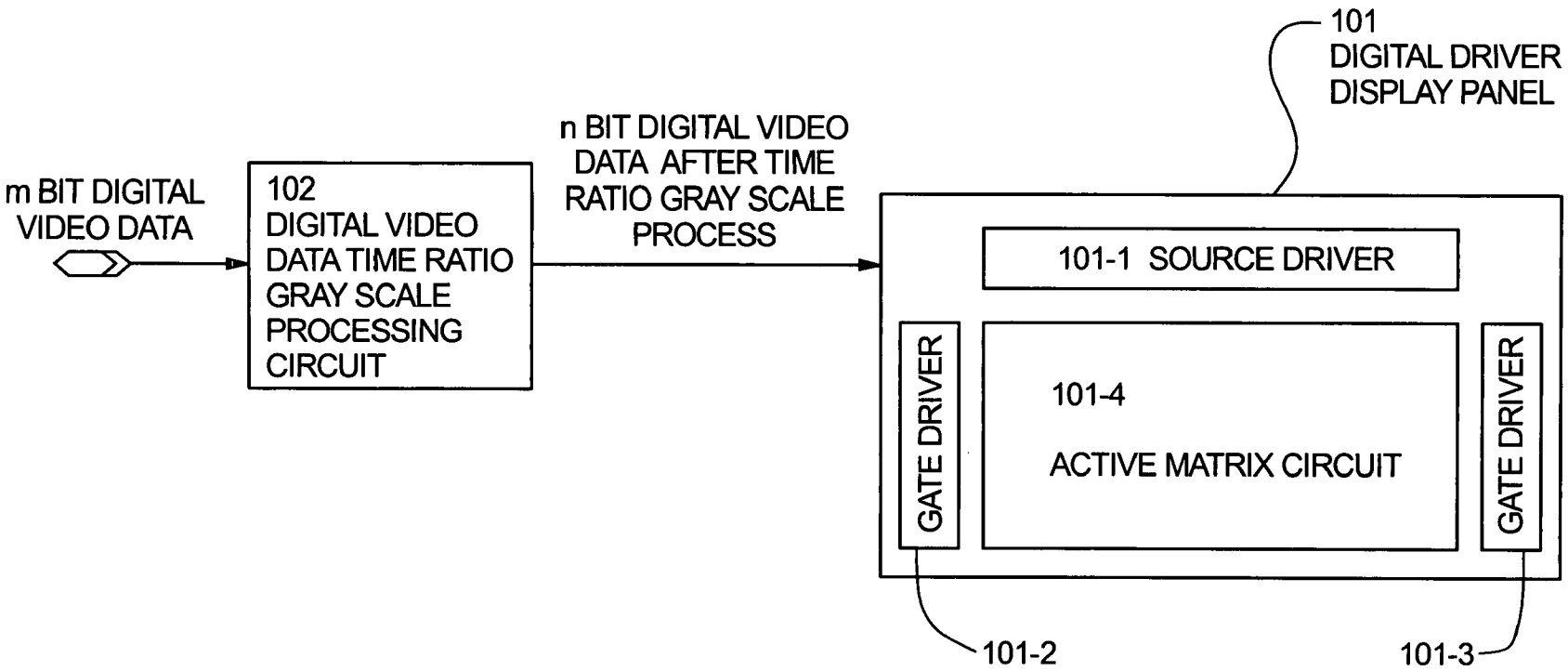
FIG. 1 is a structural diagram schematically showing a display device of the present invention.
Figure 2:
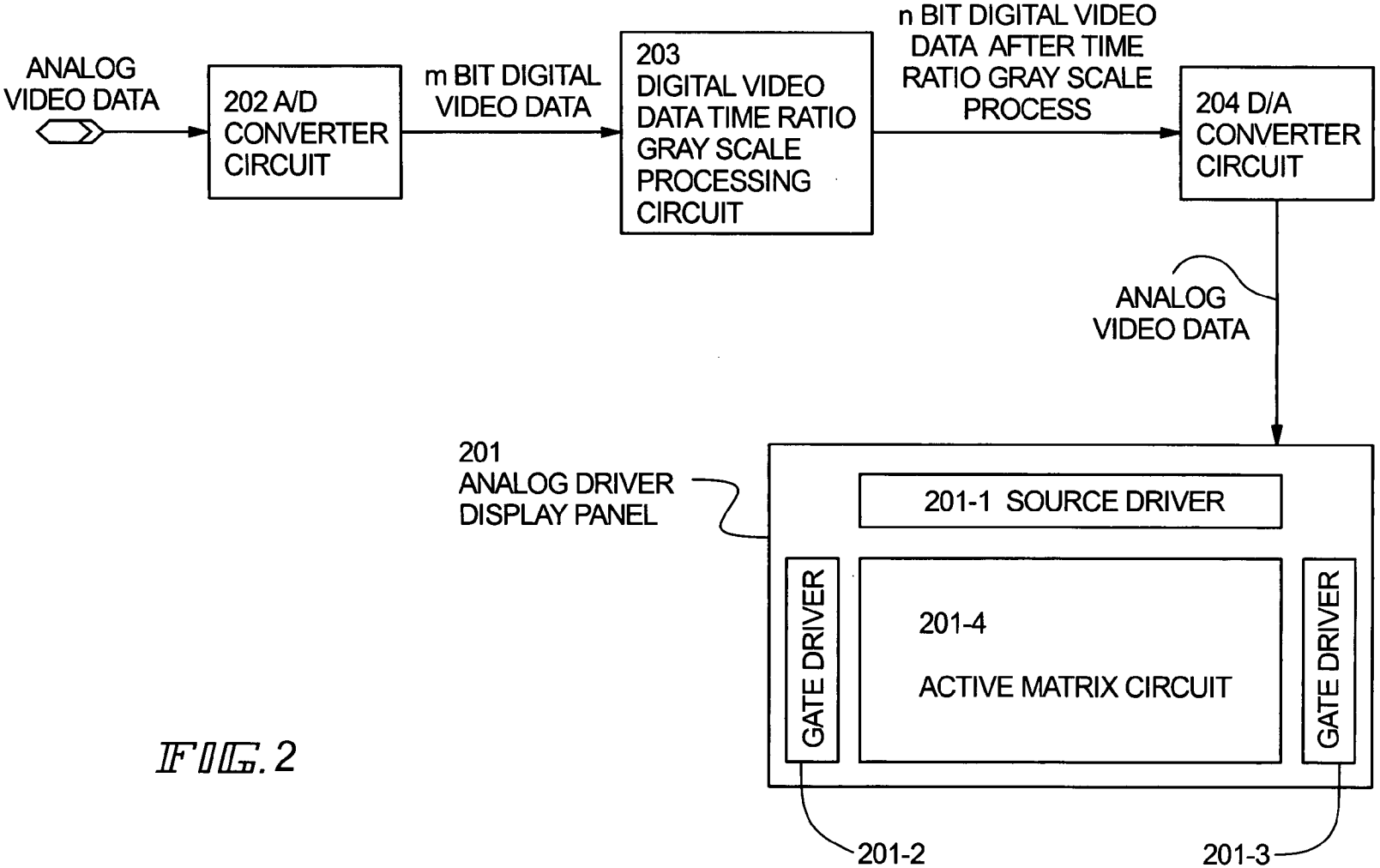
FIG. 2 is a structural diagram schematically showing another display device of the present invention.
Figure 3:
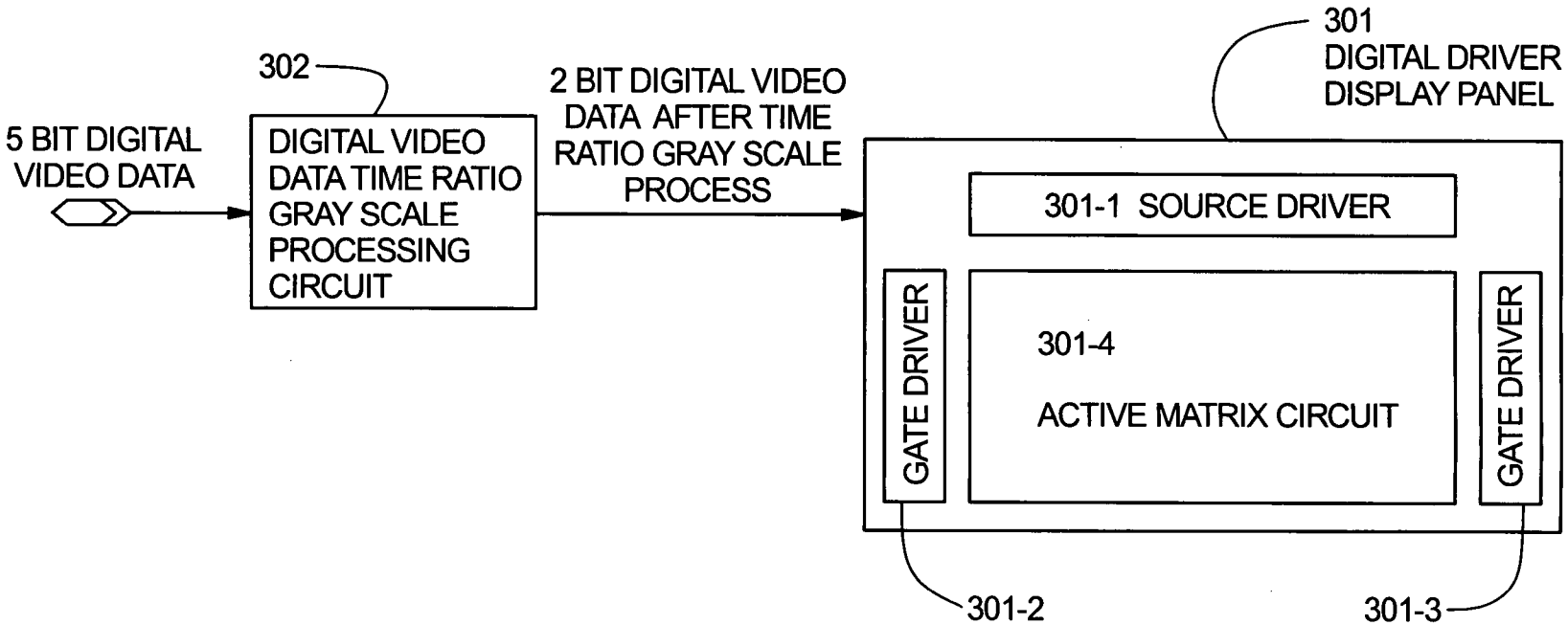
FIG. 3 is a structural diagram schematically showing a display device according to an embodiment mode of the present invention.

FIG. 3 schematically shows a structural diagram of a display device of this embodiment mode. In this embodiment mode, a display device to which 5 bit digital video data is sent from the external is taken as an example with the intention of simplifying the explanation.

Reference numeral 301 denotes a display panel having digital drivers. Denoted by 301-1 is a source driver, 301-2 and 301-3 are gate drivers, 301-4 is an active matrix circuit with a plurality of pixel TFTs arranged in matrix.

A digital video data time ratio gray scale processing circuit 302 converts, 2 bit digital video data of 5 bit digital video data inputted from the external into 2 bit digital video data for voltage gray scale method. Among the 5 bit digital video data, 3 bit gray scale information is expressed in time ratio gray scale.

The 2 bit digital video data underwent the conversion by the digital video data time ratio gray scale processing circuit 302 is inputted to the display panel 301. The 2 bit digital video data inputted to the display panel 301 is then inputted to the source driver and converted into analogue gray scale data by a D/A converter circuit (not shown) within the source driver and then sent to each source signal line. The D/A converter circuit incorporated in the liquid crystal panel according to this embodiment mode converts 2 bit digital video data into analogue gray scale voltage.

Figure 4:
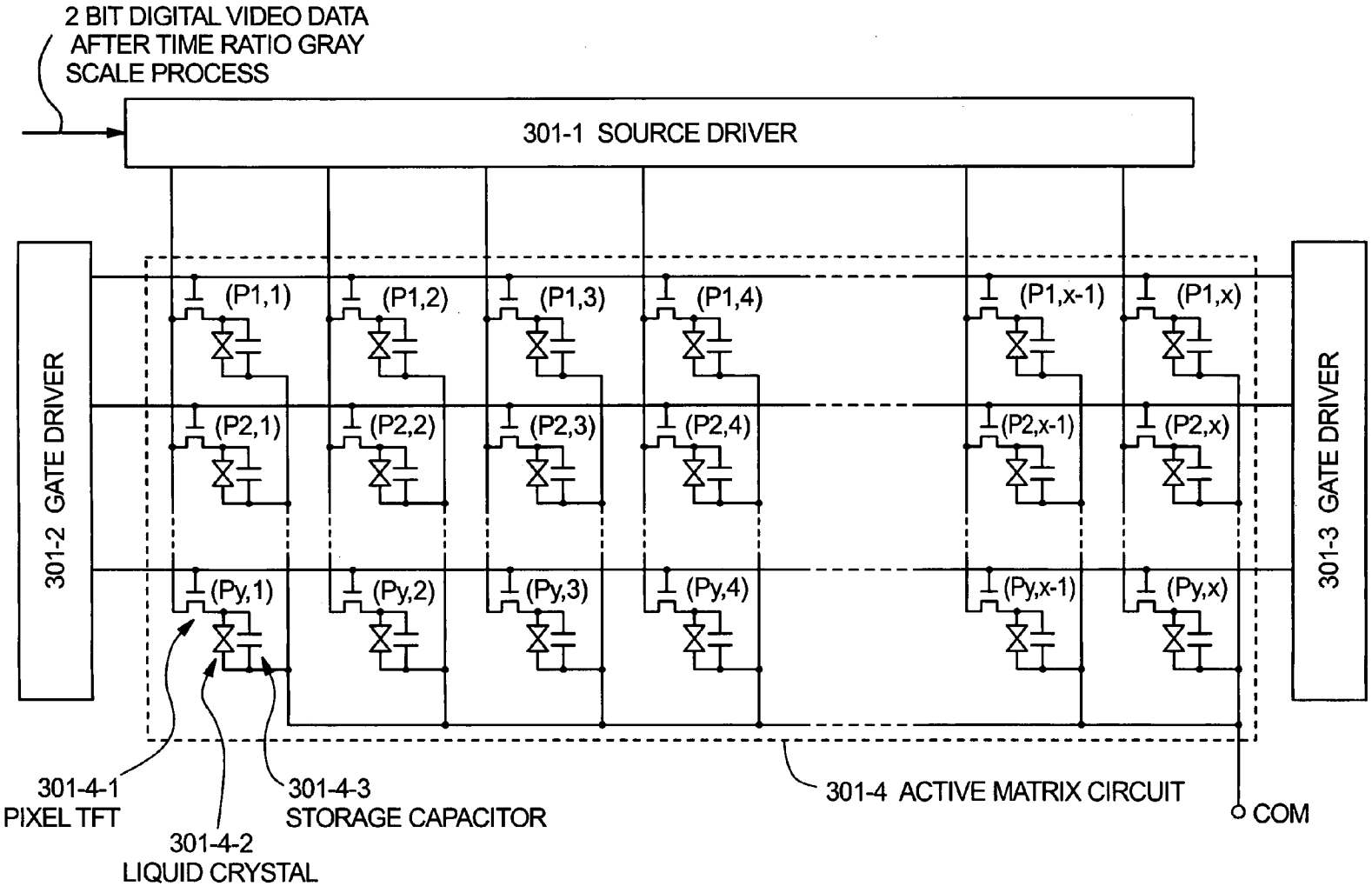
FIG. 4 is a diagram showing the circuit structure of an active matrix circuit, a source driver and gate drivers in a display device according to an embodiment mode of the present invention.

Here, a case when liquid crystal is applied as the display medium in the display device of the embodiment mode 1 is explained. Circuit structure of the display panel 301, specifically active matrix circuit 301-4 is explained by referring to FIG. 4.

The active matrix circuit 301-4 has (x×y) of pixels. For convenience of the explanation, each pixel is designated by a symbol such as P1,1, P2,1, . . . and Py,x. Also, each pixel has a pixel TFT 301-4-1 and a storage capacitor 301-4-3. Liquid crystal is held between an active matrix substrate, on which the source driver 301-1, the gate drivers 301-2 and 301-3 and the active matrix circuit 301-4 are formed, and an opposing substrate. Liquid crystal 301-4-2 schematically shows the liquid crystal for each of the pixel.

The digital driver liquid crystal panel of this embodiment mode drives pixels by each line (e.g., P1,1, P1,2, . . . , P1,x) simultaneously: so-called line sequential driving. In other words, analogue voltage gray scale is written to pixels of one line at once. A time required to write analogue voltage gray scale in all pixels (P1,1 to Py,x) is named here one frame period (Tf). One frame period (Tf) is divided into eight periods, which are referred to as sub-frame periods (Tsf) in this embodiment mode. Further, a time required to write analogue voltage gray scale in pixels of one line (e.g., P1,1, P1,2, . . . , P1,x) is called one sub-frame line period (Tsfl).

Figure 5:
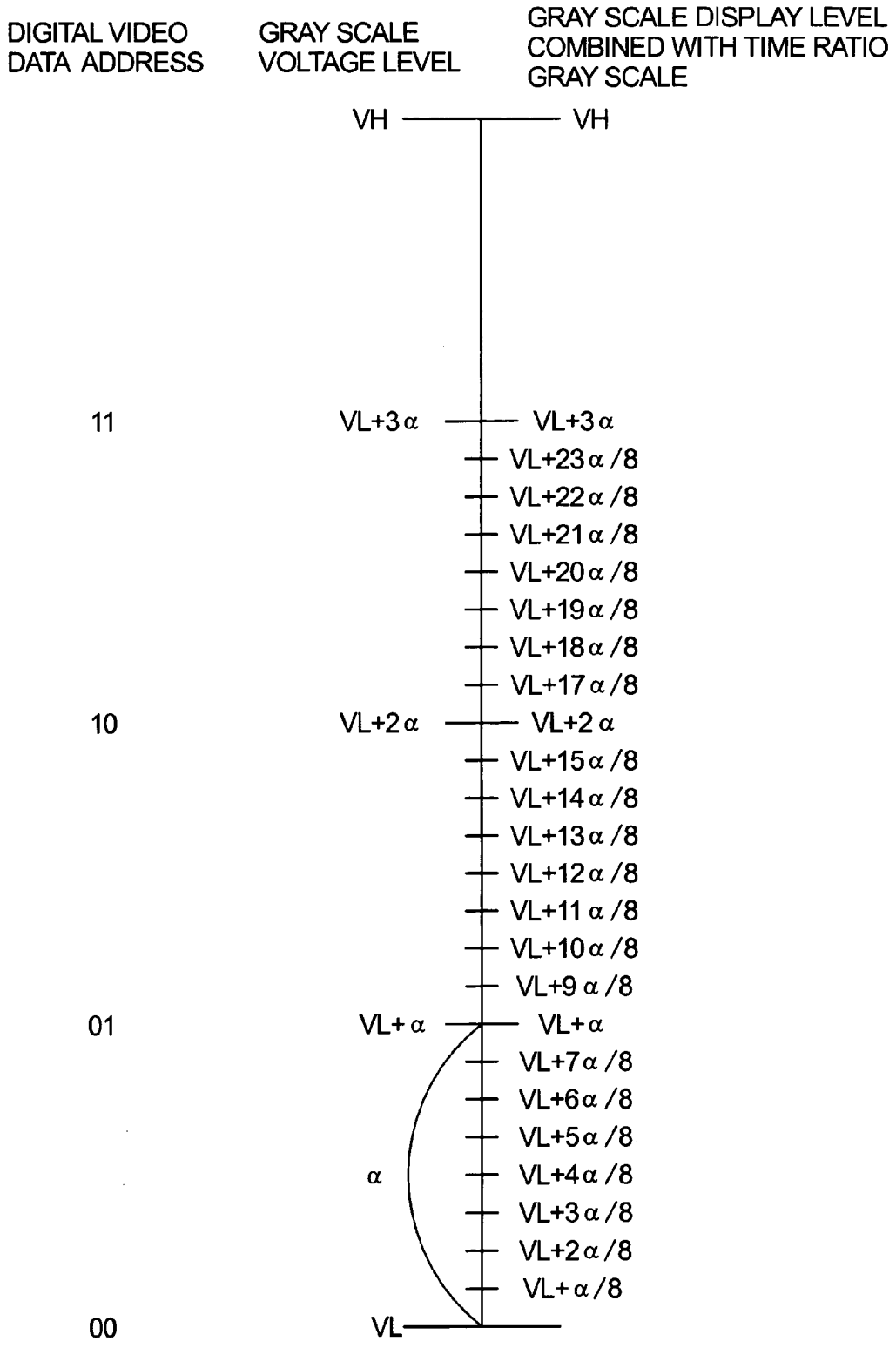
FIG. 5 is a diagram showing the gray scale display level of a display device according to an embodiment mode of the present invention.

Gray scale display in the display device of this embodiment mode will now be described. The digital video data sent from the external to the display device of this embodiment mode is 5 bit and contains information of 32 gray scales. Here, reference is made to FIG. 5. FIG. 5 shows gray scale display level of the display device of this embodiment mode. The voltage level VL is the lowest voltage level of voltage inputted to the D/A converter circuit. The voltage level VH is the highest voltage level of voltages inputted to the D/A converter circuit.

In this embodiment mode, the level between the voltage level VH and the voltage level VL is divided equally into four to obtain voltage level of 2 bit, namely, of 4 gray scale, and each step of the voltage level is designated α. Here, α is: (α=(VH−VL)/4). Therefore, the voltage gray scale level outputted from the D/A converter circuit of this embodiment mode is VL when the address of the digital video data is (00), VL+α when the address of the digital video data is (01), VL+2α when the address of the digital video data is (10), and VL+3α when the address of the digital video data is (11).

The D/A converter circuit of this embodiment mode can output four patterns of voltage gray scale levels, namely VL, (VL+α), (VL+2α) and (VL+3α), as described above. Then combining them with the time ratio gray scale display, the present invention may increase the number of gray scale display levels for the display device. In this embodiment mode, information corresponding to 3 bit digital video data of the 5 bit digital video data is used for the time ratio gray scale display so as to realize a display of gray scale level that is equal to a voltage gray scale level in which each step of voltage level α is approximately divided into 8. That is, the display device of this embodiment mode may acquire gray scale display levels corresponding to voltage gray scale levels of VL, (VL+α/8), (VL+2α/8), (VL+3α/8), (VL+4α/8), (VL+5α/8), (VL+6α/8), (VL+7α/8), (VL+α), (VL+9α/8), (VL+10α/8), (VL+11α/8), (VL+12α/8), (VL+13α/8), (VL+14α/8), (VL+15α/8), (VL+2α), (VL+17α/8), (VL+18α/8), (VL+19α/8), (VL+20α/8), (VL+21α/8), (VL+22α/8), (VL+23α/8), and (VL+3α).

The 5 bit digital video data address inputted from the external; time ratio gray scale-processed digital video data address and corresponding voltage gray scale level; and gray scale display level combined with the time ratio gray scale are related in Tables 1 and 2 below.

TABLE 1

| Digital Video Data Address | | Time ratio gray scale-processed Digital Video Data Address (Voltage gray scale Level) | | | | | | | | Gray scale Display Level Combined with Time ratio gray-scale |
|---|---|---|---|---|---|---|---|---|---|---|
| | | 1st Tsfl | 2nd Tsfl | 3rd Tsfl | 4th Tsfl | 5th Tsfl | 6th Tsfl | 7th Tsfl | 8th Tsfl | |
| 00 | 000 | 00 (VL) | 00 (VL) | 00 (VL) | 00 (VL) | 00 (VL) | 00 (VL) | 00 (VL) | 00 (VL) | VL |
| | 001 | 00 (VL) | 00 (VL) | 00 (VL) | 00 (VL) | 00 (VL) | 00 (VL) | 00 (VL) | 01 (VL + α) | VL + α/8 |
| | 010 | 00 (VL) | 00 (VL) | 00 (VL) | 00 (VL) | 00 (VL) | 00 (VL) | 01 (VL + α) | 01 (VL + α) | VL + 2α/8 |
| | 011 | 00 (VL) | 00 (VL) | 00 (VL) | 00 (VL) | 00 (VL) | 01 (VL + α) | 01 (VL + α) | 01 (VL + α) | VL + 3α/8 |
| | 100 | 00 (VL) | 00 (VL) | 00 (VL) | 00 (VL) | 01 (VL + α) | 01 (VL + α) | 01 (VL + α) | 01 (VL + α) | VL + 4α/8 |
| | 101 | 00 (VL) | 00 (VL) | 00 (VL) | 01 (VL + α) | 01 (VL + α) | 01 (VL + α) | 01 (VL + α) | 01 (VL + α) | VL + 5α/8 |
| | 110 | 00 (VL) | 00 (VL) | 01 (VL + α) | 01 (VL + α) | 01 (VL + α) | 01 (VL + α) | 01 (VL + α) | 01 (VL + α) | VL + 6α/8 |
| | 111 | 00 (VL) | 01 (VL + α) | 01 (VL + α) | 01 (VL + α) | 01 (VL + α) | 01 (VL + α) | 01 (VL + α) | 01 (VL + α) | VL + 7α/8 |
| 01 | 000 | 01 (VL + α) | 01 (VL + α) | 01 (VL + α) | 01 (VL + α) | 01 (VL + α) | 01 (VL + α) | 01 (VL + α) | 01 (VL + α) | VL + α |
| | 001 | 01 (VL + α) | 01 (VL + α) | 01 (VL + α) | 01 (VL + α) | 01 (VL + α) | 01 (VL + α) | 01 (VL + α) | 10 (VL + 2α) | VL + 9α/8 |
| | 010 | 01 (VL + α) | 01 (VL + α) | 01 (VL + α) | 01 (VL + α) | 01 (VL + α) | 01 (VL + α) | 10 (VL + 2α) | 10 (VL + 2α) | VL + 10α/8 |
| | 011 | 01 (VL + α) | 01 (VL + α) | 01 (VL + α) | 01 (VL + α) | 01 (VL + α) | 10 (VL + 2α) | 10 (VL + 2α) | 10 (VL + 2α) | VL + 11α/8 |
| | 100 | 01 (VL + α) | 01 (VL + α) | 01 (VL + α) | 01 (VL + α) | 10 (VL + 2α) | 10 (VL + 2α) | 10 (VL + 2α) | 10 (VL + 2α) | VL + 12α/8 |
| | 101 | 01 (VL + α) | 01 (VL + α) | 01 (VL + α) | 10 (VL + 2α) | 10 (VL + 2α) | 10 (VL + 2α) | 10 (VL + 2α) | 10 (VL + 2α) | VL + 13α/8 |
| | 110 | 01 (VL + α) | 01 (VL + α) | 10 (VL + 2α) | 10 (VL + 2α) | 10 (VL + 2α) | 10 (VL + 2α) | 10 (VL + 2α) | 10 (VL + 2α) | VL + 14α/8 |
| | 111 | 01 | 10 | 10 | 10 | 10 | 10 | 10 | 10 | VL + 15α/8 |

TABLE 1-continued

| Digital Video Data Address | Time ratio gray scale-processed Digital Video Data Address (Voltage gray scale Level) 1st Tsfl | 2nd Tsfl | 3rd Tsfl | 4th Tsfl | 5th Tsfl | 6th Tsfl | 7th Tsfl | 8th Tsfl | Gray scale Display Level Combined with Time ratio gray-scale |
|---|---|---|---|---|---|---|---|---|---|
| | (VL + α) | (VL + 2α) | (VL + 2α) | (VL + 2α) | (VL + 2α) | (VL + 2α) | (VL + 2α) | (VL + 2α) | |

TABLE 2

| Digital Video Data Address | Time ratio gray scale-processed Digital Video Data Address (Voltage gray scale Level) 1st Tsfl | 2nd Tsfl | 3rd Tsfl | 4th Tsfl | 5th Tsfl | 6th Tsfl | 7th Tsfl | 8th Tsfl | Gray scale Display Level Combined with Time ratio gray scale |
|---|---|---|---|---|---|---|---|---|---|
| 10 000 | 10 (VL + 2α) | 10 (VL + 2α) | 10 (VL + 2α) | 10 (VL + 2α) | 10 (VL + 2α) | 10 (VL + 2α) | 10 (VL + 2α) | 10 (VL + 2α) | VL + 2α |
| 001 | 10 (VL + 2α) | 10 (VL + 2α) | 10 (VL + 2α) | 10 (VL + 2α) | 10 (VL + 2α) | 10 (VL + 2α) | 10 (VL + 2α) | 11 (VL + 3α) | VL + 17α/8 |
| 010 | 10 (VL + 2α) | 10 (VL + 2α) | 10 (VL + 2α) | 10 (VL + 2α) | 10 (VL + 2α) | 10 (VL + 2α) | 11 (VL + 3α) | 11 (VL + 3α) | VL + 18α/8 |
| 011 | 10 (VL + 2α) | 10 (VL + 2α) | 10 (VL + 2α) | 10 (VL + 2α) | 10 (VL + 2α) | 11 (VL + 3α) | 11 (VL + 3α) | 11 (VL + 3α) | VL + 19α/8 |
| 100 | 10 (VL + 2α) | 10 (VL + 2α) | 10 (VL + 2α) | 10 (VL + 2α) | 11 (VL + 3α) | 11 (VL + 3α) | 11 (VL + 3α) | 11 (VL + 3α) | VL + 20α/8 |
| 101 | 10 (VL + 2α) | 10 (VL + 2α) | 10 (VL + 2α) | 11 (VL + 3α) | 11 (VL + 3α) | 11 (VL + 3α) | 11 (VL + 3α) | 11 (VL + 3α) | VL + 21α/8 |
| 110 | 10 (VL + 2α) | 10 (VL + 2α) | 11 (VL + 3α) | 11 (VL + 3α) | 11 (VL + 3α) | 11 (VL + 3α) | 11 (VL + 3α) | 11 (VL + 3α) | VL + 22α/8 |
| 111 | 10 (VL + 2α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 23α/8 |
| 11 000 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |
| 001 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |
| 010 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |
| 011 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |
| 100 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |
| 101 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |
| 110 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |
| 111 | 11 (VL + 3α) | 11 (VL + 3α) | 11 (VL + 3α) | 11 (VL + 3α) | 11 (VL + 3α) | 11 (VL + 3α) | 11 (VL + 3α) | 11 (VL + 3α) | VL + 3α |

The display device of this embodiment mode carries out display by dividing one frame period Tf into 8 sub-frame periods (1st Tsf, 2nd Tsf, 3rd Tsf, 4th Tsf, 5th Tsf, 6th Tsf, 7th Tsf, and 8th Tsf). As the line sequential driving method is employed in the display device of this embodiment mode, gray scale voltage is written in each pixel during one sub-frame line period (Tsfl). Therefore, during the sub-frame line periods (1st Tsfl, 2nd Tsfl, 3rd Tsfl, 4th Tsfl, 5th Tsfl, 6th Tsfl, 7th Tsfl, and 8th Tsfl) corresponding to the sub-frame periods (1st Tsf, 2nd Tsf, 3rd Tsf and 4th Tsf), the address of time ratio gray scale-processed 2 bit digital video data is inputted to the D/A converter circuit, and gray scale voltage is outputted. With the gray scale voltage written during eight sub-frame line periods (1st Tsfl, 2nd Tsfl, 3rd Tsfl, 4th Tsfl, 5th Tsfl, 6th Tsfl, 7th Tsfl, and 8th Tsfl), eight sub-frames are displayed at a high speed. As a result, display gray scale of one frame corresponds to a value obtained by averaging by time the total of the gray scale voltage levels in each sub-frame line period. The voltage gray scale method and the time ratio gray scale are thus conducted simultaneously.

As shown in Tables 1 and 2, in this embodiment mode, same gray scale voltage level (VL+3α) is outputted when the address of the 5 bit digital video data is (11000) to (11111).

Thus the display of $2^5-7=25$ gray scale levels can be obtained in the display device of this embodiment mode even in case D/A converter circuit that handles 2 bit digital video data is used.

The address (or gray scale voltage level) of the digital video data written during the sub-frame line periods (1st Tsfl, 2nd Tsfl, 3rd Tsfl, 4th Tsfl, 5th Tsfl, 6th Tsfl, 7th Tsfl, and 8th Tsfl) may be set using a combination other than the combinations shown in Tables 1 and 2. For instance, in Tables 1 and 2, a gray scale voltage of (VL+α) is written during the fifth sub-frame period (5th Tsfl), the sixth sub-frame period (6th Tsfl), the seventh sub-frame period (7th Tsfl), and the eighth sub-frame period (8th Tsfl), when the digital video data address is (00100). However, the present invention can be carried out without being limited to this combination. That means the digital video data whose address is (00100) only needs (VL+α) gray scale voltage written during any four sub-frame line periods out of eight sub-frame line periods, i.e., the first sub-frame line period to the eighth sub-frame line period. There is no limitation in choosing and setting those four sub-frame line periods during which (VL+α) gray scale voltage is to be written.

Figure 6:
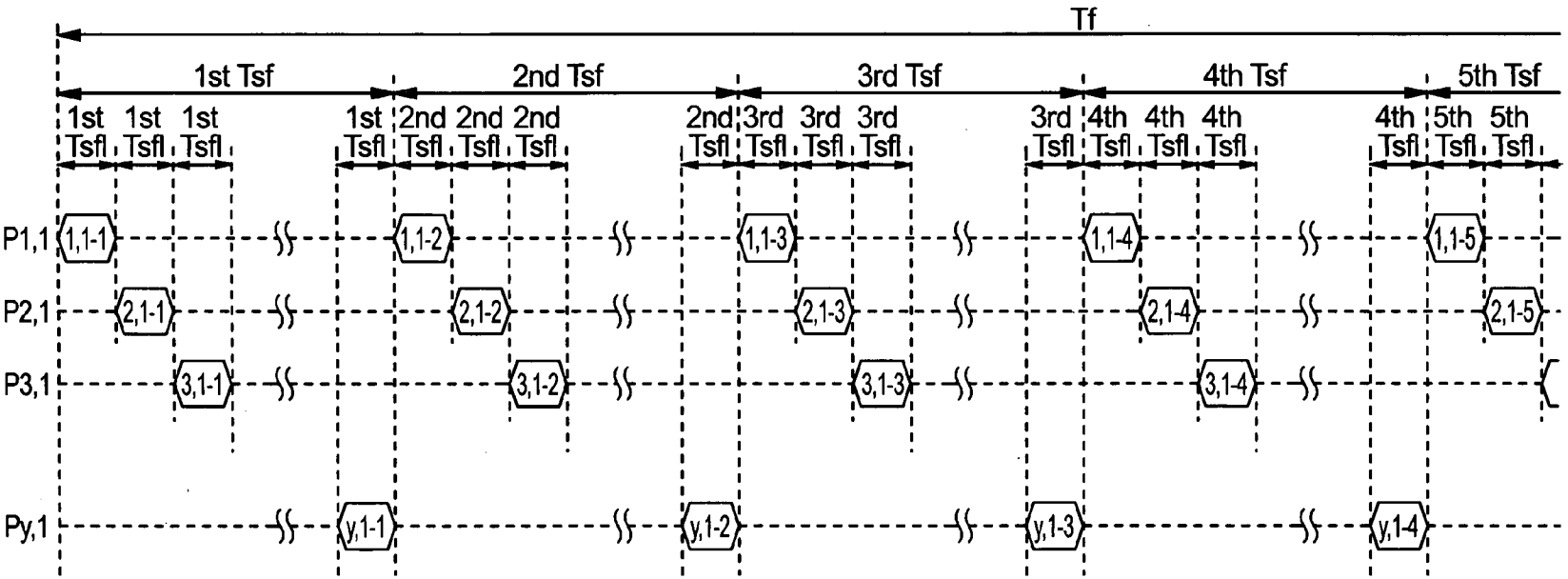
FIG. 6 is a diagram showing a drive timing chart of a display device according to an embodiment mode of the present invention.
Figure 7:
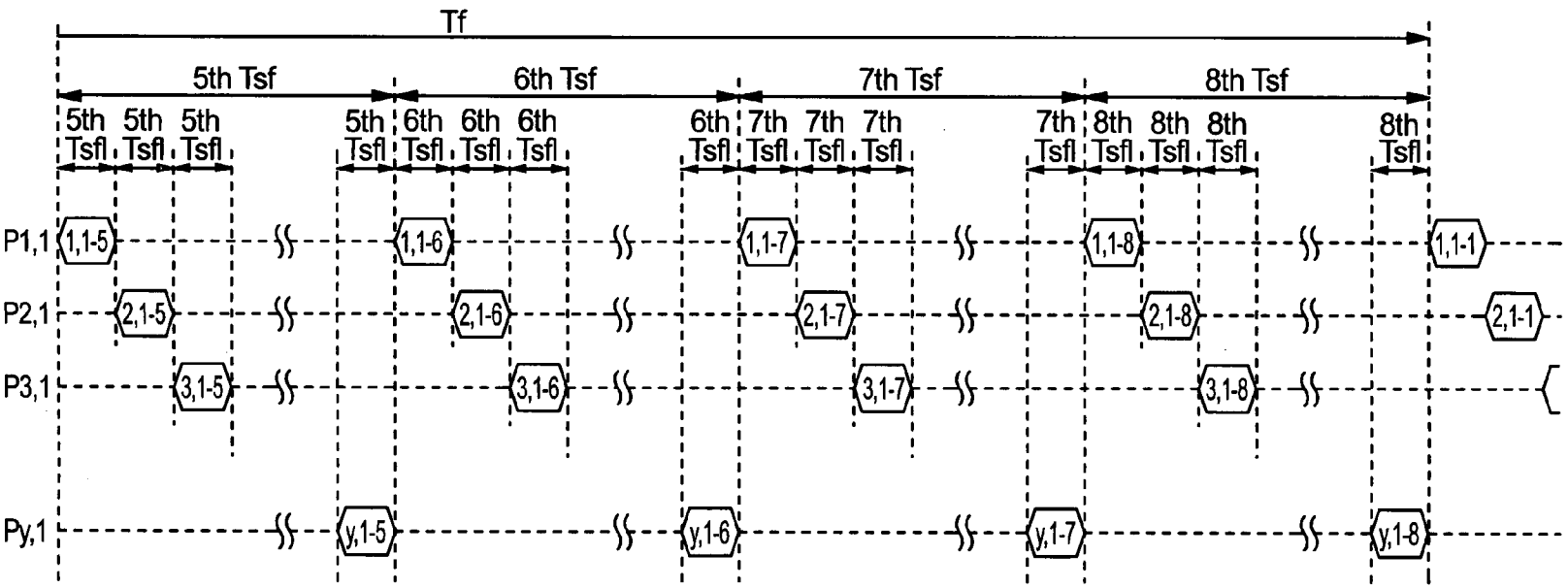
FIG. 7 is a diagram showing the drive timing chart of the display device according to an embodiment mode of the present invention.

FIGS. 6 and 7 show a drive timing chart for the display device of this embodiment mode. The pixels P1,1 to Py,1 are taken as an example in FIGS. 6 and 7. The drive timing chart is divided and shown in two diagrams, i.e., FIGS. 6 and 7, because of limited spaces.

When pixel P1,1 is referred, during each of the sub-frame line periods (1st Tsfl, 2nd Tsfl, 3rd Tsfl, 4th Tsfl, 5th Tsfl, 6th Tsfl, 7th Tsfl, and 8th Tsfl), digital video data 1,1-1, 1,1-2, 1,1-3, 1,1-4, 1,1-5, 1,1-6, 1,1-7, and 1,1-8 are written respectively in the pixel P1,1 through conversion by the D/A converter circuit into the analogue gray scale voltage. The digital video data 1,1-1, 1,1-2, 1,1-3, 1,1-4, 1,1-5, 1,1-6, 1,1-7, and 1,1-8 are 3 bit digital video data obtained by time ratio gray scale-processing the 5 bit digital video data. Such operation is performed on all the pixels.

Figure 8:
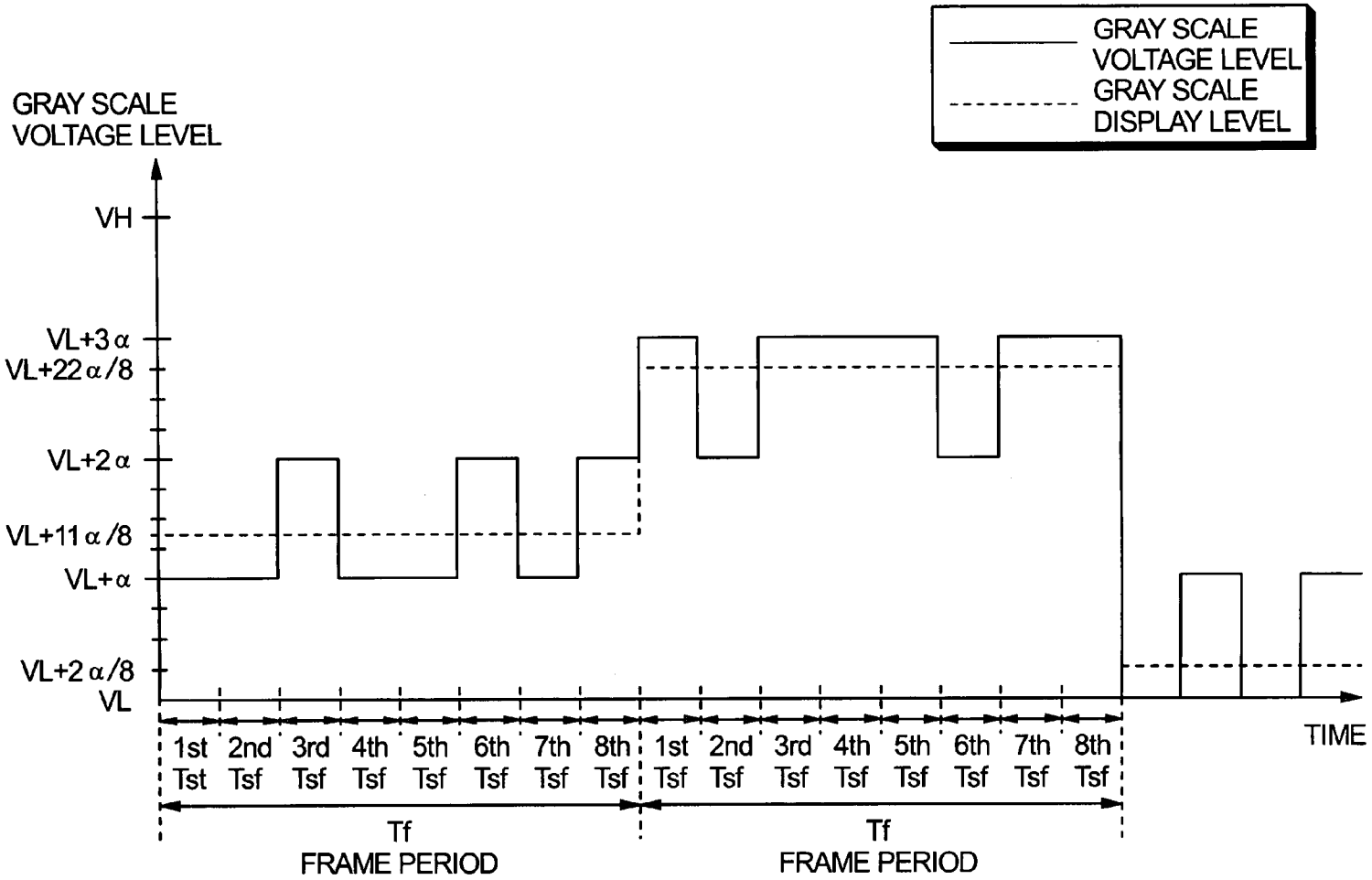
FIG. 8 is a diagram showing a drive timing chart of a display device according to an embodiment mode of the present invention

Here, reference is made to FIG. 8, which shows an example of the relationship between the gray scale voltage level to be written in a certain pixel (pixel P1,1, for example), and the sub-frame periods and the frame periods.

On taking notice of the first frame period in FIG. 8, a gray scale voltage of (VL+α) is written during the first sub-frame line period (1st Tsfl) and a gray scale display corresponding to the gray scale voltage of (VL+α) is made during the first sub-frame period (1st Tsf). Then, a gray scale voltage of (VL+α) is written during the second sub-frame line period (2nd Tsfl) and gray scale display corresponding to the gray scale voltage of (VL+α) is made during the second sub-frame period (2nd Tsf). Subsequently, a gray scale voltage of (VL+2α) is written during the third sub-frame line period (3rd Tsfl) and gray scale display corresponding to the gray scale voltage of (VL+2α) is made during the third sub-frame period (3rd Tsf). Thereafter, a gray scale voltage of (VL+α) is written during the fourth sub-frame line period (4th Tsfl) and gray scale display corresponding to the gray scale voltage of (VL+α) is made during the fourth sub-frame period (4th Tsf). A gray scale voltage of (VL+α) is written during the fifth sub-frame line period (5th Tsfl) and gray scale display corresponding to the gray scale voltage of (VL+α) is made during the fifth sub-frame period (5th Tsf). A gray scale voltage of (VL+2α) is written during the sixth sub-frame line period (6th Tsfl) and gray scale display corresponding to the gray scale voltage of (VL+2α) is made during the sixth sub-frame period (6th Tsf). A gray scale voltage of (VL+α) is written during the seventh sub-frame line period (7th Tsfl) and gray scale display corresponding to the gray scale voltage of (VL+α) is made during the seventh sub-frame period (7th Tsf). A gray scale voltage of (VL+2α) is written during the eighth sub-frame line period (8th Tsfl) and gray scale display corresponding to the gray scale voltage of (VL+2α) is made during the eighth sub-frame period (8th Tsf). The gray scale display level in the first frame, therefore, corresponds to the gray scale voltage level of (VL+11α/8).

Turning next to the second frame period, a gray scale voltage of (VL+3α) is written during the first sub-frame line period (1st Tsfl) and gray scale display corresponding to the gray scale voltage of (VL+3α) is made during the first sub-frame period (1st Tsf). Then, a gray scale voltage of (VL+2α) is written during the second sub-frame line period (2nd Tsfl) and gray scale display corresponding to the gray scale voltage of (VL+2α) is made during the second sub-frame period (2nd Tsf). Subsequently, a gray scale voltage of (VL+3α) is written during the third sub-frame line period (3rd Tsfl) and gray scale display corresponding to the gray scale voltage of (VL+3α) is made during the third sub-frame period (3rd Tsf). Thereafter, a gray scale voltage of (VL+3α) is written during the fourth sub-frame line period (4th Tsfl) and gray scale display corresponding to the gray scale voltage of (VL+3α) is made during the fourth sub-frame period (4th Tsf). A gray scale voltage of (VL+3α) is written during the fifth sub-frame line period (5th Tsfl) and gray scale display corresponding to the gray scale voltage of (VL+3α) is made during the fifth sub-frame period (5th Tsf). A gray scale voltage of (VL+2α) is written during the sixth sub-frame line period (6th Tsfl) and gray scale display corresponding to the gray scale voltage of (VL+2α) is made during the sixth sub-frame period (6th Tsf). A gray scale voltage of (VL+3α) is written during the seventh sub-frame line period (7th Tsfl) and gray scale display corresponding to the gray scale voltage of (VL+3α) is made during the seventh sub-frame period (7th Tsf). A gray scale voltage of (VL+3α) is written during the eighth sub-frame line period (8th Tsfl) and gray scale display corresponding to the gray scale voltage of (VL+3α) is made during the eighth sub-frame period (8th Tsf). The gray scale display level in the second frame, therefore, corresponds to the gray scale voltage level of (VL+22α/8).

In this embodiment mode, in order to obtain the voltage level of four gray scales, the level between the voltage level VH and the voltage level VL is divided equally by designating each step α. However, the present invention is still effective if the level between the voltage level VH and the voltage level VL is not divided equally but set arbitrarily.

Further, although the gray scale voltage level is realized by, in this embodiment mode, inputting the voltage level VH and the voltage level VL into the D/A converter circuit of the display panel, gray scale voltage level may also be realized by inputting a voltage level of 3 or more.

Though the gray scale voltage level written during each sub-frame line period is set as shown in Tables 1 and 2 in this embodiment mode, as mentioned above, it is not limited to the values in Tables 1 and 2.

In this embodiment mode, 2 bit digital video data of the 5 bit digital video data inputted from the external, is converted into 2 bit digital video data for voltage gray scale and gray scale information of 3 bit digital video data of the 5 bit digital video data is expressed in time ratio gray scale. Now, consider a general example where n bit digital video data of m bit digital video data from the external is converted into digital video data for voltage gray scale by a time ratio gray scale processing circuit while gray scale information of (m−n) bit data thereof is expressed in time ratio gray scale. The symbol m and n are both integer equal to or larger than 2 and satisfy m>n.

In this case, the relationship between frame period (Tf) and sub-frame period (Tsf) is expressed as follows:

$$Tf=2^{m-n}\cdot Tsf$$

Therefore, $(2^m-(2^{m-n}-1))$ patterns of gray scale display is obtained.

This embodiment mode takes as an example the case where m=5 and n=2. Needless to say, the present invention is not limited to that example. The symbols m and n may take 12 and 4, respectively, or 8 and 2 respectively. It is also possible to set m to 8 and n to 6, or to 10 and to 2. Values other than those may be used as well.

The voltage gray scale method and the time ratio gray scale may be conducted in the order stated, or continuously.

Embodiment Mode 2

Figure 9:
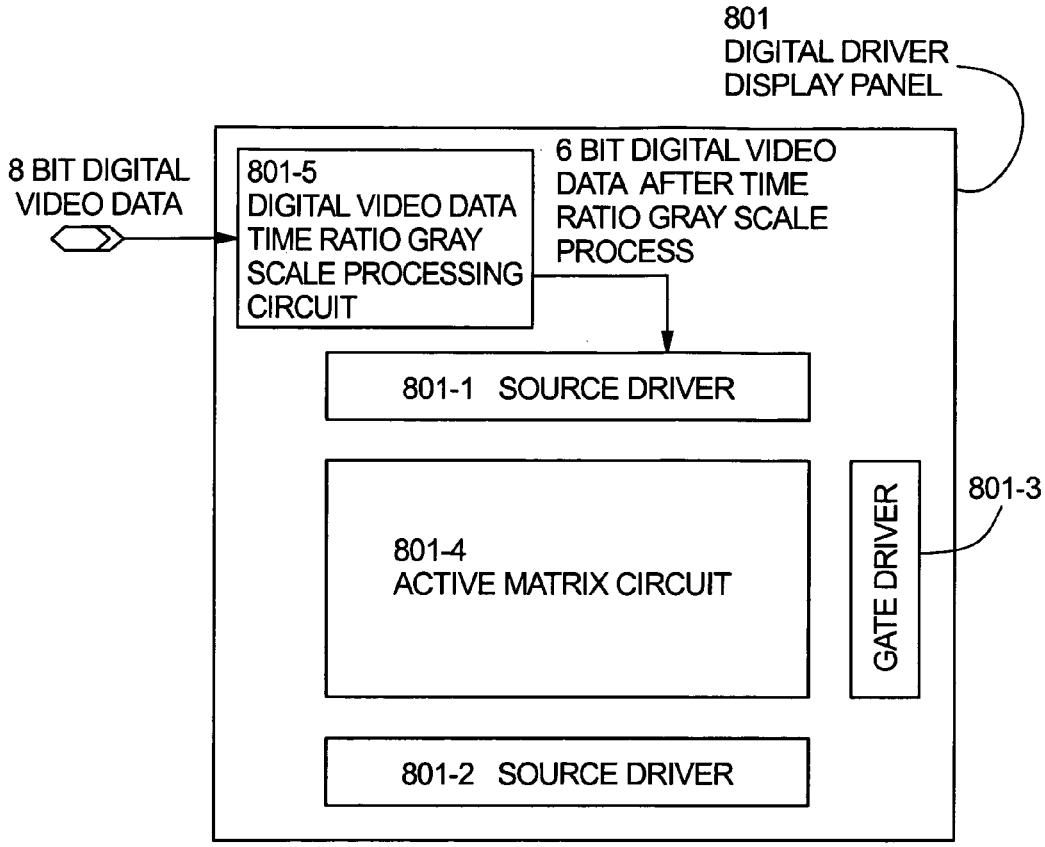
FIG. 9 is a structural diagram schematically showing a display device according to an embodiment mode of the present invention.

A description given in this embodiment mode is about a display device to which 8 bit digital video data is inputted. Reference is made to FIG. 9 that schematically shows the structure of the display device of this embodiment mode. Reference numeral 801 denotes a display device having digital drivers. Denoted by 801-1 and 801-2 are source drivers; 801-3, a gate driver; 801-4, an active matrix circuit with a plurality of pixel TFTs arranged in matrix; and 801-5, a digital video data time ratio gray scale processing circuit. The digital video data time ratio gray scale processing circuit is, as shown in the drawing, integrally formed in a display panel in this embodiment mode.

The digital video data time ratio gray scale processing circuit 801-5 converts, 6 bit digital video data of 8 bit digital video data inputted from the external, into 6 bit digital video data for voltage gray scale method. Gray scale information of 2 bit digital video data of the 8 bit digital video data is expressed in time ratio gray scale.

The 6 bit digital video data converted by the digital video data time ratio gray scale processing circuit 801-5 is inputted to the source drivers 801-1 and 801-2, converted into analogue gray scale voltage by D/A converter circuits (not shown) within the source drivers, and sent to each source signal line. The D/A converter circuits incorporated in the display device of this embodiment mode converts 6 bit digital video data into analogue gray scale voltage.

In the display device of this embodiment mode, the source drivers 801-1 and 801-2, the gate driver 801-3, the active matrix circuit 801-4 and the digital video data time ratio gray scale processing circuit 801-5 are formed and integrated on the same substrate.

Figure 10:
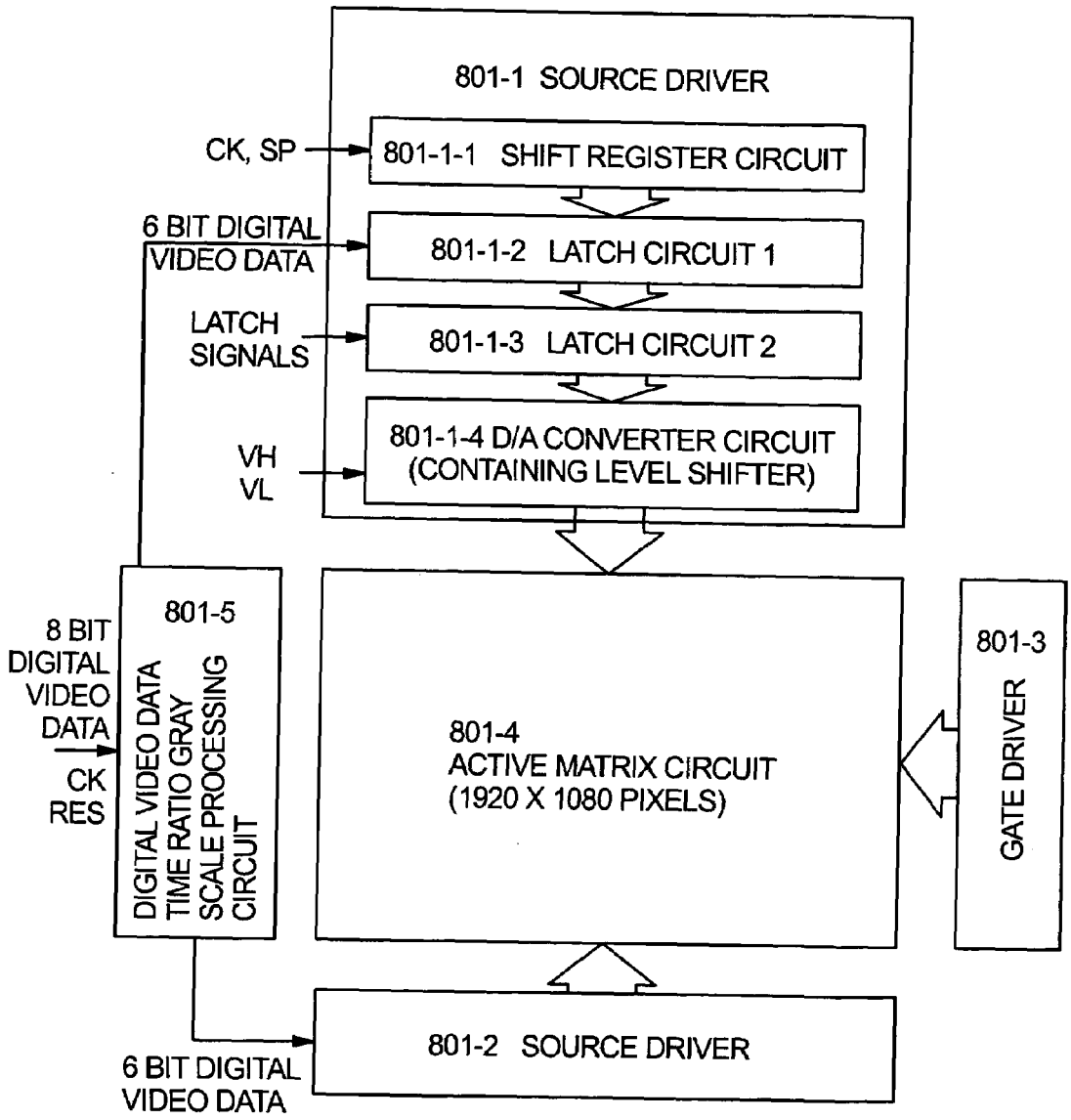
FIG. 10 is a structural diagram schematically showing a display device according to an embodiment mode of the present invention.

Now take a look at FIG. 10. FIG. 10 shows more detailed circuit structure of the display device of this embodiment mode. The source driver 801-1 includes a shift register circuit 801-1-1, a latch circuit 1 (801-1-2), a latch circuit 2 (801-1-3), and a D/A converter circuit (801-1-4). Other than those, the source driver includes a buffer circuit and a level shifter circuit (neither is shown). For the convenience in explanation, the D/A converter circuit 801-1-4 assumedly includes a level shifter circuit.

The source driver 801-2 has the same structure as that of the source driver 801-1. The source driver 801-1 sends an image signal (gray scale voltage) to odd-numbered source signal lines and the source driver 801-2 sends an image signal to even-numbered source signal lines.

In the active matrix display device of this embodiment mode, to suit the convenience of the circuit layout, two source drivers 801-1 and 801-2 are arranged sandwiching vertically the active matrix circuit. However, only one source driver may be used if that is possible in view of the circuit layout.

The gate driver 801-3 includes a shift register circuit, a buffer circuit, a level shifter circuit, etc., (neither of them is shown).

The active matrix circuit 801-4 comprises 1920 (in width)×1080 (in length) pixels. Each pixel has the structure similar to the one described in the above Embodiment mode 1.

The display device of this embodiment mode has the D/A converter circuit 801-1-4 that processes 6 bit digital video data. Information contained in 2 bit data of 8 bit digital video data inputted from the external is used for time ratio gray scale. The time ratio gray scale here is the same as in the above Embodiment mode 1.

Therefore, the display device of this embodiment mode can obtain $2^8-3=253$ patterns of gray scale display.

Embodiment Mode 3

Figure 11:
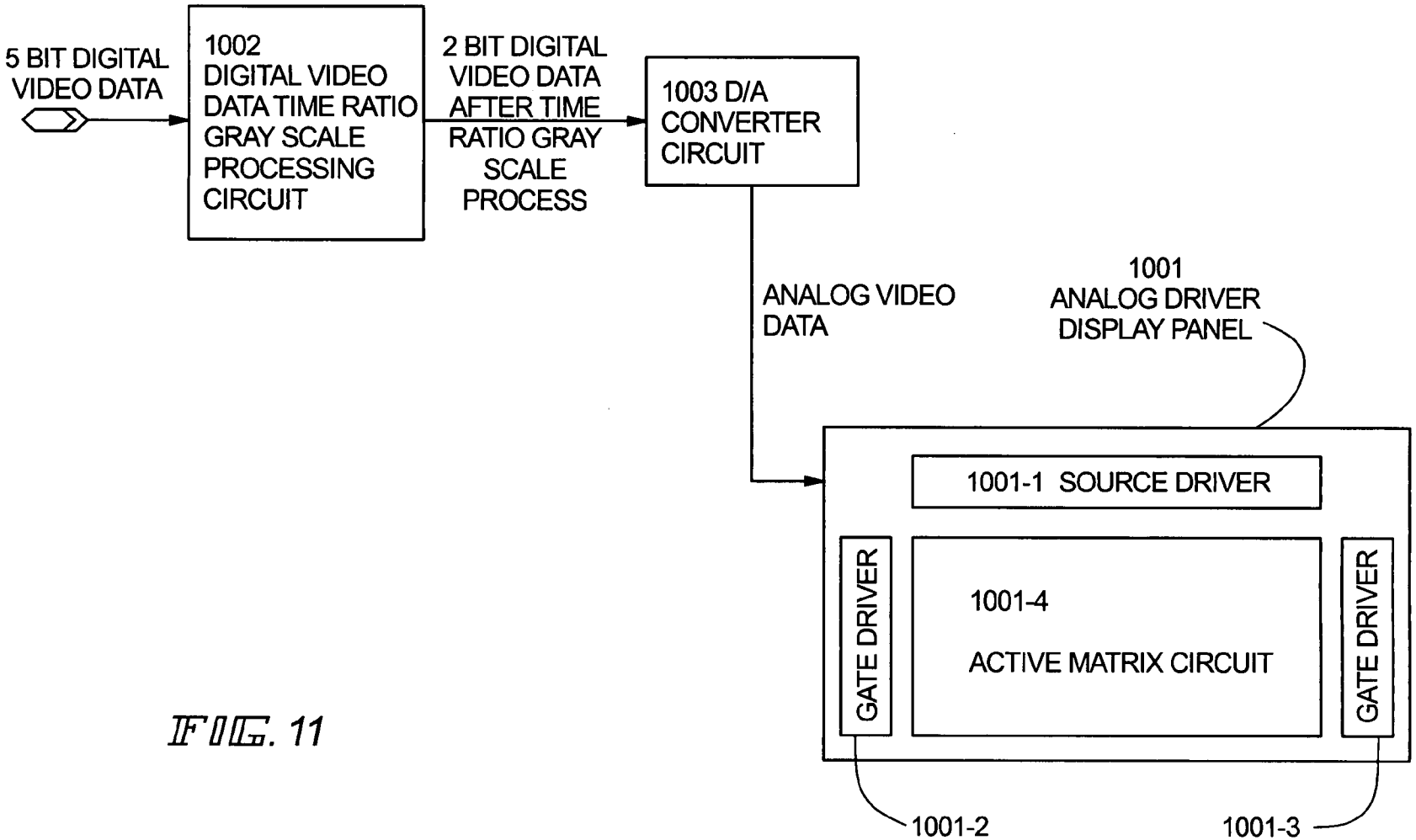
FIG. 11 is a structural diagram schematically showing a display device according to an embodiment mode of the present invention.

See FIG. 11. Reference numeral 1001 denotes a display panel having analogue drivers. Denoted by 1001-1 is a source driver; 1001-2 and 1001-3, gate drivers; 1001-4, an active matrix circuit with a plurality of pixel TFTs arranged in matrix.

A digital video data time ratio gray scale processing circuit 1002 converts, 2 bit digital video data of 5 bit digital video data inputted from the external, into 2 bit digital video data for voltage gray scale method. The gray scale information of 3 bit data of the 5 bit digital video data is expressed in time ratio gray scale.

The 2 bit digital video data converted by the digital video data time ratio gray scale processing circuit 1002 is inputted to a D/A converter circuit 1003 and converted into analogue video data. Then the analogue video data is inputted to the display panel 1001.

Figure 12:
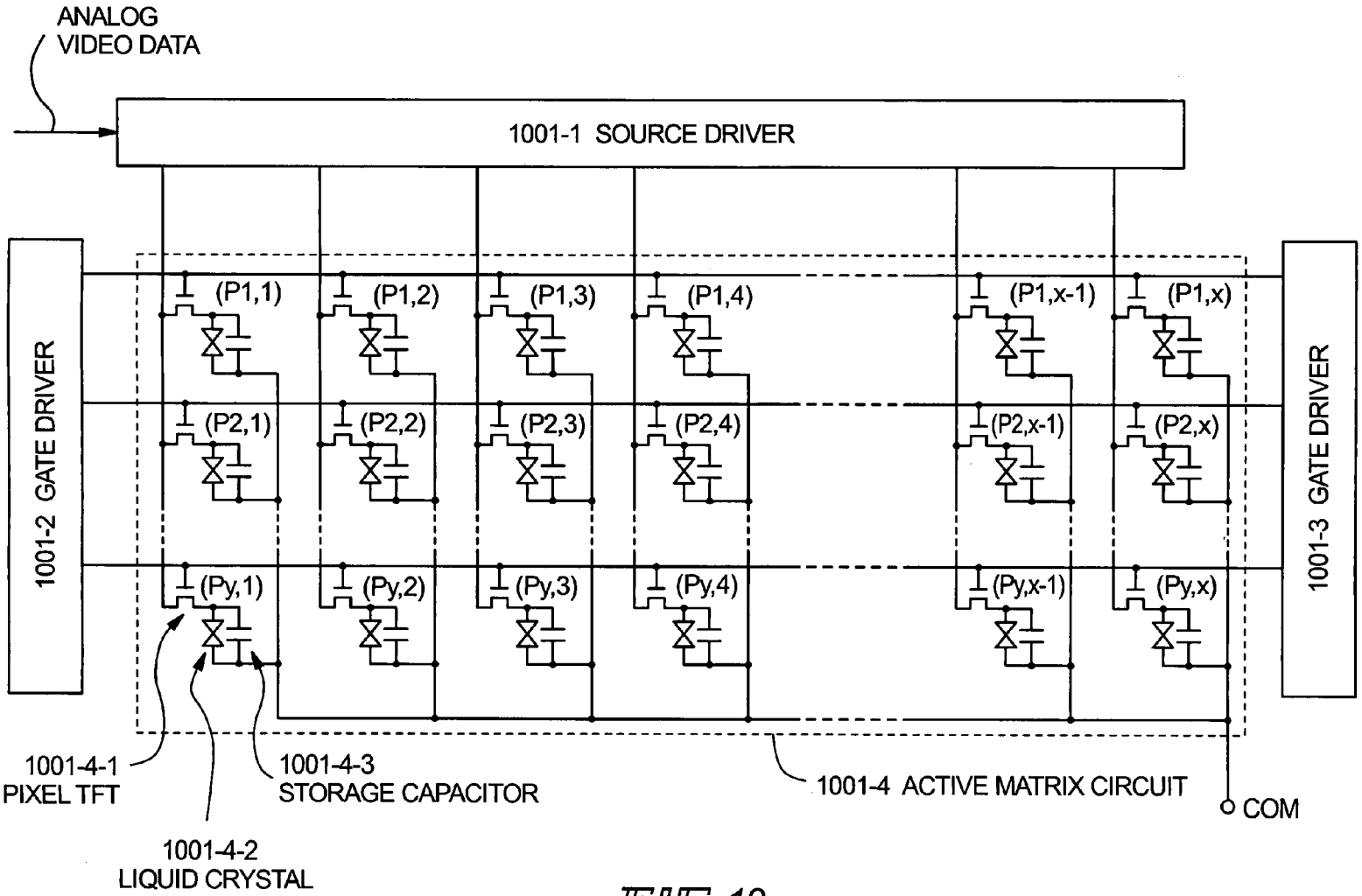
FIG. 12 is a diagram showing the circuit structure of an active matrix circuit, a source driver and gate drivers in a liquid crystal display device according to an embodiment mode of the present invention.

Here, a case when liquid crystal is applied as the display medium in the display device of the embodiment mode 2 is explained. Circuit structure of the display panel 1001, specifically active matrix circuit 1001-4 is explained by referring to FIG. 12.

The active matrix circuit 1001-4 has pixels of (x×y). For convenience of explanation, each pixel is designated by a symbol such as P1,1, P2,1, . . . and Py,x. Also, each pixel has a pixel TFT 1001-4-1 and a storage capacitance 1001-4-3. Liquid crystal is held between an active matrix substrate, on which the source driver 1001-1, the gate drivers 1001-2, 1001-3 and the active matrix circuit 1001-4 are formed, and an opposite substrate. Liquid crystal 1001-4-2 schematically shows the liquid crystal for each of the pixel.

The analogue driver panel according to this embodiment mode drives one pixel after another, namely, performs dot sequential driving. A time required to write analogue voltage gray scale in all pixels (P1,1 to Py,x) is named here one frame period (Tf). One frame period (Tf) is divided into eight periods, which are referred to as sub-frame periods (Tsf). Further, a time required to write analogue voltage gray scale in one pixel (e.g., P1,1, P1,2, . . . , P1,x) is called one sub-frame dot periods (Tsfd).

Gray scale display in the display device of this embodiment mode will be described. The digital video data sent from the external to the display device of this embodiment mode is 5 bit and contains information of 32 gray scales. The gray scale display level for the display device of this embodiment mode is similar to the one shown in FIG. 5, so FIG. 5 is referred.

Figure 13:
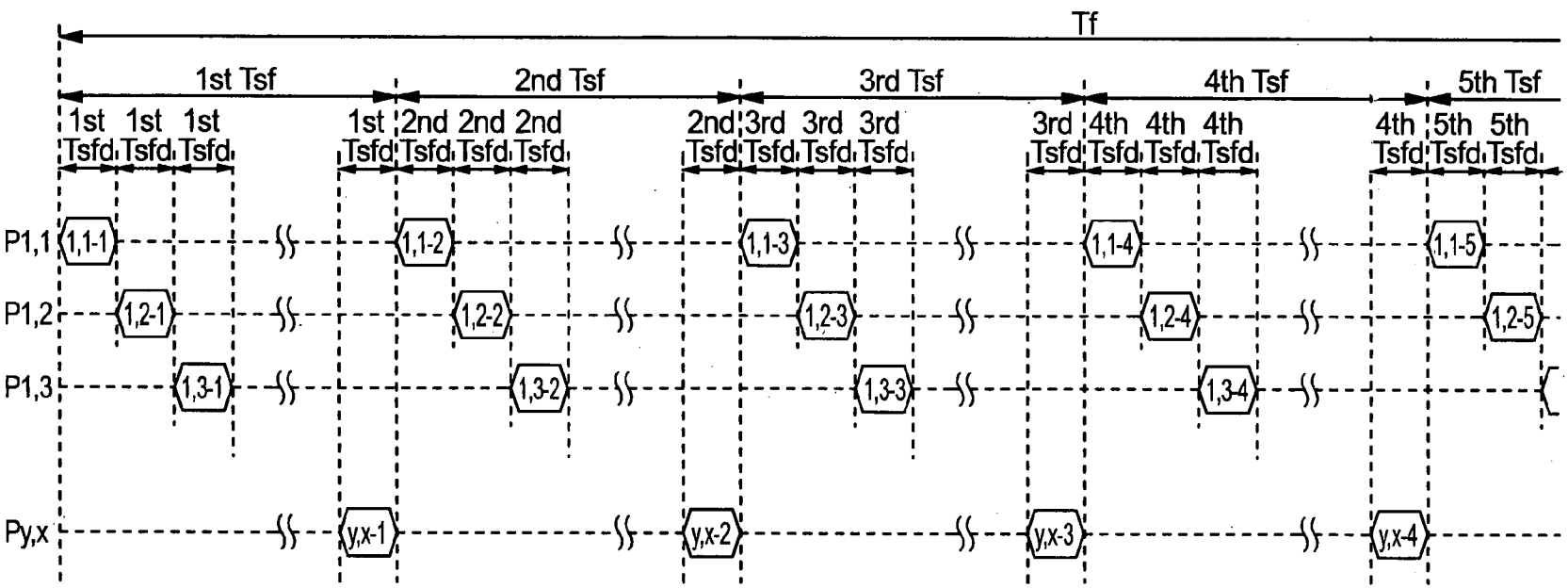
FIG. 13 is a diagram showing a drive timing chart of a display device according to an embodiment mode of the present invention.
Figure 14:
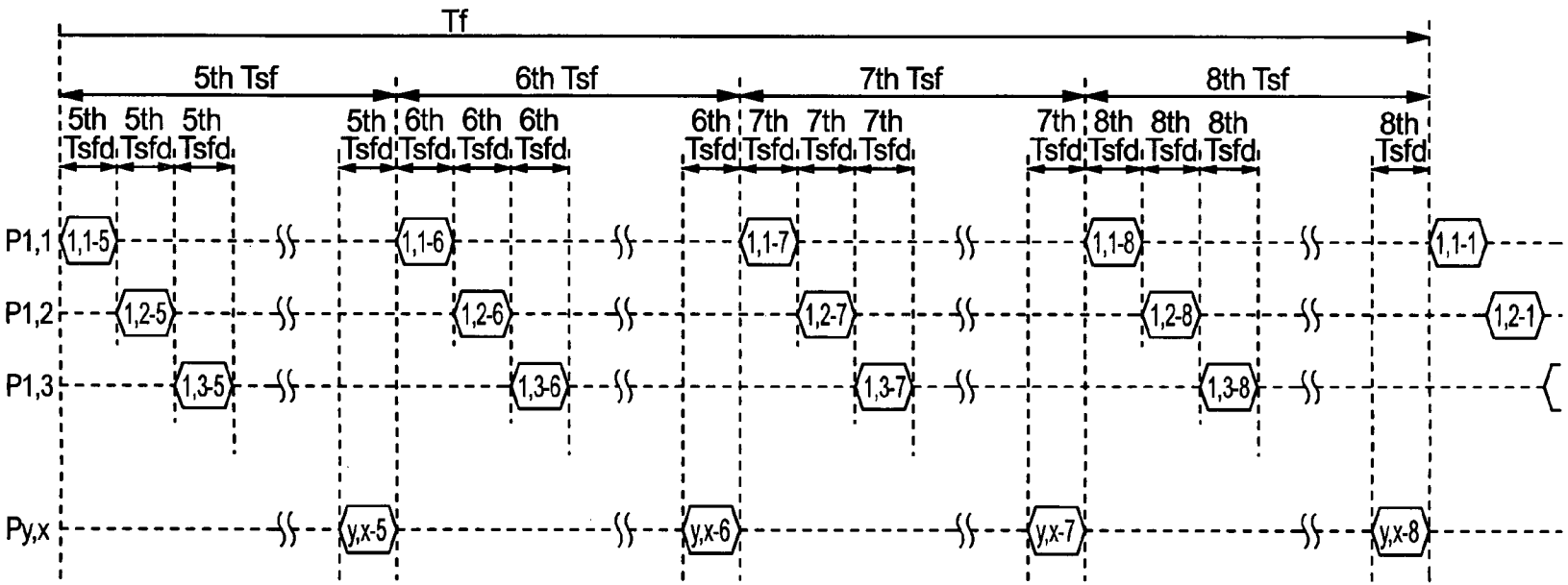
FIG. 14 is a diagram showing the drive timing chart of the display device according to an embodiment mode of the present invention.

FIGS. 13 and 14 together show a drive timing chart for the display device of this embodiment mode. The pixels P1,1, P1,2, P1,3, Py,x are taken as an example in FIGS. 13 and 14 for convenience's sake in explanation. The drive timing chart is divided and shown in two diagrams, i.e., FIGS. 13 and 14, because of limited spaces.

Look at the pixel P1,1. During each sub-frame dot period (1st Tsfd, 2nd Tsfd, 3rd Tsfd, 4th Tsfd, 5th Tsfd, 6th Tsfd, 7th Tsfd, and 8th Tsfd), digital video data 1,1-1, 1,1-2, 1,1-3, 1,1-4, 1,1-5, 1,1-6, 1,1-7, and 1,1-8 are written in the pixel P1,1 after converted into analogue video data by the D/A converter circuit.

Similarly, analogue video data corresponding to the sub-frame dot periods are written in all the other pixels.

Therefore, the display device of this embodiment mode also is capable of twenty-five patterns of gray scale display as in the above Embodiment mode 1.

When analogue video data is inputted from the external to the display device of this embodiment mode, analogue data to be inputted may be converted into digital video data and the converted data is inputted to the digital video data time ratio gray scale processing circuit 1002.

Again here in this embodiment mode a general example is considered in which, of m bit digital video data sent from the external, n bit digital video data is converted by a time ratio gray scale processing circuit into digital video data for voltage gray scale method, and gray scale information of (m−n) bit data is expressed in time ratio gray scale. The symbols m and n are both integer equal to or larger than 2 and satisfy m>n.

In this case, the relationship between frame period (Tf) and sub-frame period (Tsf) is expressed as follows:

$$Tf=2^{m-n}\cdot Tsf$$

Therefore, $(2^m-(2^{m-n}-1))$ patterns of gray scale display is obtained.

Incidentally, when dot sequential scanning as in this embodiment mode is conducted, image signals may be written in pixels from right to left, as well as left to right. Instead, video signals may be written in pixels at random, or written in every other pixel, every third pixel or every fourth pixel.

Embodiment Mode 4

This embodiment mode describes a manufacturing method of a display device of the present invention. Explained here is a method in which TFTs for an active matrix circuit and TFTs for a driver circuit arranged in the periphery of the active matrix circuit are formed at the same time.

Figure 15A:
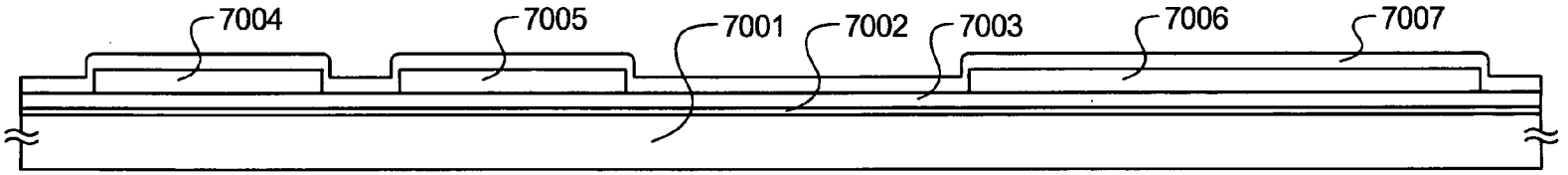
FIGS. 15A to 15C are diagrams showing an example of the manufacturing process of a display device according to the present invention.

[Step of Forming Island Semiconductor Layer and Gate Insulating Film: FIG. 15A]

In FIG. 15A, non-alkaline glass substrate or a quartz substrate is preferably used for a substrate 7001. A silicon substrate or a metal substrate that have an insulating film formed on the surface, may also be used.

On one surface of the substrate 7001 on which the TFT is to be formed, a base film 7002 made of a silicon oxide film, a silicon nitride film, or a silicon oxynitride film is formed by plasma CVD or sputtering to have a thickness of 100 to 400 nm. For instance, a preferable film for the base film 7002 is one with a two-layer structure in which a silicon nitride film 7002 having a thickness of 25 to 100 nm, here in 50 nm, and a silicon oxide film 7003 having a thickness of 50 to 300 nm, here in 150 nm, are formed. The base film 7002 is provided for preventing impurity contamination from the substrate, and is not always necessary if a quartz substrate is employed.

Next, an amorphous silicon film with a thickness of 20 to 100 nm is formed on the base film 7002 by a known film formation method. Though depending on its hydrogen content, the amorphous silicon film is preferably heated at 400 to 550° C. for several hours for dehydrogenation, reducing the hydrogen content to 5 atom % or less to prepare for the crystallization step. The amorphous silicon film may be formed by other formation methods such as sputtering or evaporation. In this case, it is desirable that impurity elements such as oxygen and nitrogen etc. contained in the film be sufficiently reduced. The base film and the amorphous silicon film can be formed by the same film formation method here, so that the films may be formed continuously. In that case, it is possible to prevent contamination on the surface since it is not exposed to the air, and that reduces fluctuation in characteristics of the TFTs to be manufactured.

A known laser crystallization technique or thermal crystallization technique may be used for a step of forming a crystalline silicon film from the amorphous silicon film. The crystalline silicon film may be formed by thermal oxidation using a catalytic element for promoting the crystallization of silicon. Other options include the use of a microcrystal silicon film and direct deposition of a crystalline silicon film. Further, the crystalline silicon film may be formed by employing a known technique of SOI (Silicon On Insulators) with which a monocrystal silicon is adhered to a substrate.

An unnecessary portion of the thus formed crystalline silicon film is etched and removed to form island semiconductor layers 7004 to 7006. A region in the crystalline silicon film where an n-channel TFT is to be formed may be doped in advance with boron (B) in a concentration of about $1\times10^{15}$ to $5\times10^{17}$ $cm^{-3}$ in order to control the threshold voltage.

Then a gate insulating film 7007 comprising mainly silicon oxide or silicon nitride is formed to cover the island semiconductor layers 7004 to 7006. The thickness of the gate insulating film 7007 may be 10 to 200 nm, preferably 50 to 150 nm. For example, the gate insulating film may be fabricated by forming a silicon oxynitride film by plasma CVD with raw materials of $N_2O$ and $SiH_4$ in a thickness of 75 nm, and then thermally oxidizing the film in an oxygen atmosphere or a mixed atmosphere of oxygen and chlorine at 800 to 1000° C. into a thickness of 115 nm (FIG. 15A).

Figure 15B:
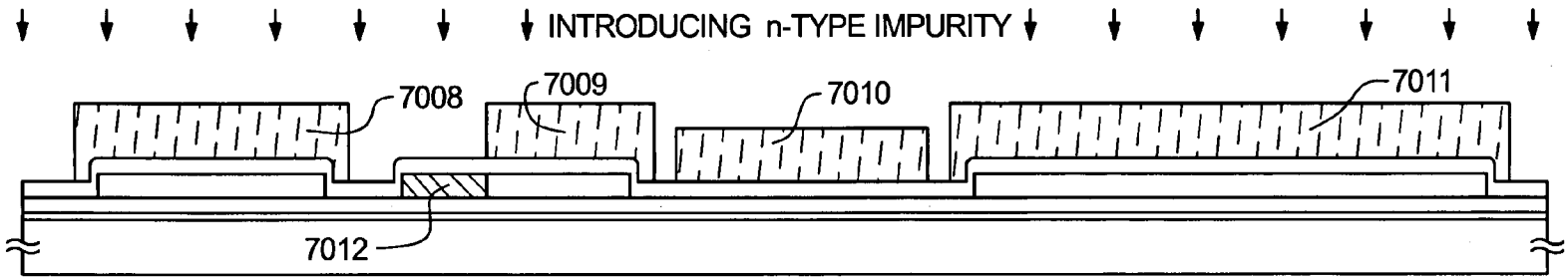

[Formation of $n^-$ Region: FIG. 15B]

Resist masks 7008 to 7011 are formed over the entire surfaces of the island semiconductor layers 7004 and 7006 and region where wiring is to be formed, and over a portion of the island semiconductor layer 7005 (including a region to be a channel formation region) and a lightly doped region 7012 is formed by doping impurity element imparting n-type. This lightly doped region 7012 is an impurity region for forming later an LDD region (called an Lov region in this specification, where 'ov' stands for 'overlap') that overlaps with a gate electrode through the gate insulating film in the n-channel TFT of a CMOS circuit. The concentration of the impurity element for imparting n type in the lightly doped region formed here is referred to as ($n^-$). Accordingly, the lightly doped region 7012 may be called $n^-$ region in this specification.

Phosphorus is doped by ion doping with the use of plasma-excited phosphine ($PH_3$) without performing mass-separation on it. Of course, the ion implantation involving mass-separation may be employed instead. In this step, a semiconductor layer beneath the gate insulating film 7007 is doped with phosphorus through the film 7007. The concentration of phosphorus to be used in the doping preferably ranges from $5\times10^{17}$ atoms/cm$^3$ to $5\times10^{18}$ atoms/cm$^3$, and the concentration here in this embodiment mode is set to $1\times10^{18}$ atoms/cm$^3$.

Thereafter, the resist masks 7008 to 7011 are removed and heat treatment is conducted in a nitrogen atmosphere at 400 to 900° C., preferably, 550 to 800° C. for 1 to 12 hours, activating phosphorus added in this step.

Figure 15C:
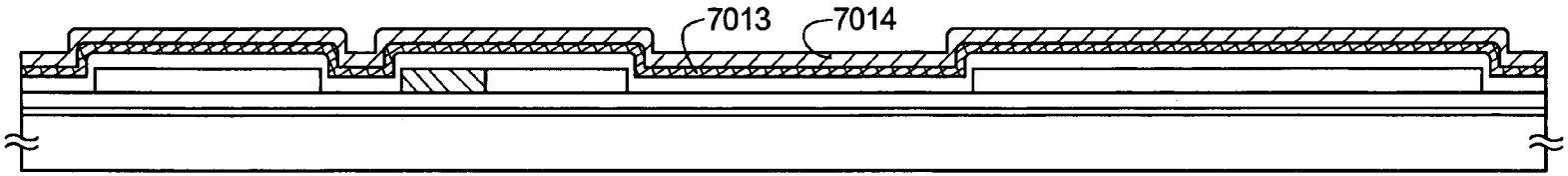

[Formation of Conductive Films for Gate Electrode and for Wiring: FIG. 15C]

A first conductive film 7013 with a thickness of 10 to 100 nm is formed from an element selected from tantalum (Ta), titanium (Ti), molybdenum (Mo) and tungsten (W) or from a conductive material comprising one of those elements as its main ingredient. Tantalum nitride (TaN) or tungsten nitride (WN), for example, is desirably used for the first conductive film 7013. A second conductive film 7014 with a thickness of 100 to 400 nm is further formed on the first conductive film 7013 from an element selected from Ta, Ti, Mo and W or from a conductive material comprising one of those elements as its main ingredient. For instance, a Ta film may be formed in a thickness of 200 nm. Though not shown, it is effective to form a silicon film with a thickness of about 2 to 20 nm under the first conductive film 7013 for the purpose of preventing oxidation of the conductive films 7013 or 7014 (especially the conductive film 7014).

Figure 16A:
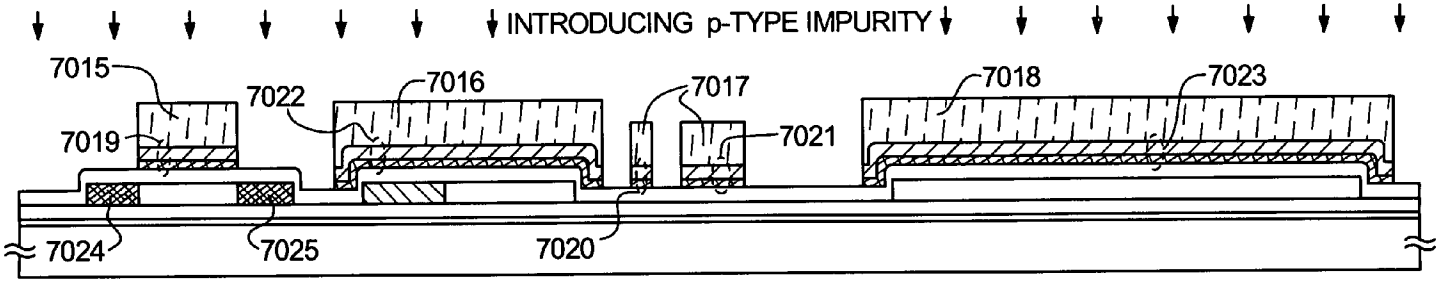
FIGS. 16A to 16C are diagrams showing an example of the manufacturing process of the display device according to the present invention.

[Formation of p-Channel Gate Electrode and Wiring Electrode, and Formation of $p^+$ Region: FIG. 16A]

Resist masks 7015 to 7018 are formed and the first conductive film and the second conductive film (which are hereinafter treated as a laminated film) are etched to form a gate electrode 7019 and gate wirings 7020 and 7021 of a p-channel TFT. Here, conductive films 7022 and 7023 are left to cover the entire surface of the regions to be n-channel TFTs.

Proceeding to the next step, the resist masks 7015 to 7018 are remained as they are to serve as masks, and a part of the semiconductor layer 7004 where the p-channel TFT is to be formed is doped with an impurity element for imparting p type. Boron may be used here as the impurity element and is doped by ion doping (of course ion implantation may also be employed) using diborane ($B_2H_6$). Boron is doped here to a concentration from $5\times10^{20}$ to $3\times10^{21}$ atoms/cm$^3$. The concentration of the impurity element for imparting p type contained in the impurity regions formed here is expressed as ($p^{++}$). Accordingly, impurity regions 7024 and 7025 may be referred to as $p^{++}$ regions in this specification.

Here, doping process of impurity element imparting p-type may be performed instead after exposing a portion of island semiconductor layer 7004 by removing gate insulating film 7007 by etching using resist masks 7015–7018. In this case, a low acceleration voltage is sufficient for the doping, causing less damage on the island semiconductor film and improving the throughput.

Figure 16B:
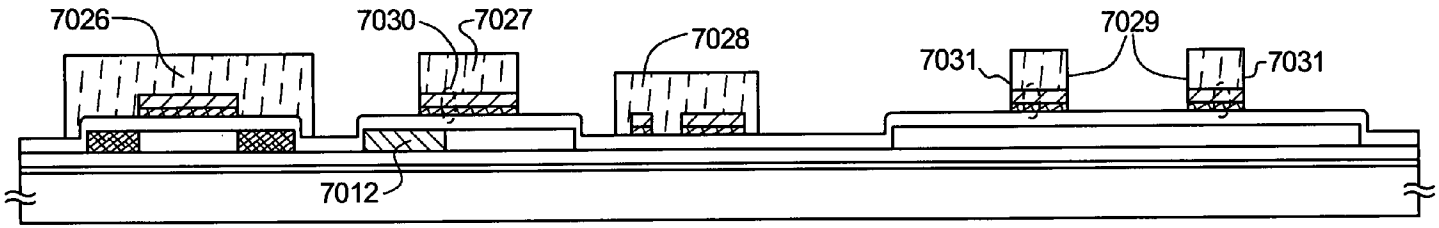

[Formation of n-Channel Gate Electrode: FIG. 16B]

Then the resist masks 7015 to 7018 are removed and new resist masks 7026 to 7029 are formed to form gate electrodes 7030 and 7031 of the n-channel TFTs. At this point, the gate electrode 7030 is formed so as to overlap with the $n^-$ region 7012 through the gate insulating film.

Figure 16C:
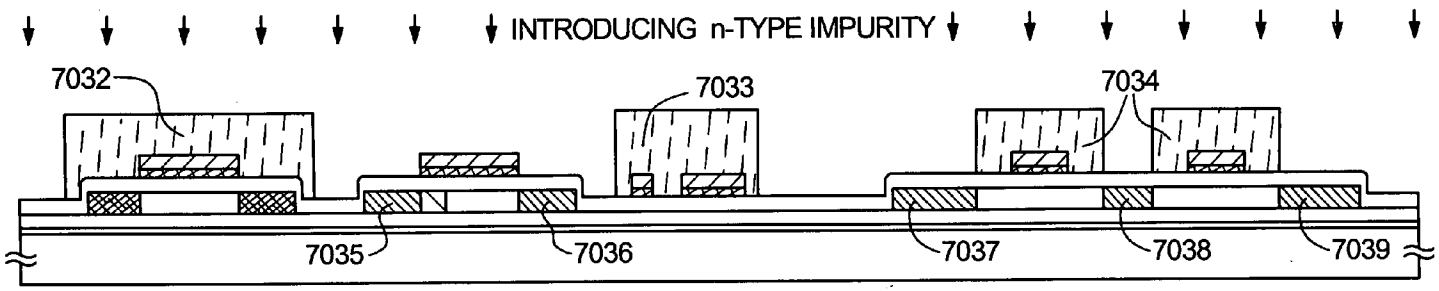

[Formation of $n^+$ Region: FIG. 16C]

The resist masks 7026 to 7029 are then removed and new resist masks 7032 to 7034 are formed. Subsequently, a step of forming an impurity region functioning as a source region or a drain region in the n-channel TFT is carried out. The resist mask 7034 is formed so as to cover the gate electrode 7031 of the n-channel TFT. This is for forming in later step an LDD region that do not overlap with the gate electrode in the n-channel TFT of the active matrix circuit.

An impurity element imparting n type is added thereto to form impurity regions 7035 to 7039. Here, ion doping (of course ion implantation also will do) using phosphine ($PH_3$) is again employed, and the phosphorus concentration in these regions are set to $1\times10^{20}$ to $1\times10^{21}$ atoms/cm$^3$. The concentration of the impurity element for imparting n type contained in the impurity regions 7037 to 7039 formed here is designated as ($n^+$). Accordingly, the impurity regions 7037 to 7039 may be referred to as $n^+$ regions in this specification. The impurity regions 7035 and 7036 have $n^-$ regions which have already been formed, so that, strictly speaking, they contain a slightly higher concentration of phosphorus than the impurity regions 7037 to 7039 do.

Here, doping process of impurity element imparting n-type may be performed instead after exposing a portion of island semiconductor layer 7005 and 7006 by removing gate insulating film 7007 by etching using resist masks 7032–7034 and gate electrode 7030 as masks. In this case, a low acceleration voltage is sufficient for the doping, causing less damage on the island-like semiconductor films and improving the throughput.

Figure 17A:
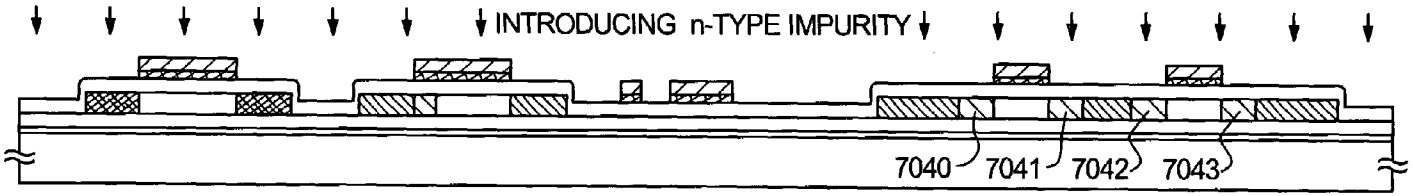
FIGS. 17A to 17C are diagrams showing an example of the manufacturing process of the display device according to the present invention.

[Formation of $n^{--}$ Region: FIG. 17A]

Next, the resist masks 7032 to 7034 are removed and an impurity element imparting n type is doped in the island semiconductor layer 7006 where the n-channel TFT of the active matrix circuit is to be formed. Thus formed impurity regions 7040 to 7043 are doped with phosphorus in the same concentration as in the above $n^-$ regions or a less concentration (specifically, $5\times10^{16}$ to $1\times10^{18}$ atoms/cm$^3$). The concentration of the impurity element imparting n type contained in the impurity regions 7040 to 7043 formed here is expressed as ($n^{--}$). Accordingly, the impurity regions 7040 to 7043 may be referred to as $n^{--}$ regions in this specification. Incidentally, every impurity region except for an impurity region 7067 that is hidden under the gate electrode is doped with phosphorus in a concentration of $n^{--}$ in this step. However, the phosphorus concentration is so low that the influence thereof may be ignored.

Figure 17B:
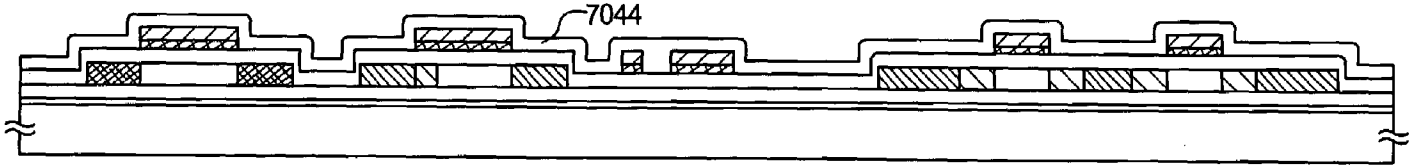

[Step of Thermal Activation: FIG. 17B]

Formed next is a protective insulating film 7044, which will later become a part of a first interlayer insulating film. The protective insulating film 7044 may comprise a silicon nitride film, a silicon oxide film, a silicon oxynitride film or a laminated film combining those films. The film thickness thereof ranges from 100 to 400 nm.

Thereafter, a heat treatment step is carried out to activate the impurity element added in the respective concentration for imparting n type or p type. This step may employ the furnace annealing, the laser annealing or the rapid thermal annealing (RTA). Here in this embodiment mode, the activation step is carried out by the furnace annealing. The heat treatment is conducted in a nitrogen atmosphere at 300 to 650° C., preferably 400 to 550° C., in here 450° C., for 2 hours.

Further heat treatment is performed in an atmosphere containing 3 to 100% of hydrogen at 300 to 450° C. for 1 to 12 hours, hydrogenating the island semiconductor layer. This step is to terminate dangling bonds in the semiconductor layer with thermally excited hydrogen. Other hydrogenating means includes plasma hydrogenation (that uses hydrogen excited by plasma).

Figure 17C:
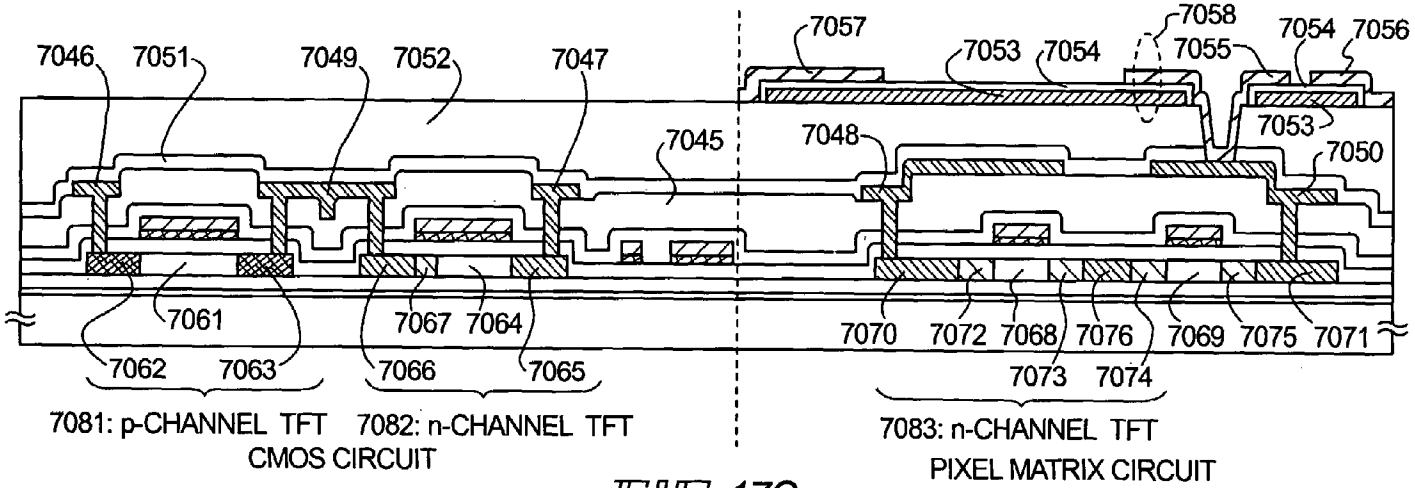

[Formation of Interlayer Insulating Film, Source/Drain Electrode, Light-Shielding Film, Pixel Electrode and Storage Capacitance: FIG. 17C]

Upon completion of the activation step, an interlayer insulating film 7045 with a thickness of 0.5 to 1.5 μm is formed on the protective insulating film 7044. A laminated film consisting of the protective insulating film 7044 and the interlayer insulating film 7045 serves as a first interlayer insulating film.

After that, contact holes reaching to the source regions or the drain regions of the respective TFTs are formed to form source electrodes 7046 to 7048 and drain electrodes 7049 and 7050. Though not shown, these electrodes in this embodiment mode comprise a laminated film having a three-layer structure in which a Ti film with a thickness of 100 nm, a Ti-containing aluminum film with a thickness of 300 nm and another Ti film with a thickness of 150 nm are sequentially formed by sputtering.

Then a passivation film 7051 is formed using a silicon nitride film, a silicon oxide film or a silicon oxynitride film in a thickness of 50 to 500 nm (typically, 200 to 300 nm). Subsequent hydrogenation treatment performed in this state brings a favorable result in regard to the improvement of the TFT characteristics. For instance, it is sufficient if heat treatment is conducted in an atmosphere containing 3 to 100% hydrogen at 300 to 450° C. for 1 to 12 hours. The same result can be obtained when the plasma hydrogenation method is used. An opening may be formed here in the passivation film 7051 at a position where a contact hole is later formed for connecting pixel electrode and the drain electrode.

Thereafter, a second interlayer insulating film 7052 made from an organic resin is formed to have a thickness of about 1 μm. As the organic resin, polyimide, acrylic, polyamide, polyimideamide, BCB (benzocyclobutene), etc. may be used. The advantages in the use of the organic resin film include simple film formation, reduced parasitic capacitance owing to low relative permittivity, excellent flatness, etc. Other organic resin films than the ones listed above or an organic-based SiO compound may also be used. Here, polyimide of the type being thermally polymerized after applied to the substrate is used and fired at 300° C. to form the film 7052.

Subsequently, a light-shielding film 7053 is formed on the second interlayer insulating film 7052 in area where active matrix circuit is formed. The light-shielding film 7053 comprises an element selected from aluminum (Al), titanium (Ti) and tantalum (Ta) or of a film containing one of those elements as its main ingredient into a thickness of 100 to 300 nm. On the surface of the light-shielding film 7053, an oxide film 7054 with a thickness of 30 to 150 nm (preferably 50 to 75 nm) is formed by anodic oxidation or plasma oxidation. Here, an aluminum film or a film mainly containing aluminum is used as the light-shielding film 7053, and an aluminum oxide film (alumina film) is used as the oxide film 7054.

The insulating film is provided only on the surface of the light-shielding film here in this embodiment mode. The insulating film may be formed by a vapor deposition method such as plasma CVD, thermal CVD, or by sputtering. In that case also, the film thickness thereof is appropriately 30 to 150 nm (preferably 50 to 75 nm). A silicon oxide film, a silicon nitride film, a silicon oxynitride film, a DLC (Diamond like carbon) film or an organic resin film may be used for the insulating film. A lamination film with those films layered in combination may also be used.

Then a contact hole reaching the drain electrode 7050 is formed in the second interlayer insulating film 7052 to form a pixel electrode 7055. Note that pixel electrodes 7056 and 7057 are adjacent but individual pixels, respectively. For the pixel electrodes 7055 to 7057, a transparent conductive film may be used in the case of fabricating a transmission type display device and a metal film may be used in the case of a reflection type display device. Here, in order to manufacture a transmission type display device, an indium tin oxide film ) with a thickness of 100 nm is formed by sputtering.

At this point, a storage capacitor is formed in a region 7058 where the pixel electrode 7055 overlaps with the light-shielding film 7053 through the oxide film 7054.

In this way, an active matrix substrate having the CMOS circuit serving as a driver circuit and the active matrix circuit formed on the same substrate is completed. A p-channel TFT 7081 and an n-channel TFT 7082 are formed in the CMOS circuit serving as a driver circuit, and a pixel TFT 7083 is formed from an n-channel TFT in the active matrix circuit.

The p-channel TFT 7081 of the CMOS circuit has a channel formation region 7061, and a source region 7062 and a drain region 7063 formed respectively in the $p^+$ regions. The n-channel TFT 7082 has a channel formation region 7064, a source region 7065, a drain region 7066 and an LDD region (hereinafter referred to as Lov region, where 'ov' stands for 'overlap') 7067 that overlaps with the gate electrode through the gate insulating film. The source region 7065 and the drain region 7066 are formed respectively in ($n^-$+$n^+$) regions and the Lov region 7067 is formed in the $n^-$ region.

The pixel TFT 7083 has channel formation regions 7068 and 7069, a source region 7070, a drain region 7071, LDD regions 7072 to 7075 which do not overlap with the gate electrode through the gate insulating film (hereinafter referred to as Loff regions, where 'off' stands for 'offset'), and an $n^+$ region 7076 in contact with the Loff regions 7073 and 7074. The source region 7070 and the drain region 7071 are formed respectively in the $n^+$ regions and the Loff regions 7072 to 7075 are formed in the $n^-$ regions.

In the present invention, the structure of the TFTs for forming the active matrix circuit and for forming the driver circuit can be optimized in accordance with the circuit specification each circuit requires, thereby improving operational performance and reliability of the semiconductor device. In concrete, by varying the arrangement of LDD regions of n-channel TFT by appropriately using Lov region or Loff region according to the circuit specification, a TFT structure in which high operation or countermeasure to hot carrier is sought and a TFT structure in which low OFF current operation is sought are realized on the same substrate.

For instance, the n-channel TFT 7082 is suitable for a logic circuit where importance is attached to the high speed operation, such as a shift register circuit, a frequency divider circuit, a signal dividing circuit, a level shifter circuit and a buffer circuit. On the other hand, the n-channel TFT 7083 is suitable for a circuit where importance is attached to the low OFF current operation, such as an active matrix circuit and a sampling circuit (sample hold circuit).

The length (width) of the Lov region is 0.5 to 3.0 μm, typically 1.0 to 1.5 μm, with respect to the channel length of 3 to 7 μm. The length (width) of the Loff regions 7072 to 7075 arranged in the pixel TFT 7083 is 0.5 to 3.5 μm, typically 2.0 to 2.5 μm.

Through the above steps, an active matrix substrate is completed.

Next, a description will be given on a process of manufacturing a liquid crystal display device using the active matrix substrate fabricated through the above steps.

An alignment film (not shown) is formed on the active matrix substrate in the state shown in FIG. 17C. In this embodiment mode, polyimide is used for the alignment film. An opposite substrate is then prepared. The opposite substrate comprises a glass substrate, an opposing electrode made of a transparent conductive film and an alignment film (neither of which is shown).

A polyimide film is again used for the alignment film of the opposite substrate in this embodiment mode. After forming the alignment film, rubbing treatment is performed. The polyimide used for the alignment film in this embodiment mode is one that has a relatively large pretilt angle.

The active matrix substrate and the opposite substrate which have undergone the above steps are then adhered to each other by a known cell assembly process through a sealing material or a spacer (neither is shown). After that, liquid crystal is injected between the substrates and an end-sealing material (not shown) is used to completely seal the substrates. In this embodiment mode, nematic liquid crystal is used for the injected liquid crystal.

A liquid crystal display device is thus completed.

Incidentally, the amorphous silicon film may be crystallized by laser light (typically excimer laser light) instead of the crystallization method for amorphous silicon film described in this embodiment mode.

Additionally, the polycrystalline silicon film may be replaced by an SOI structure (SOI substrate) such as Smart-Cut™, a SIMOX, and ELTRAN™ to perform other processes.

Embodiment Mode 5

The embodiment mode gives a description on another manufacturing method of a display device of the present invention. The description here in this embodiment mode deals with a method of simultaneously manufacturing TFTs forming an active matrix circuit and those forming a driver circuit arranged in the periphery of the active matrix circuit.

Figure 18A:
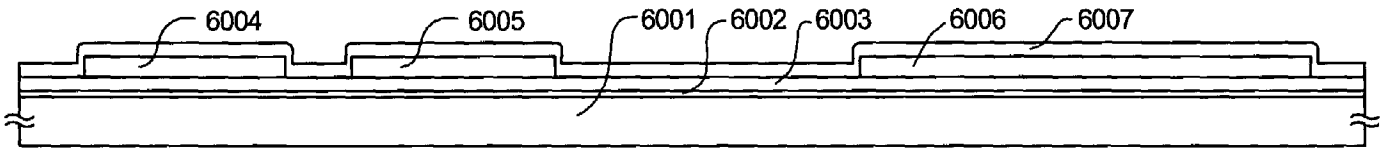
FIGS. 18A to 18C are diagrams showing an example of the manufacturing process of the display device according to the present invention.

[Steps of Formation of Island-Like Semiconductor Layer and Gate Insulating Film: FIG. 18A]

In FIG. 18A, a non-alkaline glass substrate or a quartz substrate is desirably used for a substrate 6001. A usable substrate other than those may be a silicon substrate or a metal substrate on the surface of which an insulating film is formed.

On the surface of the substrate 6001 on which the TFT is to be formed, a base film 6002 made of a silicon oxide film, a silicon nitride film, or a silicon oxynitride film is formed by plasma CVD or sputtering to have a thickness of 100 to 400 nm. For instance, a base film 6002 is preferably formed in a two-layer structure in which a silicon nitride film 6002 having a thickness of 25 to 100 nm, in here 50 nm, and a silicon oxide film 6003 having a thickness of 50 to 300 nm, in here 150 nm, are layered. The base film 6002 is provided for preventing impurity contamination from the substrate, and is not always necessary if a quartz substrate is employed.

Next, an amorphous silicon film with a thickness of 20 to 100 nm is formed on the base film 6002 by a known film formation method. Though depending on its hydrogen content, the amorphous silicon film is preferably heated at 400 to 550° C. for several hours for dehydrogenation, reducing the hydrogen content to 5 atom % or less to prepare for the crystallization step. The amorphous silicon film may be formed by other formation methods such as sputtering or evaporation if impurity elements such as oxygen and nitrogen etc. contained in the film are sufficiently reduced. The base film and the amorphous silicon film can be formed by the same film formation method here continuously. In that case, the device is not exposed to the air after forming the base film, which makes it possible to prevent contamination of the surface reducing fluctuation in characteristics of the TFTs to be manufactured.

A known laser crystallization technique or thermal crystallization technique may be used for a step of forming a crystalline silicon film from the amorphous silicon film. The crystalline silicon film may be formed by thermal oxidation using a catalytic element for promoting the crystallization of silicon. Other options include the use of a microcrystal silicon film and direct deposition of a crystalline silicon film. Further, the crystalline silicon film may be formed by employing a known technique of SOI (Silicon On Insulators) with which a monocrystal silicon is adhered to a substrate.

An unnecessary portion of thus formed crystalline silicon film is etched and removed to form island semiconductor layers 6004 to 6006. Boron may be doped in advance in a region in the crystalline silicon film where an n-channel TFT is to be formed in a concentration of about $1\times10^{15}$ to $5\times10^{17}$ $cm^{-3}$ in order to control the threshold voltage.

Then a gate insulating film 6007 containing mainly silicon oxide or silicon nitride is formed to cover the island semiconductor layers 6004 to 6006. The thickness of the gate insulating film 6007 is 10 to 200 nm, preferably 50 to 150 nm. For example, the gate insulating film may be fabricated by forming a silicon oxynitride film by plasma CVD with raw materials of $N_2O$ and $SiH_4$ in a thickness of 75 nm, and then thermally oxidizing the film in an oxygen atmosphere or a mixed atmosphere of oxygen and chlorine at 800 to 1000° C. into a thickness of 115 nm (FIG. 18A).

Figure 18B:
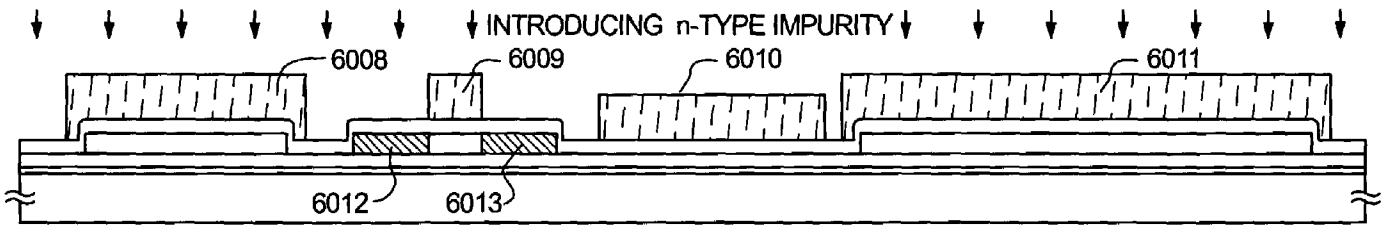

[Formation of $n^-$ Region: FIG. 18B]

Resist masks 6008 to 6011 are formed on the entire surfaces of the island-like semiconductor layers 6004 and 6006 and region where a wiring is to be formed, and on a portion of the island semiconductor layer 6005 (including a region to be a channel formation region) and lightly doped regions 6012 and 6013 were formed by doping impurity element imparting n-type. These lightly doped regions 6012 and 6013 are impurity regions for later forming LDD regions that overlap with a gate electrode through the gate insulating film (called Lov regions in this specification, where 'ov' stands for 'overlap') in the n-channel TFT of a CMOS circuit. The concentration of the impurity element for imparting n type contained in the lightly doped regions formed here is referred to as ($n^-$). Accordingly, the lightly doped regions 6012 and 6013 may be called $n^-$ regions.

Phosphorus is doped by ion doping with the use of plasma-excited phosphine ($PH_3$) without performing mass-separation on it. Of course, ion implantation involving mass-separation may be employed instead. In this step, a semiconductor layer beneath the gate insulating film 6007 is doped with phosphorus through the film 6007. The concentration of phosphorus may preferably be set in a range from $5\times10^{17}$ atoms/$cm^3$ to $5\times10^{18}$ atoms/$cm^3$, and the concentration here is set to $1\times10^{18}$ atoms/$cm^3$.

Thereafter, the resist masks 6008 to 6011 are removed and heat treatment is conducted in a nitrogen atmosphere at 400 to 900° C., preferably 550 to 800° C., for 1 to 12 hours, activating phosphorus added in this step.

Figure 18C:
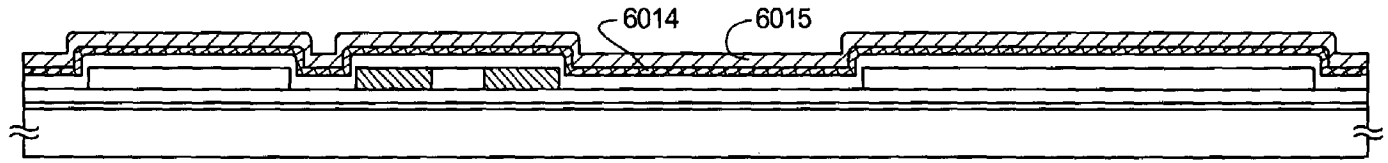

[Formation of Conductive Films for Gate Electrode and for Wiring: FIG. 18C]

A first conductive film 6014 with a thickness of 10 to 100 nm is formed from an element selected from tantalum (Ta), titanium (Ti), molybdenum (Mo) and tungsten (W) or from a conductive material containing one of those elements as its main ingredient. Tantalum nitride (TaN) or tungsten tungsten (WN), for example, is desirably used for the first conductive film 6014. A second conductive film 6015 with a thickness of 100 to 400 nm is further formed on the first conductive film 6014 from an element selected from Ta, Ti, Mo and W or from a conductive material containing one of those elements as its main ingredient. For instance, A Ta film is formed in a thickness of 200 nm. Though not shown, it is effective to form a silicon film with a thickness of about 2 to 20 nm under the first conductive film 6014 for the purpose of preventing oxidation of the conductive films 6014, 6015 (especially the conductive film 6015).

Figure 19A:
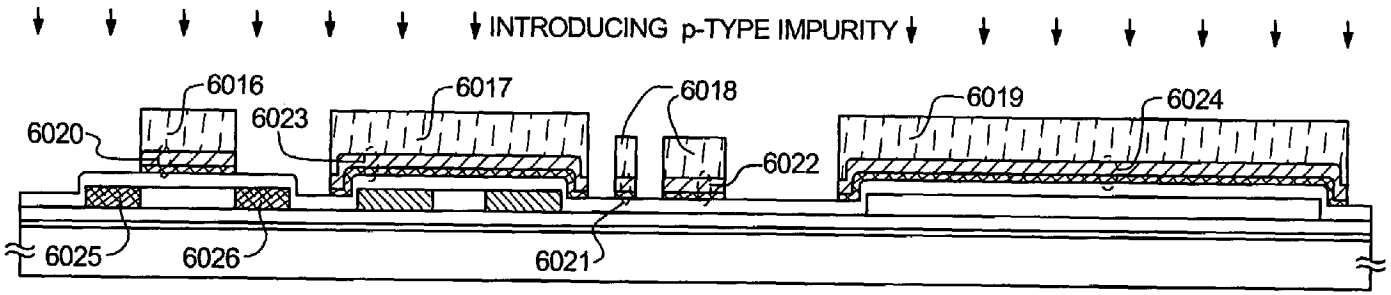
FIGS. 19A to 19C are diagrams showing an example of the manufacturing process of the display device according to the present invention.

[Formation of p-Channel Gate Electrode and Wiring Electrode, and Formation of $p^+$ Region: FIG. 19A]

Resist masks 6016 to 6019 are formed and the first conductive film and the second conductive film (which are hereinafter treated as a laminated film) are etched to form a gate electrode 6020 and gate wirings 6021 and 6022 of a p-channel TFT. Conductive films 6023, 6024 are left to cover the entire surface of the regions to be n-channel TFTs.

Proceeding to the next step, the resist masks 6016 to 6019 are remained as they are to serve as masks, and a part of the semiconductor layer 6004 where the p-channel TFT is to be formed is doped with an impurity element for imparting p type. Boron is selected here as the impurity element and is doped by ion doping (of course ion implantation also will do) using dibolane ($B_2H_6$). The concentration of boron used in the doping here is $5\times10^{20}$ to $3\times10^{21}$ atoms/cm$^3$. The concentration of the impurity element for imparting p type contained in the impurity regions formed here is expressed as ($p^{++}$). Accordingly, impurity regions 6025 and 6026 may be referred to as $p^{++}$ regions in this specification.

Here, doping process of impurity element imparting p-type may be performed instead after exposing a portion of island semiconductor layer 6004 by removing gate insulating film 6007 by etching using resist masks 6016–6019. In this case, a low acceleration voltage is sufficient for the doping, causing less damage on the island semiconductor film and improving the throughput.

Figure 19B:
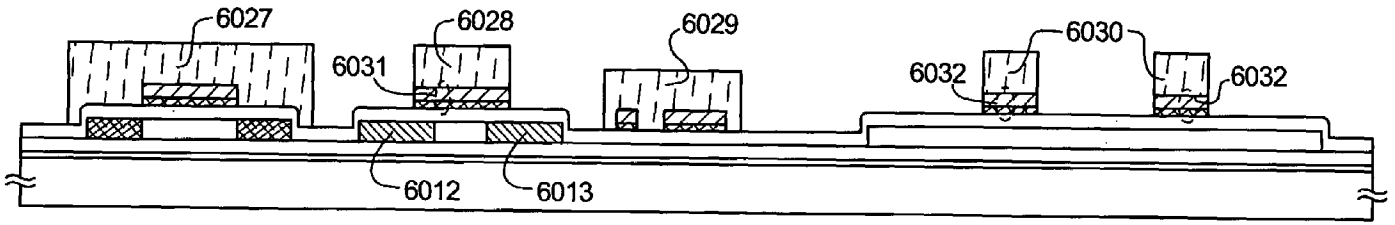

[Formation of n-Channel Gate Electrode: FIG. 19B]

Then the resist masks 6016 to 6019 are removed and new resist masks 6027 to 6030 are formed to form gate electrodes 6031 and 6032 of the n-channel TFTs. At this point, the gate electrode 6031 is formed so as to overlap with the $n^-$ regions 6012, 6013 through the gate insulating film.

Figure 19C:
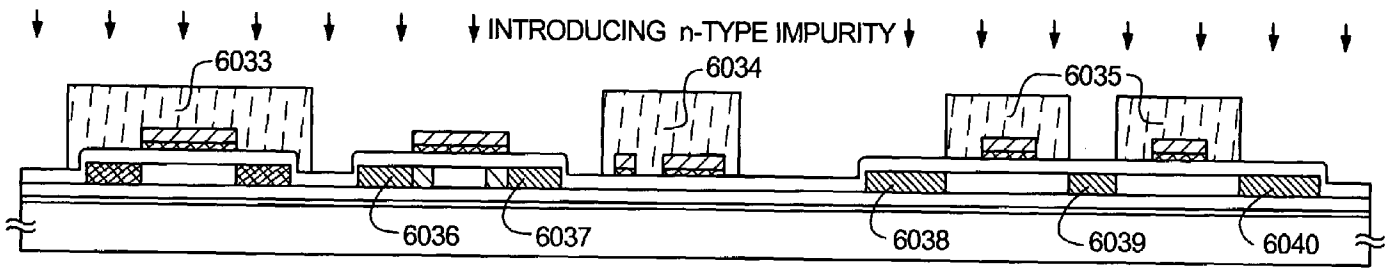

[Formation of $n^+$ Region: FIG. 19C]

The resist masks 6027 to 6030 are then removed and new resist masks 6033 to 6035 are formed. Subsequently, a step of forming an impurity region functioning as a source region or a drain region in the n-channel TFT will be carried out. The resist mask 6035 is formed so as to cover the gate electrode 6032 of the n-channel TFT. This is for forming in later step an LDD region which do not to overlap with the gate electrode in the n-channel TFT of the active matrix circuit.

An impurity element for imparting n type is added thereto to form impurity regions 6036 to 6040. Here, ion doping (of course ion implantation also will do) using phosphine ($PH_3$) is again employed, and the phosphorus concentration in these regions is set to $1\times10^{20}$ to $1\times10^{21}$ atoms/cm$^3$. The concentration of the impurity element contained in the impurity regions 6038 to 6040 formed here is expressed as ($n^+$). Accordingly, the impurity regions 6038 to 6040 may be referred to as $n^+$ regions in this specification. The impurity regions 6036, 6037 have $n^-$ regions which have already been formed, so that, strictly speaking, they contain a slightly higher concentration of phosphorus than the impurity regions 6038 to 6040 do.

Here, doping process of impurity element imparting n-type may be performed instead after exposing a portion of island semiconductor layer 6005 and 6006 by removing gate insulating film 6007 by etching using resist masks 6033 to 6035. In this case, a low acceleration voltage is sufficient for the doping, causing less damage on the island semiconductor film and improving the throughput.

Figures 20A, 20B, 20C:
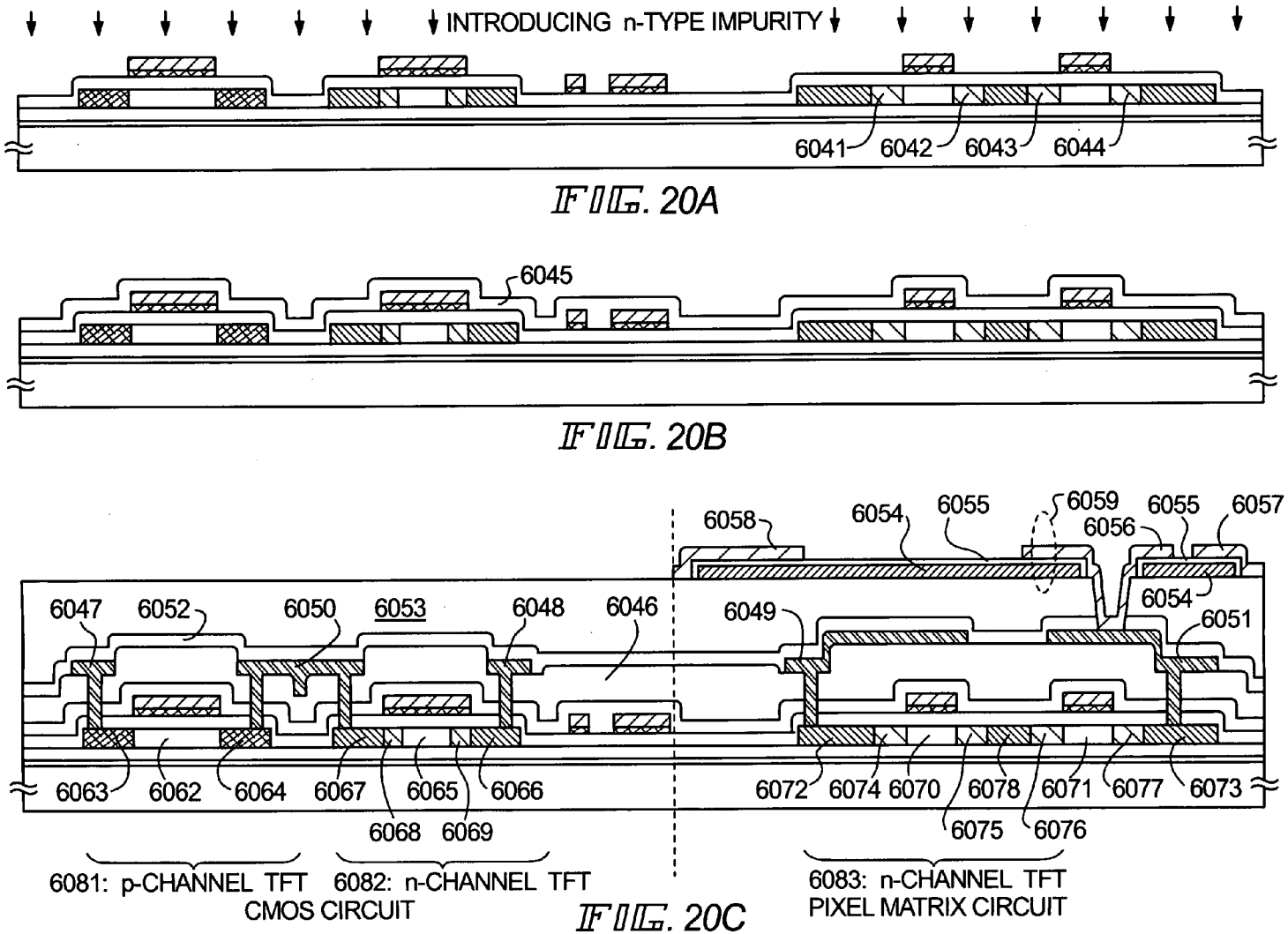
FIGS. 20A to 20C are diagrams showing an example of the manufacturing process of the display device according to the present invention.

[Formation of $n^{--}$ Region: FIG. 20A]

Next, a step is carried out in which the resist masks 6033 to 6035 are removed and the island semiconductor layer 6006 where the n-channel TFT of the active matrix circuit is to be formed is doped with an impurity element for imparting n type. The thus formed impurity regions 6041 to 6044 are doped with phosphorus in the same concentration as in the above $n^-$ regions or a less concentration (specifically, $5\times10^{16}$ to $1\times10^{18}$ atoms/cm$^3$). The concentration of the impurity element for imparting n type contained in the impurity regions 6041 to 6044 formed here is expressed as ($n^{--}$). Accordingly, the impurity regions 6041 to 6044 may be referred to as $n^{--}$ regions in this specification. Incidentally, every impurity region except for an impurity region 6068 that is hidden under the gate electrode is doped with phosphorus in a concentration of $n^{--}$ in this step. However, the phosphorus concentration is so low that the influence thereof may be ignored.

[Step of Thermal Activation: FIG. 20B]

Formed next is a protective insulating film 6045, which will later become a part of a first interlayer insulating film. The protective insulating film 6045 may be made of a silicon nitride film, a silicon oxide film, a silicon oxynitride film or a lamination film with those films layered in combination. The film thickness thereof ranges from 100 to 400 nm.

Thereafter, a heat treatment step is carried out to activate the impurity elements added in the respective concentration for imparting n type or p type. This step may employ the furnace annealing, the laser annealing or the rapid thermal annealing (RTA). Here, the activation step is carried out by the furnace annealing. The heat treatment is conducted in a nitrogen atmosphere at 300 to 650° C., preferably 400 to 550° C., in here 450° C., for 2 hours.

Further heat treatment is performed in an atmosphere containing 3 to 100% of hydrogen at 300 to 450° C. for 1 to 12 hours, hydrogenating the island semiconductor layer. This step is to terminate dangling bonds in the semiconductor layer with thermally excited hydrogen. Other hydrogenating means includes plasma hydrogenation (that uses hydrogen excited by plasma).

[Formation of Interlayer Insulating Film, Source/drain Electrode, Light-Shielding Film, Pixel Electrode and Storage Capacitance: FIG. 20C]

Upon completion of the activation step, an interlayer insulating film 6046 with a thickness of 0.5 to 1.5 μm is formed on the protective insulating film 6045. A lamination film consisting of the protective insulating film 6045 and the interlayer insulating film 6046 serves as a first interlayer insulating film.

After that, contact holes reaching to the source regions and the drain regions of the respective TFTs are formed to form source electrodes 6047 to 6049 and drain electrodes 6050 and 6051. Though not shown, these electrodes in this embodiment mode are each made of a laminated film having a three-layer structure in which a Ti film with a thickness of 100 nm, a Ti-containing aluminum film with a thickness of 300 nm and another Ti film with a thickness of 150 nm are sequentially formed by sputtering.

Then a passivation film 6052 is formed using a silicon nitride film, a silicon oxide film or a silicon oxynitride film in a thickness of 50 to 500 nm (typically, 200 to 300 nm). Subsequent hydrogenation treatment performed in this state brings a favorable result in regard to the improvement of the TFT characteristics. For instance, it is sufficient if heat treatment is conducted in an atmosphere containing 3 to 100% hydrogen at 300 to 450° C. for 1 to 12 hours. The same result can be obtained when the plasma hydrogenation method is used. An opening may be formed here in the passivation film 6052 at a position where a contact hole for connecting the pixel electrode and the drain electrode is to be formed.

Thereafter, a second interlayer insulating film 6053 made from an organic resin is formed to have a thickness of about 1 μm. As the organic resin, polyimide, acrylic, polyamide, polyimideamide, BCB (benzocyclobutene), etc. may be used. The advantages in the use of the organic resin film include simple film formation, reduced parasitic capacitance owing to low relative permittivity, excellent flatness, etc. Other organic resin films than the ones listed above and an organic-based SiO compound may also be used. Here, polyimide of the type being thermally polymerized after applied to the substrate is used and burnt at 300° C. to form the film 6053.

Subsequently, a light-shielding film 6054 is formed on the second interlayer insulating film 6053 in a region to be the active matrix circuit. The light-shielding film 6054 is made from an element selected from aluminum (Al), titanium (Ti) and tantalum (Ta) or of a film containing one of those elements as its main ingredient to have a thickness of 100 to 300 nm. On the surface of the light-shielding film 6054, an oxide film 6055 with a thickness of 30 to 150 nm (preferably 50 to 75 nm) is formed by anodic oxidation or plasma oxidation. Here in this embodiment mode, an aluminum film or a film mainly containing aluminum is used as the light-shielding film 6054, and an aluminum oxide film (alumina film) is used as the oxide film 6055.

The insulating film is provided only on the surface of the light-shielding film here in this embodiment mode. The insulating film may be formed by a vapor phase method such as plasma CVD, thermal CVD or sputtering. In that case also, the film thickness thereof is appropriately 30 to 150 nm (preferably 50 to 75 nm). A silicon oxide film, a silicon nitride film, a silicon oxynitride film, a DLC (Diamond like carbon) film or an organic resin film may be used for the insulating film. A lamination film with those films layered in combination may also be used.

Then a contact hole reaching the drain electrode 6051 is formed in the second interlayer insulating film 6053 to form a pixel electrode 6056. Incidentally, pixel electrodes 6057 and 6058 are for adjacent but individual pixels, respectively. For the pixel electrodes 6056 to 6058, a transparent conductive film may be used in the case of fabricating a transmission type display device and a metal film may be used in the case of a reflection type display device. In the embodiment mode here, in order to manufacture a transmission type display device, an indium tin oxide (ITO) film with a thickness of 100 nm is formed by sputtering.

At this point, a storage capacitor is formed using a region 6059 where the pixel electrode 6056 overlaps with the light-shielding film 6054 through the oxide film 6055.

In this way, an active matrix substrate having the CMOS circuit serving as a driver circuit and the active matrix circuit which are formed on the same substrate is completed. A p-channel TFT 6081 and an n-channel TFT 6082 are formed in the CMOS circuit serving as a driver circuit, and a pixel TFT 6083 is formed from an n-channel TFT in the active matrix circuit.

The p-channel TFT 6081 of the CMOS circuit has a channel formation region 6062, and a source region 6063 and a drain region 6064 respectively formed in the $p^+$ regions. The n-channel TFT 6082 has a channel formation region 6065, a source region 6066, a drain region 6067 and LDD regions 6068 and 6069 which overlap with the gate electrode through the gate insulating film (hereinafter referred to as Lov region, where 'ov' stands for 'overlap'). The source region 6066 and the drain region 6067 are formed respectively in ($n^-$+$n^+$) regions and the Lov region 6068 and 6069 are formed in the $n^-$ region.

The pixel TFT 6083 has channel formation regions 6070 and 6071, a source region 6072, a drain region 6073, LDD regions 6074 to 6077 which do not overlap with the gate electrode through the gate insulating film (hereinafter referred to as Loff regions, where 'off' stands for 'offset'), and an $n^+$ region 6078 in contact with the Loff regions 6075 and 6076. The source region 6072 and the drain region 6073 are formed respectively in the $n^+$ regions and the Loff regions 6074 to 6077 are formed in the $n^{--}$ regions.

In the present invention, the structure of the TFTs for forming the active matrix circuit and for forming the driver circuit can be optimized in accordance with the circuit specification each circuit requires, thereby improving operational performance and reliability of the semiconductor device. Specifically, varying the arrangement of the LDD region in the n-channel TFT and choosing either the Lov region or the Loff region in accordance with the circuit specification realize formation on the same substrate of the TFT structure that attaches importance to high speed operation or to countermeasures for hot carrier and the TFT structure that attaches importance to low OFF current operation.

For instance, in the case of the active matrix display device, the n-channel TFT 6082 is suitable for a logic circuit where importance is attached to the high speed operation, such as a shift register circuit, a frequency divider circuit, a signal dividing circuit, a level shifter circuit and a buffer circuit. On the other hand, the n-channel TFT 6083 is suitable for a circuit where importance is attached to the low OFF current operation, such as an active matrix circuit and a sampling circuit (sample hold circuit).

The length (width) of the Lov region is 0.5 to 3.0 μm, typically 1.0 to 1.5 μm, with respect to the channel length of 3 to 7 μm. The length (width) of the Loff regions 6073 to 6076 arranged in the pixel TFT 6083 is 0.5 to 3.5 μm, typically 2.0 to 2.5 μm.

A display device is manufactured using as the base the active matrix substrate fabricated through the above steps. For an example of the manufacturing process, see Embodiment mode 4.

Embodiment Mode 6

Figure 21:
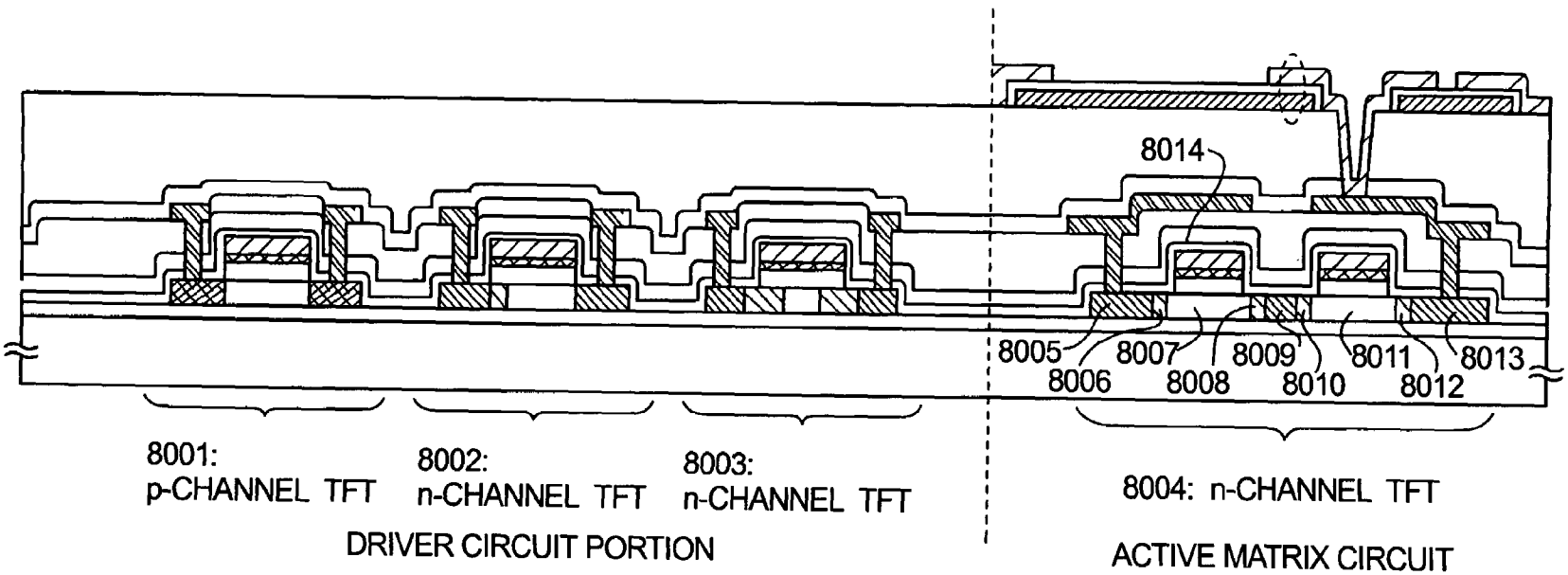
FIG. 21 is a diagram showing cross sectional structure of a display device according to the present invention.

FIG. 21 shows an example of another structure of the active matrix substrate for the liquid crystal display device of the present invention. Reference numeral 8001 denotes a p-channel TFT, while 8002, 8003 and 8004 denote n-channel TFTs. The TFTs 8001, 8002, 8003 constitute a circuit portion of a driver, and 8004 is a component of an active matrix circuit portion.

Reference numerals 8005 to 8013 denote semiconductor layers of the pixel TFT constituting the active matrix circuit. Denoted by 8005, 8009 and 8013 are $n^+$ regions; 8006, 8008, 8010 and 8012, $n^{--}$ regions; and 8007 and 8011, channel formation regions. A cap layer of an insulating film is designated by 8014, which is provided to form offset portions in the channel formation regions.

As concerns this embodiment mode, see a patent application by the present applicant, Japanese Patent Application No. Hei 11-67809.

Embodiment Mode 7

In the above-described liquid crystal display devices of the present invention, various kinds of liquid crystal may be used other than TN liquid crystal. For example, usable liquid crystal material includes ones disclosed in: 1998, SID, "Characteristics and Driving Scheme of Polymer-Stabilized Monostable FLCD Exhibiting Fast Response Time and High Contrast Ratio with Gray-Scale Capability" by H. Furue et al.; 1997, SID DIGEST, 841, "A Full-Color Thresholdless Antiferroelectric LCD Exhibiting Wide Viewing Angle with Fast Response Tune" by T. Yoshida et al.; 1996, J. Mater. Chem. 6(4), 671–673, "Thresholdless Antiferroelectricity in Liquid Crystals and its Application to Displays" by S. Inui et al.; and U.S. Pat. No. 5,594,569.

Liquid crystal that exhibits antiferroelectric phase in a certain temperature range is called antiferroelectric liquid crystal. Among mixed liquid crystal having antiferroelectric liquid crystal, there is one called thresholdless-antiferroelectric mixed liquid crystal, which exhibits electro-optical response characteristics in that the transmittance varies continuously with respect to the electric field. Some of the thresholdless-antiferroelectric mixed liquid crystal show electro-optical response characteristics of V shape, and there has been found among them ones the driving voltage of which is about ±2.5 V (with cell thickness of about 1 to 2 μm).

Figure 22:
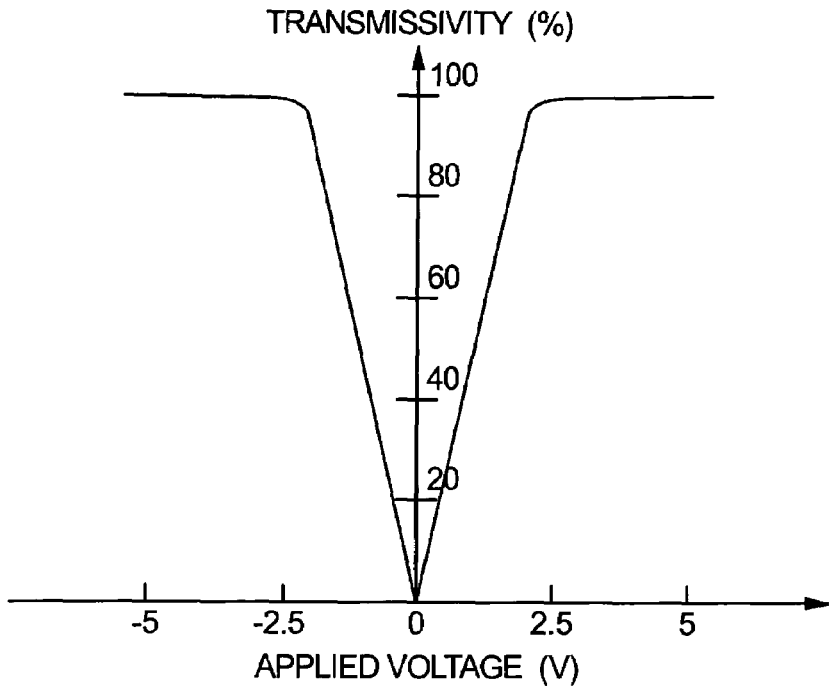
FIG. 22 is a graph showing the applied voltage—transmittance characteristic of thresholdless antiferroelectric mixed liquid crystal.

Here, reference is made to FIG. 22 showing exemplary characteristics of the thresholdless-antiferroelectric mixed liquid crystal that exhibits electro-optical response characteristics of V shape, in terms of its light transmittance with respect to the applied voltage. In the graph shown in FIG. 22, the axis of the ordinate indicates transmittance (in arbitrary unit) and the axis of abscissa indicates applied voltage. A transmission axis of a polarizing plate on the incident side of a liquid crystal display device is set substantially in parallel with the normal line direction of a smectic layer of the thresholdless-antiferroelectric mixed liquid crystal which substantially coincides with the rubbing direction of the liquid crystal display device. On the other hand, a transmission axis of the polarizing plate on the emission side is set so as to substantially form cross Nicol to the transmission axis of the polarizing plate on the incident side.

As shown in FIG. 22, it can be understood that using such thresholdless-antiferroelectric mixed liquid crystal makes possible the low-voltage driving and gray scale display.

In the case that such thresholdless-antiferroelectric mixed liquid crystal of low-voltage driving is used in a liquid crystal display device having an analog driver, supply voltage of a sampling circuit for a video signal may be suppressed to, for example, about 5 to 8 V Accordingly, operation supply voltage of the driver may be lowered to realize a liquid crystal display device of lowered power consumption and high reliability.

Also in the case that such thresholdless-antiferroelectric mixed liquid crystal of low-voltage driving is used in a liquid crystal display device having a digital driver, the output voltage of a D/A converter circuit may be reduced so as to lower operation supply voltage of the D/A converter circuit and to lower operation supply voltage of the driver. Accordingly, a liquid crystal display device of lowered power consumption and high reliability may be realized.

Therefore, the use of such thresholdless-antiferroelectric mixed liquid crystal of low-voltage driving is effective also when employing a TFT having an LDD region (lightly doped region) of which width is relatively small (for example, 0 to 500 nm, or 0 to 200 nm).

In general, thresholdless-antiferroelectric mixed liquid crystal is large in spontaneous polarization and dielectric permittivity of liquid crystal itself is high. For that reason, relatively large storage capacitor is required for a pixel when using for a liquid crystal display device the thresholdless-antiferroelectric mixed liquid crystal. Thus, preferably used is thresholdless-antiferroelectric mixed liquid crystal that is small in spontaneous polarization. Alternatively, with employment of the linear-sequential driving as a driving method of the liquid crystal display device, writing period of voltage gray scale into a pixel (pixel feed period) is prolonged so that a small storage capacitor may be supplemented.

The use of such thresholdless-antiferroelectric mixed liquid crystal realizes the low-voltage driving, to thereby realize a liquid crystal display device of lowered power consumption.

Incidentally, any liquid crystal may be used as a display medium for the liquid crystal display device of the present invention, on condition that it has electro-optical characteristics as shown in FIG. 22.

Embodiment Mode 8

Figure 23:
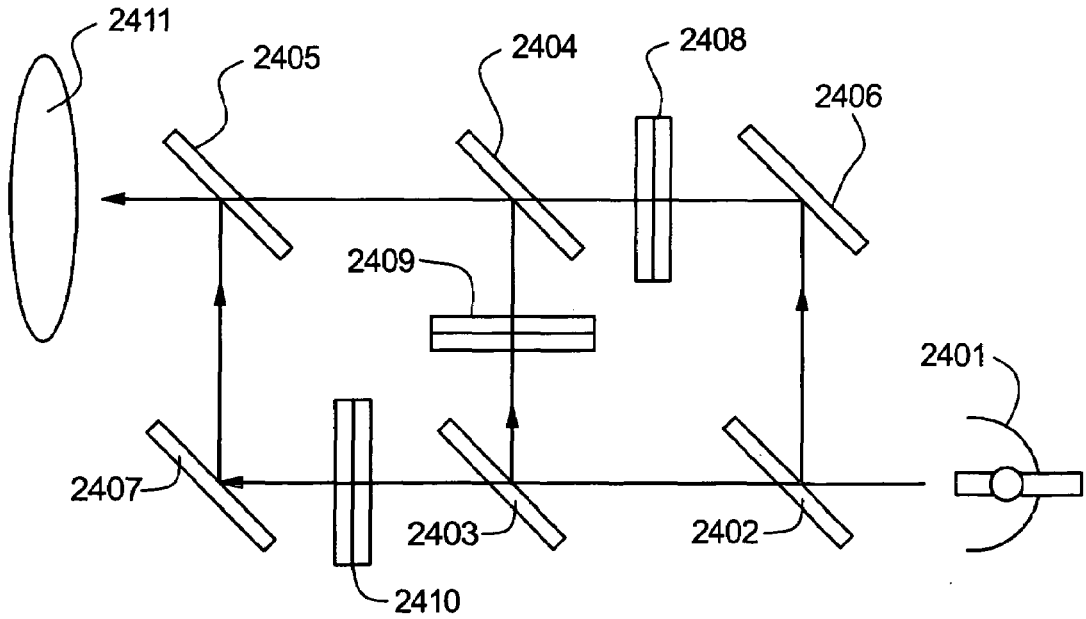
FIG. 23 is a structural diagram schematically showing a three panel type projector using display devices of the present invention.

The display device of the present invention described above may be used for a three panel type projector as shown in FIG. 23.

In FIG. 23, reference numeral 2401 denotes a white light source; 2402 to 2405, dichroic mirrors; 2406 and 2407, total reflection mirrors; 2408 to 2410, display devices of the present invention; and 2411, a projection lens.

Embodiment Mode 9

Figure 24:
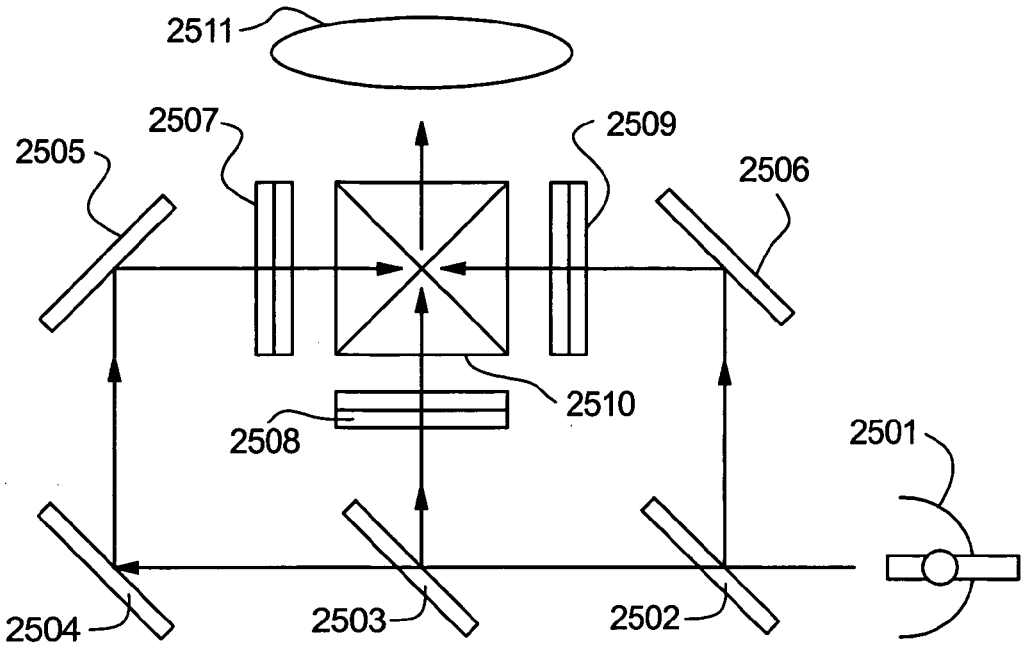
FIG. 24 is a structural diagram schematically showing a three panel type projector using display devices of the present invention.

The display device of the present invention described above may be used also for a three panel type projector as shown in FIG. 24.

In FIG. 24, reference numeral 2501 denotes a white light source; 2502 and 2503, dichroic mirrors; 2504 to 2506, total reflection mirrors; 2507 to 2509, display devices of the present invention; 2510, a dichroic prism; and 2511, a projection lens.

Embodiment Mode 10

Figure 25:
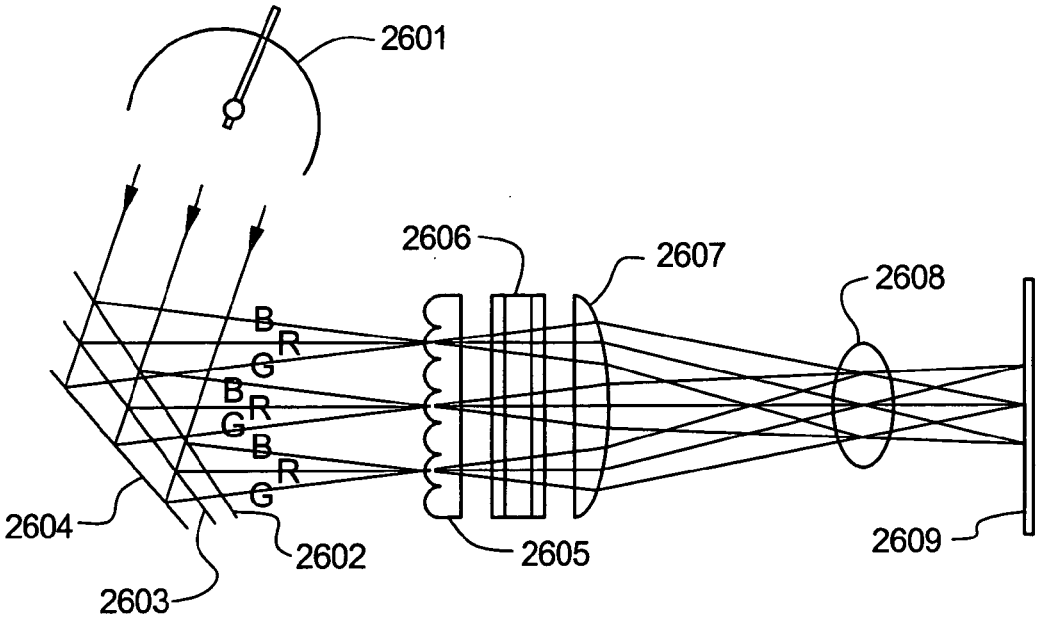
FIG. 25 is a structural diagram schematically showing a single panel type projector using a display device of the present invention.

The display device of the present invention described in the above-mentioned Embodiment mode 1 to 3 may be used also for a single panel type projector as shown in FIG. 25.

In FIG. 25, reference numeral 2601 denotes a white light source comprising a lamp and a reflector, and 2602, 2603 and 2604 denote dichroic mirrors which selectively reflect light in wavelength regions of blue, red and green, respectively. Denoted by 2605 is a microlens array consisting of a plurality of microlenses. Reference numeral 2606 denotes a display panel of the present invention; 2607, a field lens; 2608, a projection lens; and 2609, a screen.

Embodiment Mode 11

The projectors in Embodiment modes 8 to 10 above are classified into rear projectors and front projectors depending on their manner of projection.

Figure 26A:
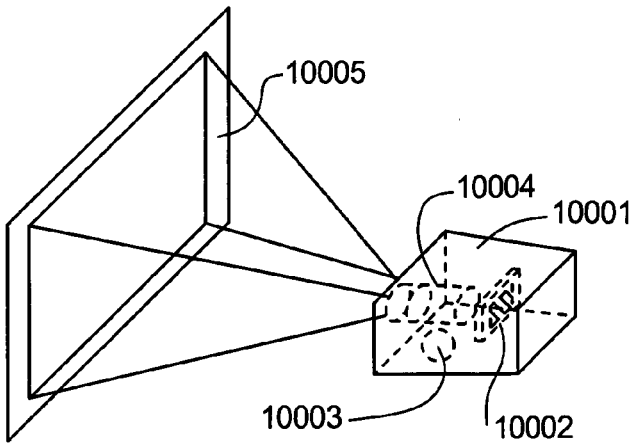
FIGS. 26A and 26B are structural diagrams schematically showing a front projector and a rear projector, respectively, each using a display device of the present invention.

FIG. 26A shows a front projector comprised of a main body 10001, a display device 10002 of the present invention, a light source 10003, an optical system 10004, and a screen 10005. Though shown in FIG. 26A is the front projector incorporating one display device, it may incorporate three display devices (corresponding to the light R, G and B, respectively) to realize a front projector of higher resolution and higher definition.

Figure 26B:
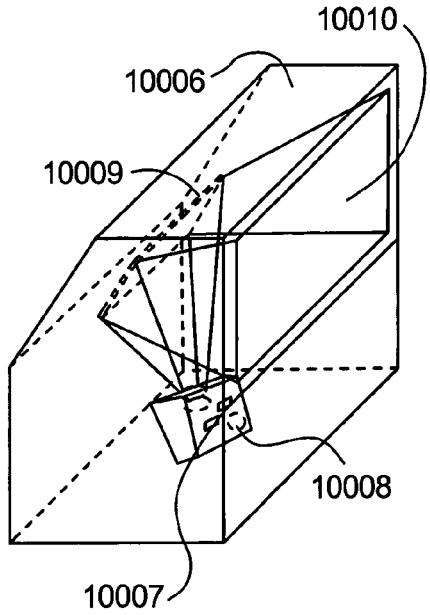

FIG. 26B shows a rear projector comprised of a main body 10006, a display device 10007, a light source 10008, a reflector 10009, and a screen 10010. Shown in FIG. 26B is a rear projector incorporating three active matrix semiconductor display devices (corresponding to the light R, G and B, respectively).

Embodiment Mode 12

This embodiment mode shows an example in which the display device of the present invention is applied to a goggle type display.

Figure 27:
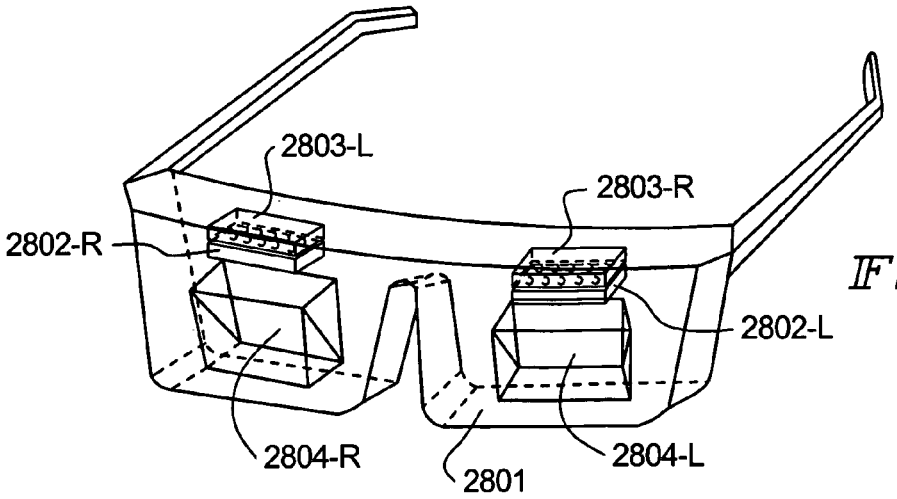
FIG. 27 is a structural diagram schematically showing a goggle type display using display devices of the present invention.

Reference is made to FIG. 27. Denoted by 2801 is the main body of a goggle type display; 2802-R, 2802-L, display devices of the present invention; 2803-R, 2803-L, LED backlights; and 2804R, 2804-L, optical elements.

Embodiment Mode 13

In this embodiment mode, LEDs are used for a backlight of a display device of the present invention to perform a field sequential operation.

Figure 28:
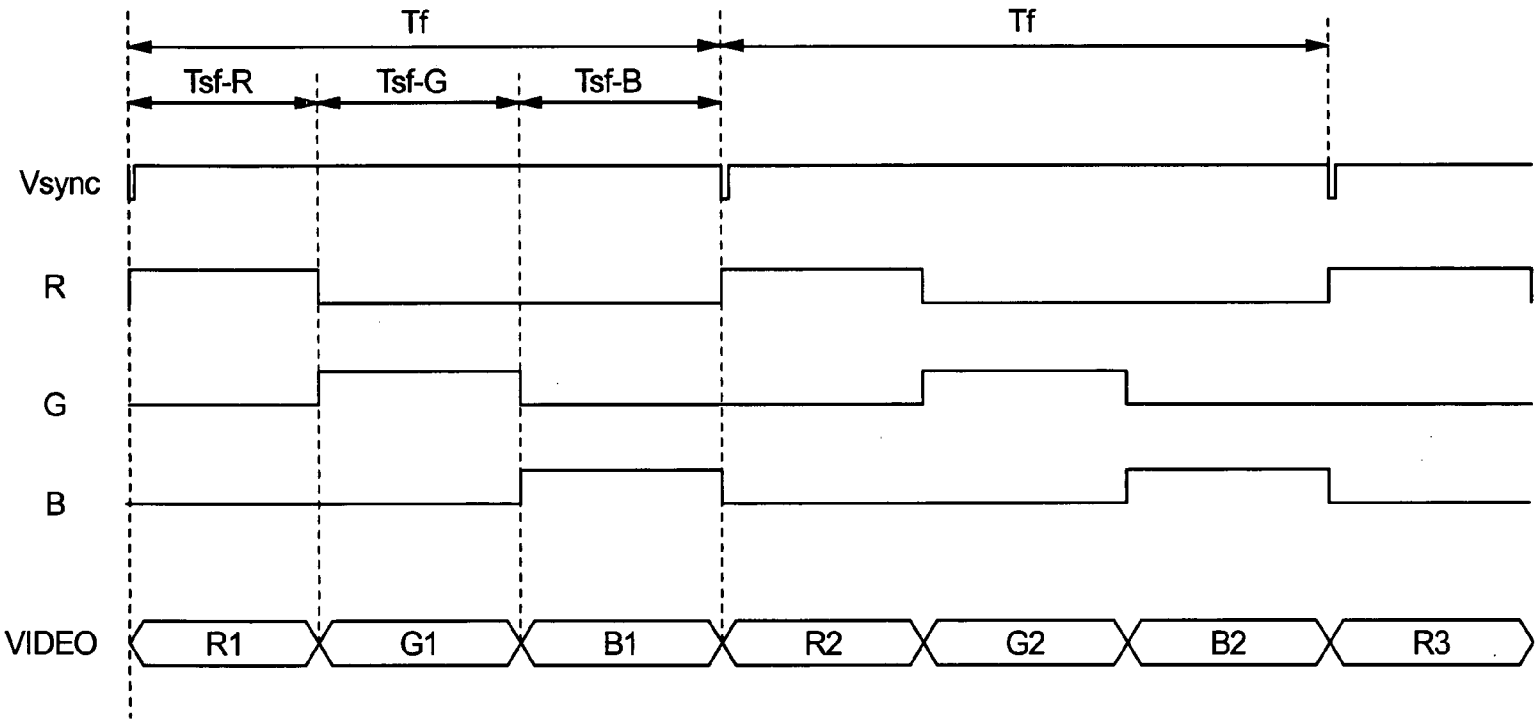
FIG. 28 is a timing chart for field sequential driving.

The timing chart of the field sequential driving method in FIG. 28 shows a start signal for writing a video signal (Vsync signal), lighting timing signals (R, G and B) for red (R), green (G) and blue (B) LEDs, and a video signal (VIDEO). Tf indicates a frame period. Tr, Tg, Tb designate lit-up periods for red (R), green (G) and blue (B) LEDs, respectively.

A video signal sent to the display device, for example, R1, is a signal obtained by compressing along the time-base the video data, that is inputted from the external and corresponds to red, to have a size one third the original data size. A video signal sent to the display panel, G1, is a signal obtained by compressing along the time-base the video data, that is inputted from the external and corresponds to green, to have a size one third the original data size. A video signal sent to the display panel, B1, is a signal obtained by compressing along the time-base the video data, that is inputted from the external and corresponds to blue, to have a size one third the original data size.

In the field sequential driving method, R, G and B LEDs are lit respectively and sequentially during the LED lit-up periods: TR period, TG period and TB period. A video signal (R1) corresponding to red is sent to the display panel during the lit-up period for the red LED (TR), to write one screen of red image into the display panel. A video data (G1) corresponding to green is sent to the display panel during the lit-up period for the green LED (TG), to write one screen of green image into the display panel. A video data (B1) corresponding to blue is sent to the display device during the lit-up period for the blue LED (TB), to write one screen of blue image into the display device. These three times operations of writing images complete one frame of image.

Embodiment Mode 14

Figure 29:
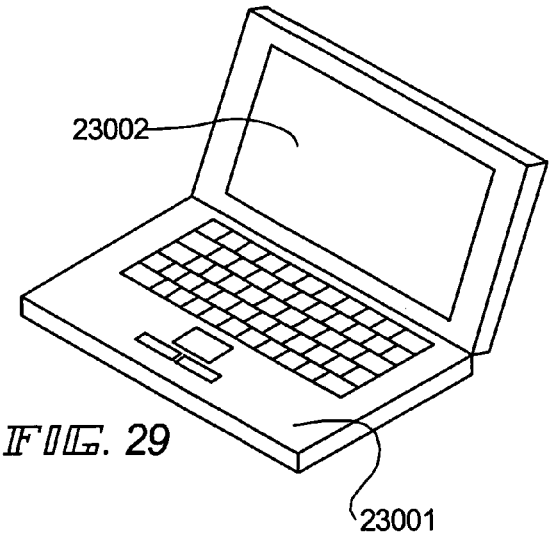
FIG. 29 is a structural diagram schematically showing a notebook type personal computer using a display device of the present invention.

This embodiment mode shows with reference to FIG. 29 an example in which a display device of the present invention is applied to a notebook computer.

Reference numeral 23001 denotes the main body of a notebook computer, and 23002 denotes a display device of the present invention. LEDs are used for a backlight. The backlight may instead employ a cathode ray tube as in the prior art.

Embodiment Mode 15

The display device of the present invention may be applied in various uses. In the present embodiment mode, semiconductor devices loading a display device of the present invention is explained.

Such semiconductor device include video camera, still camera, car navigation systems, personal computer, portable information terminal (mobile computer, mobile telephone etc.). Examples of those are shown in FIG. 30.

Figure 30A:
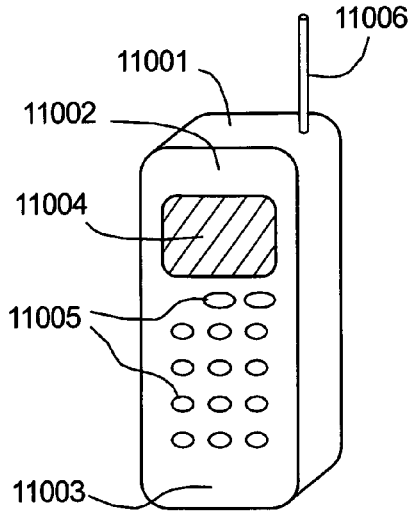
FIGS. 30A to 30D show examples of electronic equipment using display device of the present invention.

FIG. 30A is a mobile telephone, comprising: main body 11001; voice output section 11002; voice input section 11003; display device of the present invention 11004; operation switch 11005 and antenna 11006.

Figure 30B:
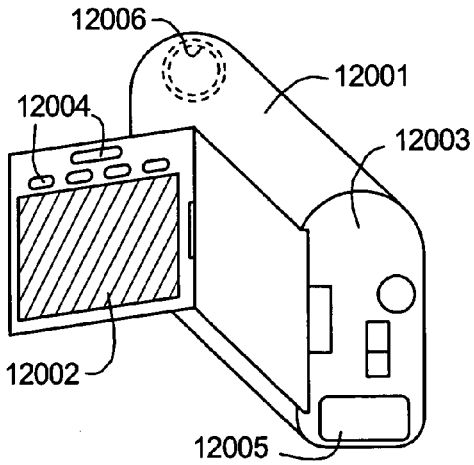

FIG. 30B shows a video camera comprising a main body 12001, a display device 12002 of the present invention, an audio input unit 12003, operation switches 12004, a battery 12005, and an image receiving unit 12006.

Figure 30C:
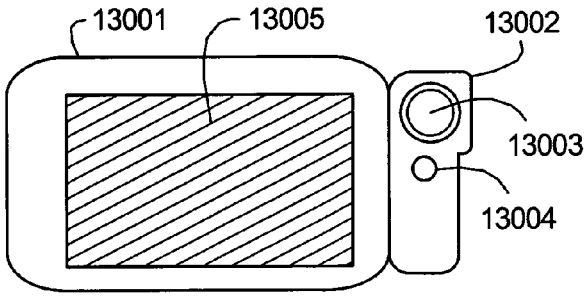

FIG. 30C shows a mobile computer comprising a main body 13001, a camera unit 13002, an image receiving unit 13003, an operation switch 13004, and a display device 13005 of the present invention.

Figure 30D:
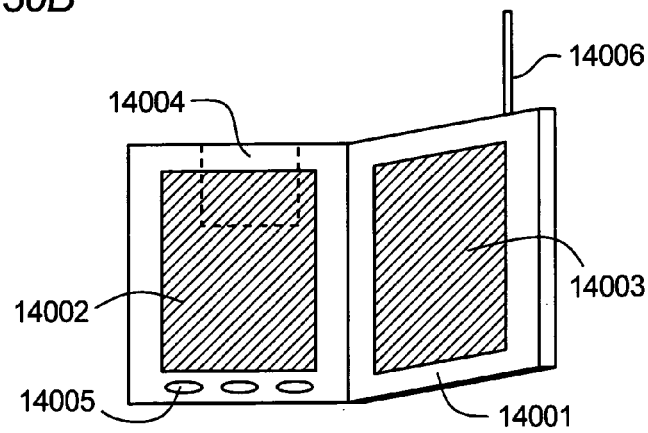

FIG. 30D shows a portable book (electronic book) comprising a main body 14001, display devices 14002, 14003 of the present invention, storing medium, operation switches 14005, and antenna 14006.

Figure 31A:
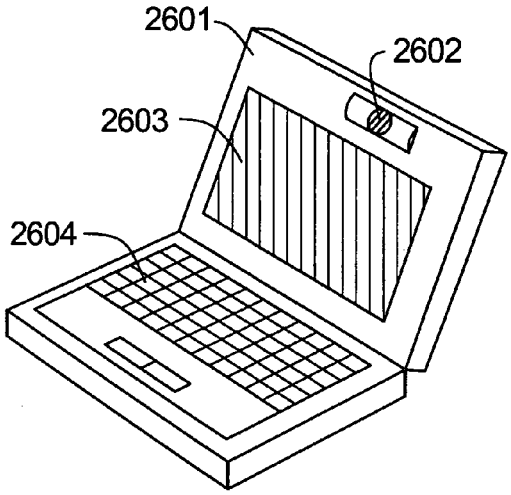
FIGS. 31A to 31D show examples of electronic equipment using display device of the present invention.

FIG. 31A is a personal computer, and is composed of a main body 2601, an image input section 2602, a display device 2603, a keyboard 2604, etc. The electro-optical device of the present invention can be applied to the display device 2603, and the semiconductor circuits of the present invention can be applied to CPU, memories or the like.

Figure 31B:
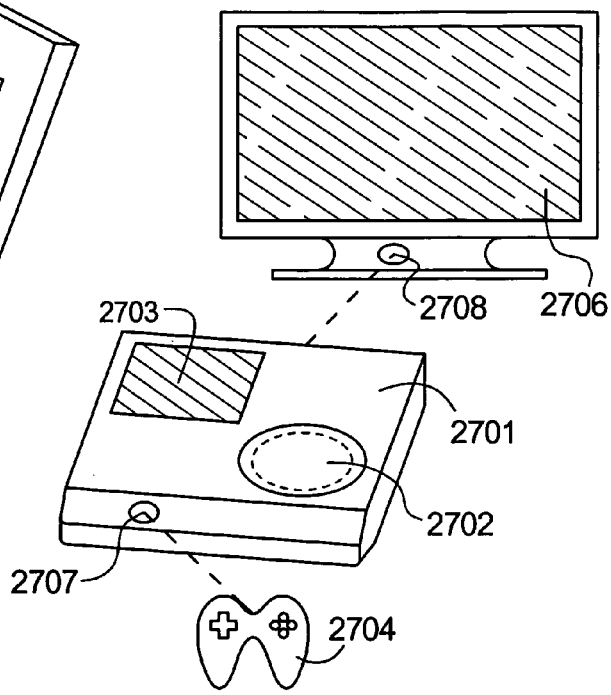

FIG. 31B is an electronic game equipment (game equipment) composing a main body 2701, a recording medium 2702, a display device 2703 and a controller 2704. The voice and the image outputted from the electronic game equipment are reproduced in the display having body 2705 and display device 2706. As communication means between the controller 2704 and the main body 2701 or the electronic game equipment and the display, wired communication, wireless communication or optical communication may be used. In this embodiment mode, there is employed such a structure that an infrared radiation is detected in sensor portions 2707 and 2708. The electro-optical device of the present invention can be applied to the display devices 2703 and 2706, and the semiconductor circuits of the present invention can be applied to CPU, memories or the like.

Figure 31C:
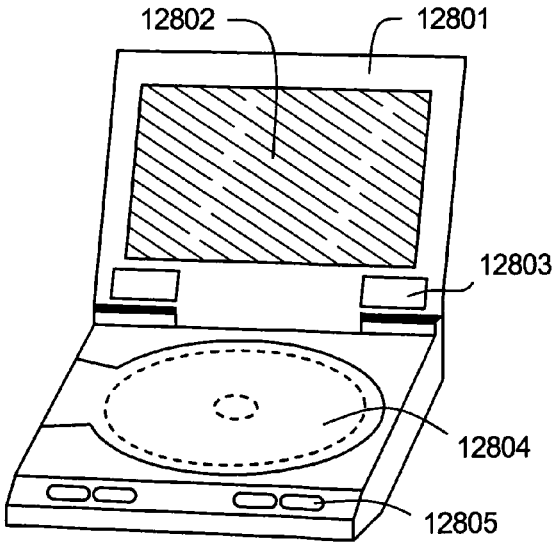

FIG. 31C is a player (image reproduction device) which uses a recording medium on which a program is recorded (hereafter referred to simply as a recording medium), and is composed of a main body 12801, a display device 12802, a speaker section 12803, a recording medium 12804 and operation switches 12805. Note that a DVD (digital versatile disk), or CD as a recording medium for this device, and that it can be used for music appreciation, film appreciation, games, and the Internet. The present invention can be applied to display device 12802, CPU, memories or the like.

Figure 31D:
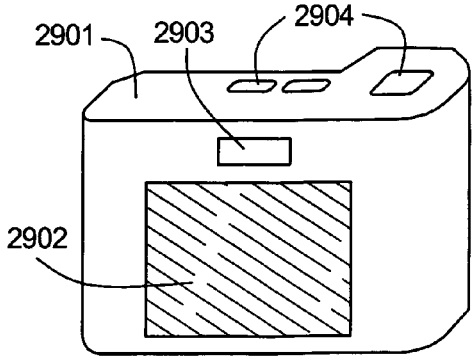

FIG. 31D is a digital camera, and is composed of a main body 2901, a display device 2902, an eyepiece section 2903, operation switches 2904 and an image receiving section (not shown). The present invention can be applied to the display device 2902, CPU, memories or the like.

Embodiment Mode 16

This embodiment mode gives a description on an example where an EL (electroluminescence) display device is manufactured as a display device of the present invention.

Figure 32A:
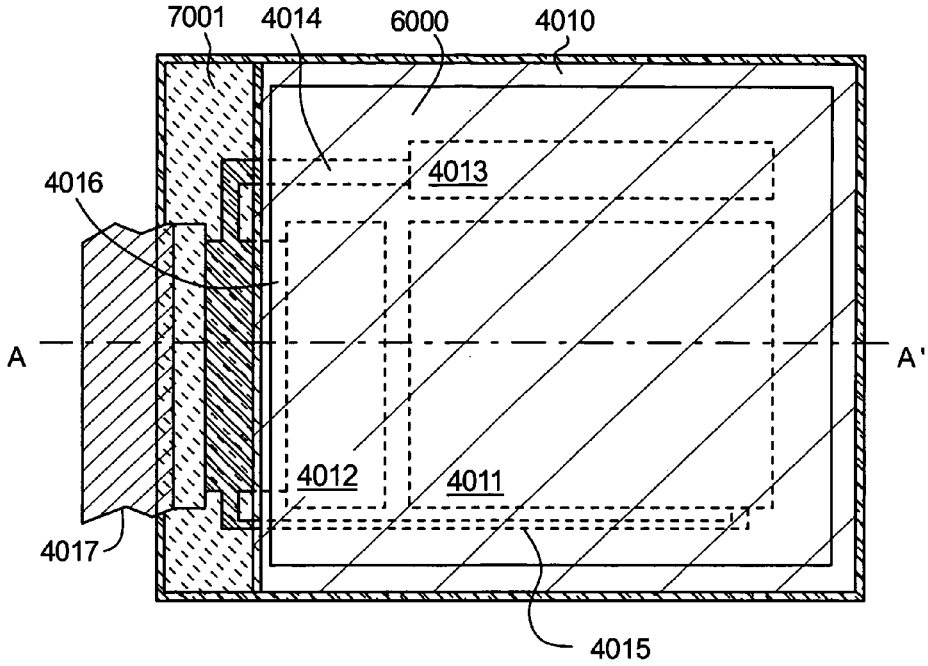
FIGS. 32A and 32B are diagrams respectively showing a top view and a cross sectional structure of an EL display device.

FIG. 32A is a top view of an EL display device according to this embodiment mode. In FIG. 32A, reference numeral 4010 denotes a substrate; 4011, a pixel portion; 4012, a source side driver circuit; and 4013, a gate side driver circuit. Each of the driver circuits is connected to an FPC 4017 through wirings 4014 to 4016, and further connected to external equipment.

Figure 32B:
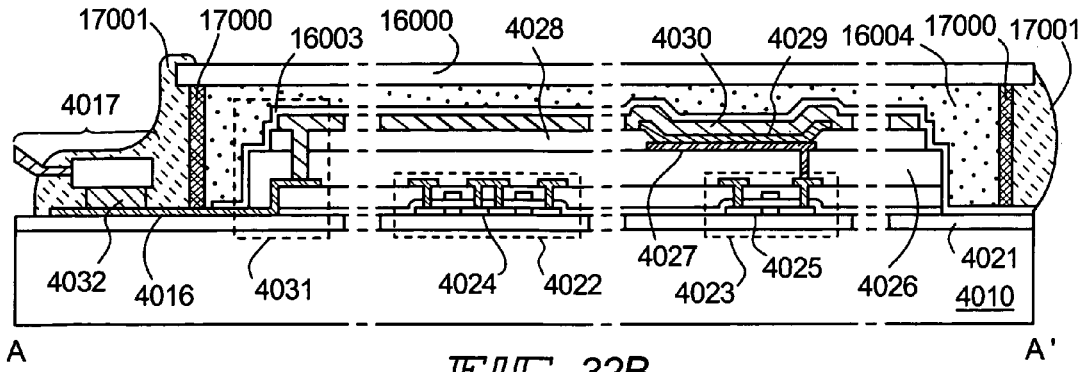

FIG. 32B shows the sectional structure of the EL display device according to this embodiment mode. A cover member 16000, a sealing material 17000 and a sealant (second sealing material) 17001 are arranged so as to enclose, at least, the pixel portion, preferably, the driver circuits and the pixel portion.

A TFT (note that a CMOS circuit having a combination of an n-channel TFT and a p-channel TFT is shown here) 4022 for driver circuit and a TFT (note that only a TFT for controlling the current flowing to an EL element is shown here) 4023 for pixel portion are formed on the substrate 4010 and a base film 4021.

Upon completion of the TFT 4022 for driver circuit and the TFT 4023 for pixel portion, a pixel electrode 4027 made of a transparent conductive film and electrically connected to a drain of the TFT 4023 for pixel portion is formed on an interlayer insulating film (leveling film) 4026 made of a resin material. A usable transparent conductive film is made of a compound of indium oxide and tin oxide (called ITO) or a compound of indium oxide and zinc oxide. After forming the pixel electrode 4027, an insulating film 4028 is formed and an opening is formed on the pixel electrode 4027.

An EL layer 4029 is next formed. The EL layer 4029 may have a laminate structure in which known EL materials (hole injection layer, hole carrying layer, light emitting layer, electron carrying layer, or electron injection layer) are freely layered in combination, or may have a single layer structure. Known techniques may be used in forming either structure. EL materials are divided into low molecular materials and macromolecular (polymer) materials. The evaporation method is used for the low molecular materials while a simple method such as spin coating, printing method and ink jet method may be used for the polymer materials.

In this embodiment mode, the evaporation method is employed with the use of a shadow mask to form the EL layer. The shadow mask is used to form a light emitting layer capable of emitting light different in wavelength for each pixel (red-colored light emitting layer, green-colored light emitting layer and blue-colored light emitting layer), obtaining color display. There are other color display systems, one of which is a system using in combination a color conversion layer (CCM) and a color filter, and the other is a system using in combination a white-light emitting layer and a color filter. Any of these systems may be employed. The EL display device may of course be of single-colored light emission.

After forming the EL layer 4029, a cathode 4030 is formed thereon. It is desirable to remove as much as possible the moisture and oxygen present in the interface between the cathode 4030 and the EL layer 4029. Some contrivance is thus needed, so the EL layer 4029 and the cathode 4030 are sequentially formed in vacuum, or the EL layer 4029 is formed in an inert atmosphere to form the cathode 4030 without exposing it to the air. Such film formation is accomplished in this embodiment mode by employing a film formation device of multi-chamber system (cluster tool system).

This embodiment mode uses as the cathode 4030 a lamination structure consisting of a LiF (lithium fluoride) film and an Al (aluminum) film. Specifically, a LiF (lithium fluoride) film with a thickness of 1 nm is formed on the EL layer 4029 by the evaporation method and an aluminum film with a thickness of 300 nm is formed thereon. A MgAg electrode, which is a known cathode material, may of course be used. The cathode 4030 is then connected to the wiring 4016 in a region denoted by 4031. The wiring 4016 is a power supply line for providing the cathode 4030 with a given voltage, and is connected to the FPC 4017 through a conductive paste material 4032.

In order to electrically connect the cathode 4030 to the wiring 4016 in the region denoted by 4031, contact holes have to be formed in the interlayer insulating film 4026 and the insulating film 4028. These holes are formed in etching the interlayer insulating film 4026 (in forming a contact hole for pixel electrode) and in etching the insulating film 4028 (in forming the opening prior to the formation of the EL layer). Alternatively, the contact holes may be formed by etching at once both the insulating film 4028 and the interlayer insulating film 4026 when the insulating film 4028 is to be etched. In this case, an excellent shape may be obtained for the contact holes if the interlayer insulating film 4026 and the insulating film 4028 are made of the same resin material.

A passivation film 16003, a filling material 16004 and the cover member 16000 are formed to cover the surface of the thus formed EL element.

The sealing material 17000 is arranged inside the cover member 16000 and the substrate 14010 and the sealant (second sealing material) 17001 is formed outside the sealing material 17000 so that the EL element portion is enclosed.

At this point, the filling material 16004 serves also as an adhesive for adhering the cover member 16000. A material usable as the filling material 16004 is PVC (polyvinyl chloride), epoxy resin, silicone resin, PVB (polyvinyl butyral) or EVA (ethylene vinyl acetate). Providing a drying agent inside the filing material 16004 is preferable, since moisture-absorbing effect can be maintained.

The filling material 16004 may contain a spacer therein. The spacer may be made of a granular substance such as BaO, giving the spacer itself moisture-absorbing property.

When the spacer is arranged, the passivation film 16003 can release the spacer pressure. A resin film for releasing the spacer pressure may be formed separately from the passivation film.

Examples of the usable cover member 16000 include a glass plate, an aluminum plate, a stainless steel plate, an FRP (Fiberglass-Reinforced Plastics) plate, a PVF (polyvinyl fluoride) film, a Mylar™ film, a polyester film and an acrylic film. If PVB or EVA is used for the filling material 16004, preferable cover member is a sheet having a structure in which an aluminum foil several tens μm in thickness is sandwiched between PVF films or Mylar™ films.

Depending on the direction of light emitted from the EL element (light emission direction), light-shielding property is required for the cover member 16000.

The wiring 4016 is electrically connected to the FPC 4017 passing through the clearance defined by the substrate 24010 and by the sealing material 17000 and the sealant 17001. Though explanation here is made on the wiring 4016, the rest of the wirings, namely, wirings 4014, 4015 similarly pass under the sealing material 17000 and the sealant 17001 to be electrically connected to the FPC 4017.

Embodiment Mode 17

Figure 33A:
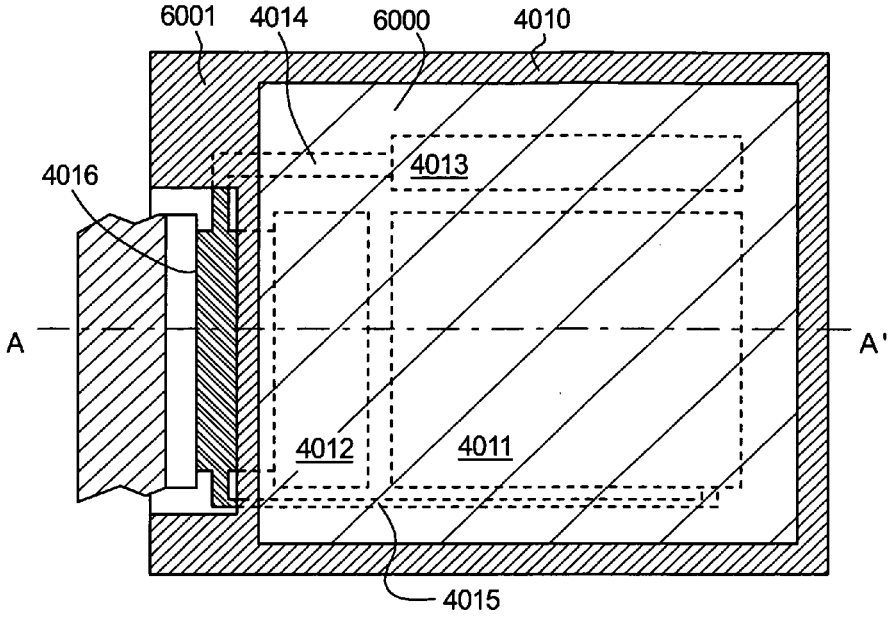
FIGS. 33A and 33B are diagrams respectively showing a top view and a cross sectional structure of an EL display device.
Figure 33B:
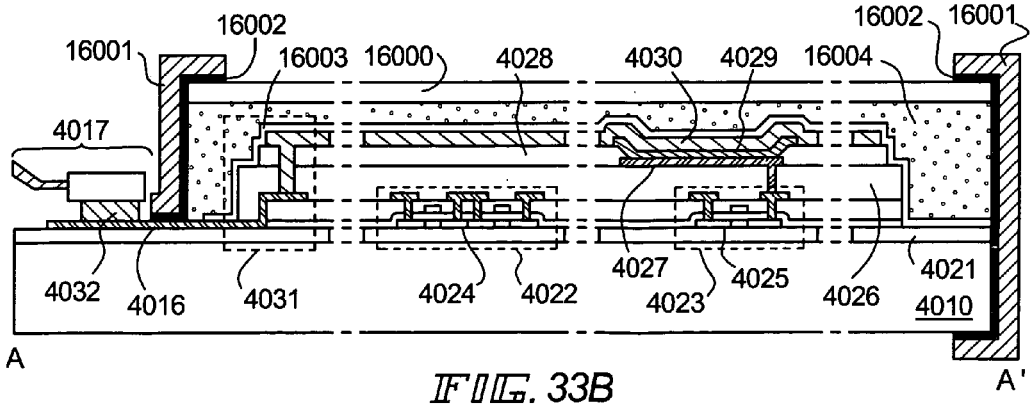

A description given in this embodiment mode with reference to FIGS. 33A and 33B is about an example of manufacturing an EL display device different in configuration from the one in Embodiment mode 16. Reference numerals identical to the ones in FIGS. 32A and 32B designate the same parts, so that explanation thereof is omitted.

FIG. 33A is a top view of an EL display device according to this embodiment mode, and FIG. 33B shows a sectional view taken along the line A–A' in FIG. 33A.

The procedure here follows the description in Embodiment mode 16 up through the formation of the passivation film 10003 covering the surface of the EL element.

The filling material 16004 is arranged so as to further cover the EL element. This filling material 16004 serves also as an adhesive for adhering the cover member 16000. A material usable as the filing material 16004 is PVC (polyvinyl chloride), epoxy resin, silicone resin, PVB (polyvinyl butyral) or EVA (ethylene vinyl acetate). Providing a drying agent inside the filling material 16004 is preferable, for moisture-absorbing effect can be maintained.

The filling material 16004 may contain a spacer therein. The spacer may be made of a granular substance such as BaO, giving the spacer itself moisture-absorbing property.

When the spacer is arranged, the passivation film 16003 can release the spacer pressure. A resin film for releasing the spacer pressure may be formed separately from the passivation film.

Example of the usable cover member 16000 include a glass plate, an aluminum plate, a stainless steel plate, an FRP (Fiberglass-Reinforced Plastics) plate, a PVF (polyvinyl fluoride) film, a Mylar™ film, a polyester film and an acrylic film. If PVB or EVA is used for the filling material 16004, preferable cover member is a sheet having a structure in which an aluminum foil several tens μm in thickness is sandwiched between PVF films or Mylar™ films.

Depending on the direction of light emitted from the EL element (light emission direction), light-shielding property is required for the cover member 16000.

After adhering the cover member 16000 utilizing the filing material 16004, a frame member 16001 is attached so as to cover the side faces (exposed faces) of the filling material 16004. The frame member 16001 is adhered with a sealing material (functioning as an adhesive) 16002. At this point, though preferably employed sealing material 16002 is an optically curable resin, a thermally curable resin may be used instead if the heat resistance of the EL layer allows. The sealing material 16002 is desirably a material that transmits less moisture and oxygen. The sealing material 16002 may additionally contains a drying agent.

The wiring 4016 is electrically connected to the FPC 4017 passing through the clearance between the sealing material 16002 and the substrate 4010. Though explanation here is made on the wiring 4016, the rest of the wirings, namely, wirings 4014, 4015 similarly pass under the sealing material 16002 to be electrically connected to the FPC 4017.

Embodiment Mode 18

Figure 34:
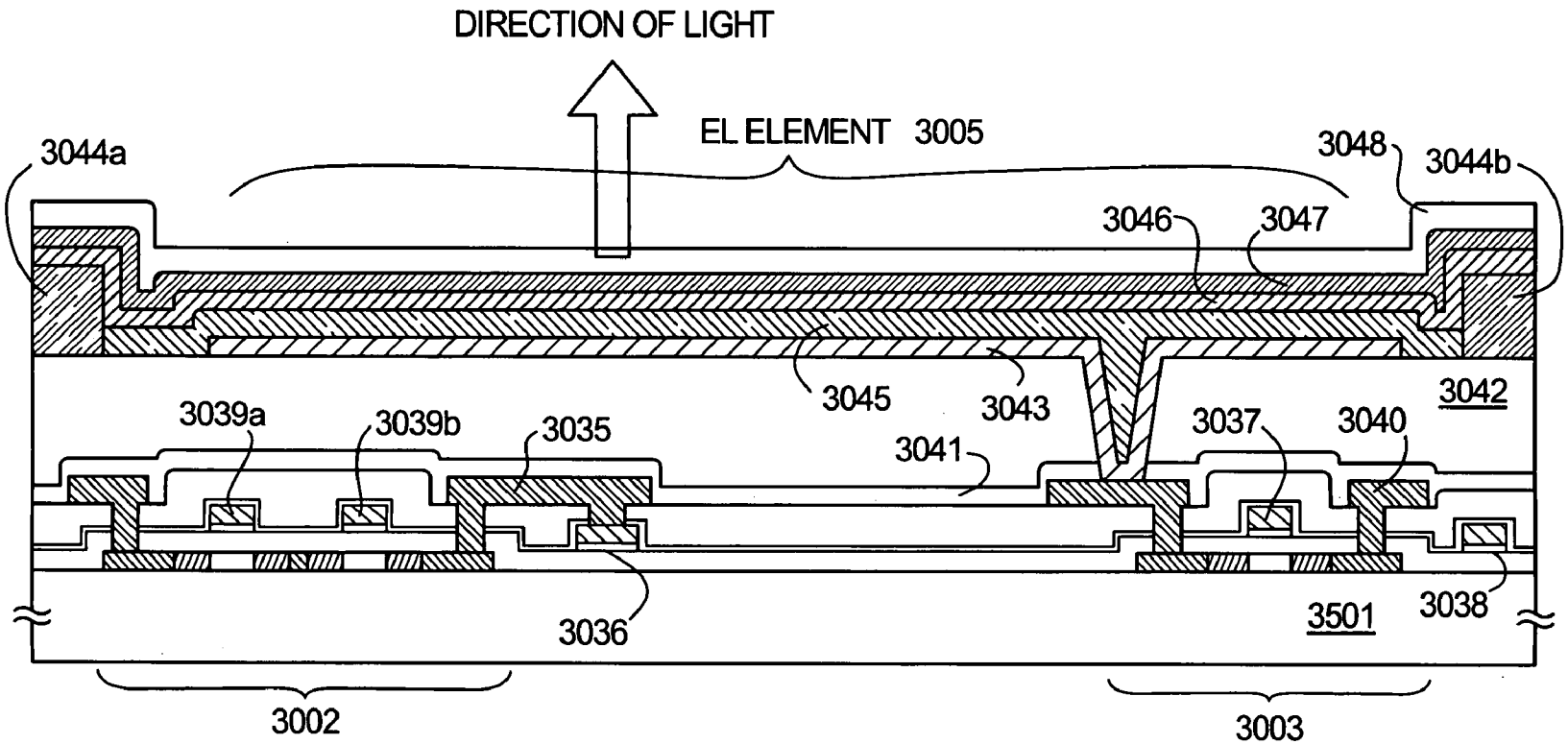
FIG. 34 is a cross sectional view showing the structure of an EL display device.
Figure 35A:
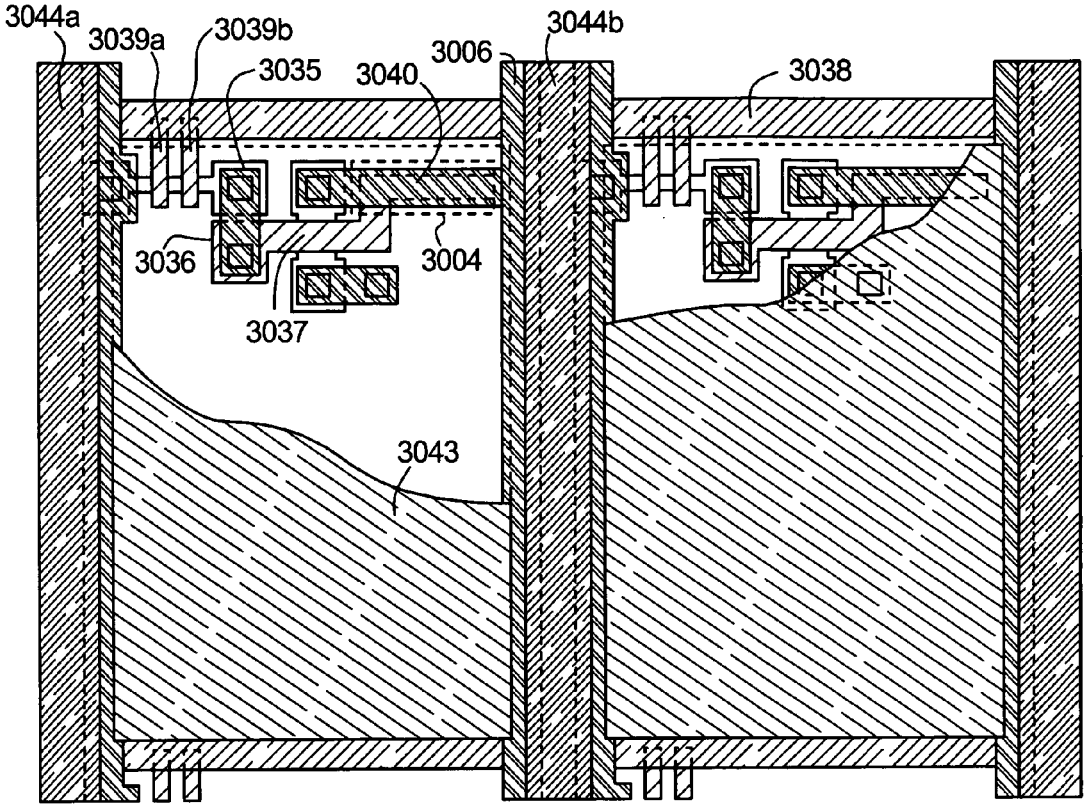
FIGS. 35A and 35B respectively show a top view and a block circuit diagram of a pixel portion in an EL display device.
Figure 35B:
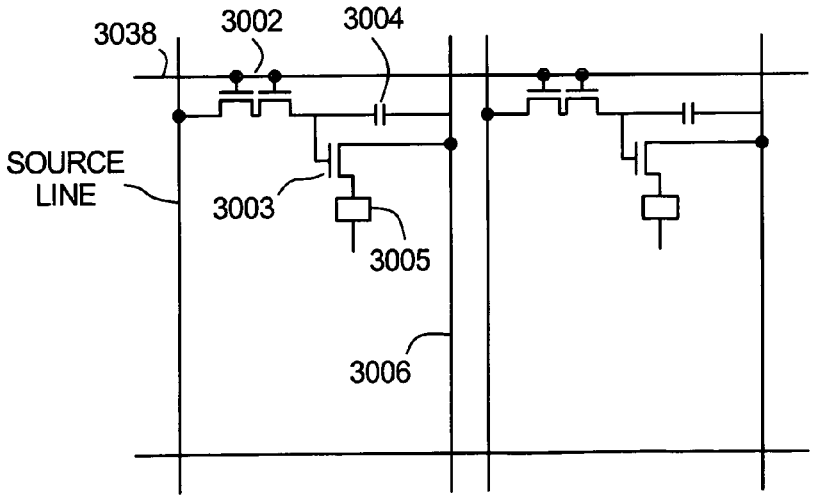

This embodiment mode will be described with reference to: FIG. 34 showing more detailed sectional structure of a pixel portion in an EL display panel, FIG. 35A showing the top structure thereof and FIG. 35B showing a circuit diagram thereof. Common reference numerals are used in FIG. 34, FIG. 35A and FIG. 35B, so that each drawing may find references in the others.

In FIG. 34, a switching TFT 3002 arranged on a substrate 3001 may either take the TFT structure described in the present specification or a known TFT structure. This embodiment mode employs the double gate structure, which does not make much difference in the structure and the manufacturing process, and accordingly the explanation thereof is omitted. It nevertheless is worth noting that the double gate structure has an advantage of reducing OFF current value owing to two TFTs substantially arranged in series. The TFT may take the single gate structure, the triple gate structure, or the multi-gate structure having more than three gates, regardless of employment of the double gate structure in this embodiment mode.

A current controlling TFT 3003 is formed using an NTFT. At this point, a drain wiring 3035 of the switching TFT 3002 is electrically connected through a wiring 3036 to a gate electrode 3037 of the current controlling TFT. A wiring denoted by 3038 is a gate wiring for electrically connecting gate electrodes 3039*a*, 3039*b* of the switching TFT 3002.

The current controlling TFT which is an element for controlling the amount of current flowing in an EL element has a high risk of degradation by heat and by hot carrier due to a large current that flows therein. Therefore the structure of the present invention, in which an LDD region is arranged on the drain side of the current controlling TFT so as to overlap with the gate electrode through a gate insulating film, is very effective.

Although the current controlling TFT 3003 in this embodiment mode is shown as a TFT having the single gate structure, it may take the multi-gate structure in which a plurality of TFTs are connected in series. The TFT 3003 may instead assume the structure in which a plurality of TFTs are connected in parallel to one another to practically divide a channel formation region into plural sections, achieving highly efficient heat radiation. Such structure is effective as countermeasures against degradation by heat.

As shown in FIG. 35A, a wiring to be the gate electrode 3037 of the current controlling TFT 3003 overlaps with a drain electrode 3040 of the current controlling TFT 3003 through the insulating film in a region denoted by 3004. At this point, a capacitor is formed in the region denoted by 3004. The capacitor 3004 functions as a capacitor for holding the voltage applied to the gate of the current controlling TFT 3003. The drain wiring 3040 is connected to a current supply line (power source line) 3006, and a constant voltage is applied thereto.

A first passivation film 3041 is formed on the switching TFT 3002 and the current controlling TFT 3003, and a leveling film 3042 made of a resin insulating film is formed thereon. It is very important to flatten the level difference due to the TFTs using the leveling film 3042. An EL layer to be formed later is so thin that the presence of the level difference may sometimes cause trouble in emitting light. Therefore flattening is desirably carried out before forming a pixel electrode in order to form the EL layer on the surface as flat as possible.

Denoted by 3043 is a pixel electrode (cathode of the EL element) made of a conductive film with high reflectivity, which is electrically connected to the drain of the current controlling TFT 3003. Preferable material for the pixel electrode 3043 is a low resistance conductive film such as an aluminum alloy film, a copper alloy film and a silver alloy film, or a lamination film of those films. Of course, those films may be used to form a lamination structure with other conductive films.

Banks 3044*a*, 3044*b* made of an insulating film (preferably resin) form a groove (corresponding to a pixel) therebetween to form a light emitting layer 3045 in the groove. Though only one pixel is shown here, light emitting layers corresponding to the colors R (red), G (green) and B(blue), respectively, may be formed. As an organic EL material for forming the light emitting layer, π conjugate polymer material is used. Representative polymer materials include a polyparaphenylene vinylene (PPV)-, polyvinyl carbazole (PVK)- and polyfluorene-based materials, etc.

Among PPV-based organic EL materials of various forms, usable material is one disclosed in, for example, H. Shenk, H. Becker, O. Gelsen, E. Kluge, W. Kreuder, and H. Spreitzer, "Polymers for Light Emitting Diodes," Euro Display, Proceedings, 1999, pp. 33–37, or in Japanese Patent Application Laid-open No. Hei 10-92576.

Specifically, cyanopolyphenylene vinylene is used for the light emitting layer for emitting red light, polyphenylene vinylene is used for the light emitting layer for emitting green light, and polyphenylene vinylene or polyalkylphenylene is used for the light emitting layer for emitting blue light. Appropriate film thickness thereof is 30 to 150 nm (preferably 40 to 100 nm).

However, the description above is an example of an organic EL material usable as the light emitting layer and there is no need to limit the present invention thereto. The EL layer (a layer for emitting light and for moving carriers to emit light) may be formed by freely combining the light emitting layer, an electric charge carrying layer and an electric charge injection layer.

Instead of the polymer material that is used as the light emitting layer in the example shown in this embodiment mode, for instance, a low molecular organic EL material may be used. It is also possible to use an inorganic material such as silicon carbide for the electric charge carrying layer and the electric charge injection layer. Known materials may be used for these organic EL materials and inorganic materials.

The EL layer in this embodiment mode has a lamination structure in which a hole injection layer 3046 made from PEDOT (polytiophene) or PAni (polyanline) is layered on the light emitting layer 3045. On the hole injection layer 3046, an anode 3047 is formed from a transparent conductive film. In the case of this embodiment mode, light produced in the light emitting layer 3045 is emitted toward the top face (upwards beyond the TFTs), which requires an anode having light transmittancy. The transparent conductive film may be formed from a compound of indium oxide and tin oxide or a compound of indium oxide and zinc oxide, and preferred material is one that can be formed into a film at a temperature as low as possible because the transparent conductive film is formed after forming the light emitting layer and the hole injection layer which have low heat resistance.

An EL element 3005 is completed upon formation of the anode 3047. The EL element 3005 here refers to a capacitor consisting of the pixel electrode (cathode) 3043, the light emitting layer 3045, the hole injection layer 3046 and the anode 3047. As shown in FIG. 35A, the pixel electrode 3043 extends almost all over the area of the pixel, so that the entire pixel functions as the EL element. Therefore light emittance efficiency is very high, resulting in bright image display.

In this embodiment mode, a second passivation film 3048 is further formed on the anode 3047. Preferred second passivation film 3048 is a silicon nitride film or a silicon oxynitride film. A purpose of this second passivation film is to shut the EL element from the external with the intention of preventing degradation of the organic EL material due to oxidation as well as suppressing degassing from the organic EL material. This enhances reliability of the EL display device.

As described above, the EL display panel of this embodiment mode includes the pixel portion composed of pixels that has the structure as shown in FIG. 34, the switching TFT sufficiently low in OFF current value, and the current controlling TFT strong against hot carrier injection. Thus obtained is the EL display panel that has high reliability and is capable of excellent image display.

Embodiment Mode 19

Figure 36:
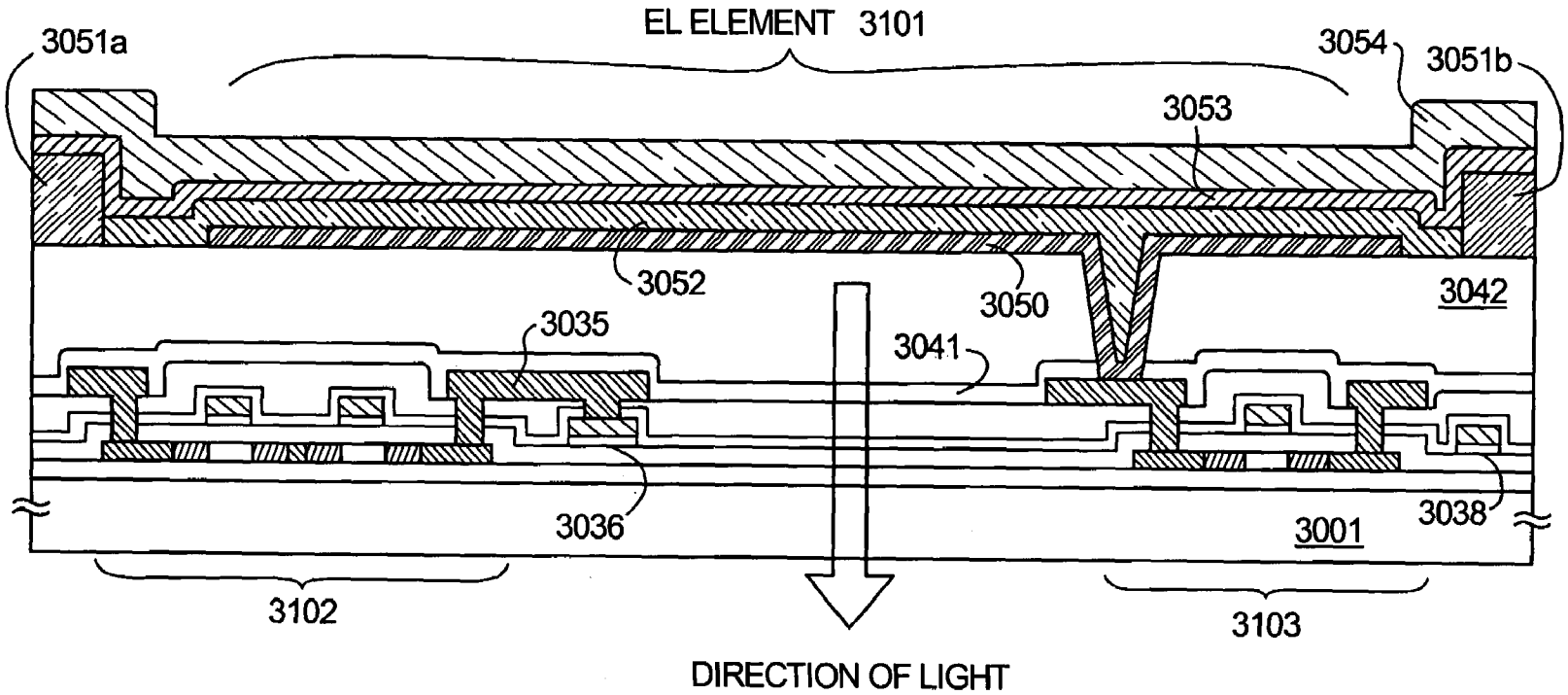
FIG. 36 is a cross sectional view showing the structure of an EL display device.

A description given in this embodiment mode is about the structure of the EL element 3005 in the pixel portion shown in Embodiment mode 18, which is now inverted. FIG. 36 is used for explanation. The difference between this embodiment mode and the structure shown in FIG. 34 is limited to the EL element and the current controlling TFT, so that the explanation of the others is omitted.

In FIG. 36, a current controlling circuit 3103 is formed using a PTFT.

A transparent conductive film is used for a pixel electrode (anode) 3050 in this embodiment mode. Specifically, a conductive film made from a compound of indium oxide and zinc oxide is used. A conductive film made from a compound of indium oxide and tin oxide may of course be used.

After forming banks 3051*a*, 3051*b* made of an insulating film, a light emitting layer 3052 comprising polyvinyl carbazole is formed by applying a solution. An electron injection layer 3053 comprising potassium acetylacetonate and a cathode 3054 made of an aluminum alloy are formed thereon. In this case, the cathode 3054 functions also as a passivation film. An EL element 3101 is thus formed.

In this embodiment mode, light produced in the light emitting layer 3052 is emitted, as indicated by the arrow in the drawing, toward the substrate on which TFTs are formed.

It is effective to use the EL display panel of this embodiment mode as a display unit of the electronic equipment shown in Embodiment mode 12 through 15.

Embodiment Mode 20

Figure 37A:
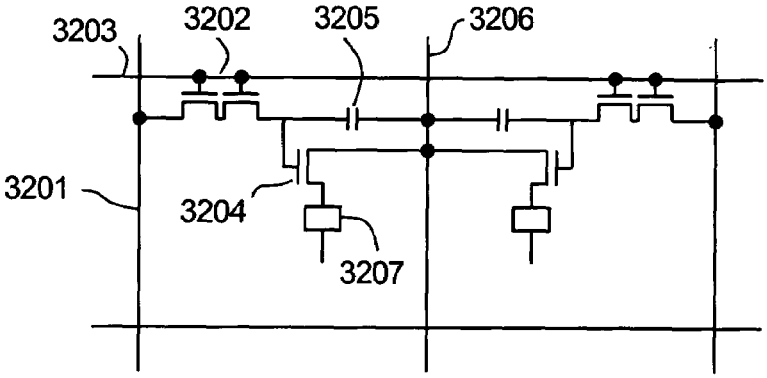
FIGS. 37A to 37C are circuit diagrams showing the structure of a pixel portion in an EL display device.
Figure 37B:
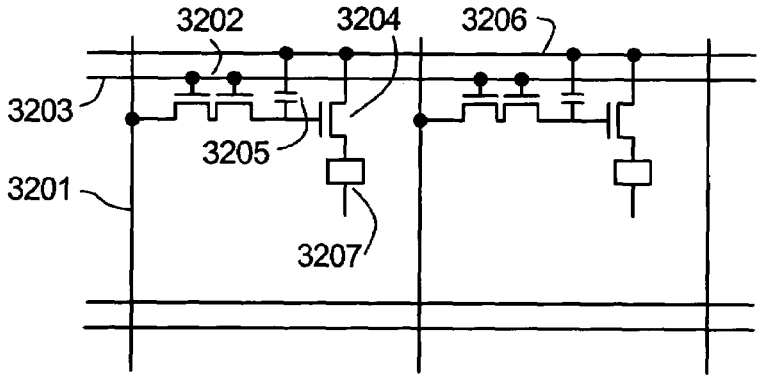
Figure 37C:
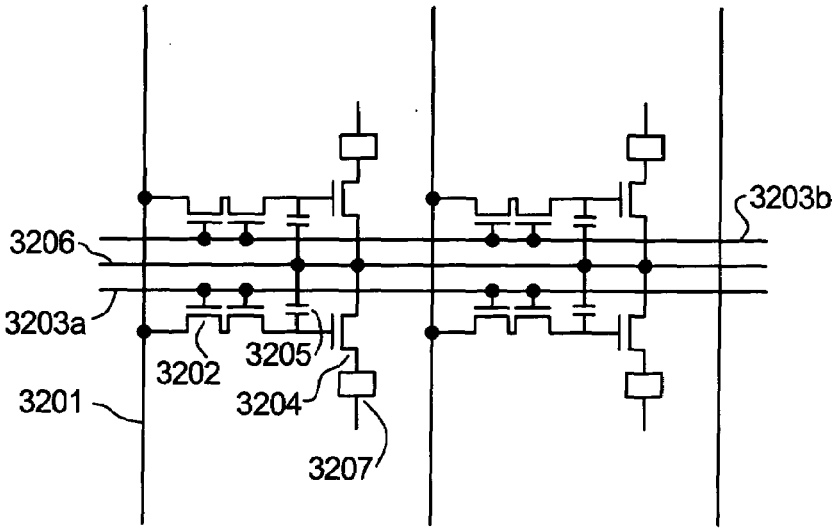

This embodiment mode deals with an example where a pixel has a different structure from the one shown in the circuit diagram of FIG. 35B, and the example is illustrated in FIGS. 37A to 37C. In this embodiment mode, reference numeral 3201 denotes a source wiring of a switching TFT 3202; 3203, gate wirings of the switching TFT 3202; 3204, a current controlling TFT; 3205, a capacitor; 3206, current supply line; and 3207, an EL element.

FIG. 37A shows an example in which the current supply line 3206 is shared by two pixels. In other words, this example is characterized in that two pixels are formed so as to be axisymmetric with respect to the current supply line 3206. In this case, the number of current supply lines can be reduced, further enhancing the definition of the pixel portion.

FIG. 37B shows an example in which the current supply line 3208 is arranged in parallel with the gate wirings 3203. Though the current supply line 3208 is arranged so as not to overlap with the gate wirings 3203 in FIG. 37B, the two may overlap with each other through an insulating film if the lines are formed in different layers. In this case, the current supply line 3208 and the gate wirings 3203 can share their occupying area, further enhancing the definition of the pixel portion.

An example shown in FIG. 37C is characterized in that the current supply line 3206 is arranged, similar to the structure in FIG. 37B, in parallel with the gate wirings 3203*a* and 3203*b* and, further, two pixels are formed to be axisymmetric with respect to the current supply line 3206. It is also effective to arrange the current supply line 3206 so as to overlap with one of the gate wirings 3203*a* and 3206*b*. In this case, the number of current supply lines can be reduced, further enhancing the definition of the pixel portion.

Embodiment Mode 21

In Embodiment mode 18 illustrated in FIGS. 35A and 35B, the capacitor 3004 for holding the voltage applied to the gate of the current controlling TFT 3003 is provided. However, the capacitor 3004 may be omitted. In the case of Embodiment mode 21, the TFT having the LDD region that is arranged to overlap with the gate electrode through the gate insulating film is used as the current controlling TFT 3003. A parasitic capacitance generally called a gate capacitance is formed in the overlapped region. This embodiment mode is characterized in that this parasitic capacitance is actively used as a substitute for the capacitor 3004.

The capacitance of this parasitic capacitance varies depending on the area of the region where the gate electrode overlaps with the LDD region, and accordingly on the length of the LDD region contained in the overlapped region.

The capacitor 3205 may be omitted similarly in the structure of Embodiment mode 20 illustrated in FIGS. 37A to 37C.

According to the display device of the present invention, good multi-gray scale display beyond the capacity of the D/A converter circuit can be obtained. Therefore a small-sized display device can be realized.

What is claimed is:

1. A display device comprising:

a plurality of pixels disposed in matrix over a substrate;

an active matrix circuit comprising a plurality of pixels TFT over said substrate, each of said pixel comprising at least first and second thin film transistors and a pixel electrode wherein a gate electrode of the first thin film transistor is electrically connected to a gate line and a gate electrode of the second thin film transistor is electrically connected to a drain region of the film thin transistor, and the pixel electrode is electrically connected to one of source and drain regions of the second thin film transistor;

a source driver and a gate driver which drive said active matrix circuit over said substrate; and a circuit which converts m bit digital video data inputted from an external into n bit digital video data and provides said n bit digital video data to said source driver, where said m and said n are integers equal to or larger than 2 and satisfy m>n, wherein said circuit is formed over substrate;

wherein each step of a voltage level for said voltage gray scale method is designated as (VH−VL)2n, where VH is the highest voltage level of voltages inputted to DA converter circuit, and VL is the lowest level of voltage inputted to said D/A converter circuit.

2. A display device according to claim 1 wherein said display device comprises thresholdless antiferroelectric mixed liquid crystal indicating electro-optical characteristic of V-shape.

3. A display device according to claim 1 wherein said m is 8 and said n is 2.

4. A display device according to claim 1 wherein said m is 12 and said n is 4.

5. A rear projector comprising three of the display devices according to claim 1.

6. A front projector comprising three of the display devices according to claim 1.

7. A single plate type rear projector comprising a display device according to claim 1.

8. A goggle type display comprising two of the display device according to claim 1.

9. A portable information terminal comprising a display device according to claim 1.

10. A notebook type personal computer comprising a display device according to claim 1.

11. An EL display comprising a display device according to claim 1.

12. A mobile telephone comprising a display device according to claim 1.

13. A video camera comprising a display device according to claim 1.

14. A mobile computer comprising a display device according to claim 1.

15. A portable electronic book comprising a display device according to claim 1.

16. A personal computer comprising a display device according to claim 1.

17. An electronic game equipment comprising a display device according to claim 1.

18. An image reproduction device comprising a display device according to claim 1.

19. A digital camera comprising a display device according to claim 1.

20. A display device comprising:

a plurality of pixels disposed in matrix over a substrate;

an active matrix circuit comprising a plurality of pixels TFT over said substrate, a source driver and a gate driver which drive said active matrix circuit over said substrate; and a circuit which converts m bit digital video data inputted from an external into n bit digital video data and provides said n bit digital video data to said source driver, where said m and said n are integers equal to or larger than 2 and satisfy m>n, wherein said circuit is formed over substrate;

wherein each step of a voltage level for said voltage gray scale method is designated as (VH−VL)2n, where VH is the highest voltage level of voltages inputted to DA converter circuit, and VL is the lowest level of voltage inputted to said D/A converter circuit, and wherein one frame period comprises 2 to the m−n sub-frame periods.

21. A display device according to claim 20 wherein said display device comprises thresholdless antiferroelectric mixed liquid crystal indicating electro-optical characteristic of V-shape.

22. A display device according to claim 20 wherein said m is 8 and said n is 2.

23. A display device according to claim 21 wherein said m is 12 and said n is 4.

24. A rear projector comprising three of the display devices according to claim 20.

25. A front projector comprising three of the display devices according to claim 20.

26. A single plate type rear projector comprising a display device according to claim 20.

27. A goggle type display comprising two of the display device according to claim 20.

28. A portable information terminal comprising a display device according to claim 20.

29. A notebook type personal computer comprising a display device according to claim 20.

30. A mobile telephone comprising a display device according to claim 20.

31. A video camera comprising a display device according to claim 20.

32. A mobile computer comprising a display device according to claim 20.

33. A portable electronic book comprising a display device according to claim 20.

34. A personal computer comprising a display device according to claim 20.

35. An electronic game equipment comprising a display device according to claim 20.

36. An image reproduction device comprising a display device according to claim 20.

37. A digital camera comprising a display device according to claim 20.

38. An EL display comprising a display device according to claim 20.

39. A display device comprising:

a plurality of pixels disposed in matrix over a substrate;

an active matrix circuit comprising a plurality of pixels TFT over said substrate, each of said pixel comprising at least first and second thin film transistors and a pixel electrode wherein a gate electrode of the first thin film transistor is electrically connected to a gate line and a gate electrode of the second thin film transistor is electrically connected to a drain region of the film thin transistor, and the pixel electrode is electrically connected to one of source and drain regions of the second thin film transistor;

a source driver and a gate driver which drive said active matrix circuit over said active matrix circuit, wherein n bit information out of m bit digital video data inputted from an external is used for a voltage gray scale method and (m−n) bit information is used for a time ration gray scale method, where said m and n are integers equal to or larger than 2 and satisfy m>n, wherein each step of a voltage level for said voltage gray scale method is designated as (VH−VL)2n, where VH is the highest voltage level of voltages inputted to DA converter circuit, and VL is the lowest level of voltage inputted to said D/A converter circuit, and wherein an image displayed by an image gray scale of (2 to the m−((2 to the m−n)−1) patterns.

40. A display device according to claim 39 wherein said display device comprises thresholdless antiferroelectric mixed liquid crystal indicating electro-optical characteristic of V-shape.

41. A display device according to claim 39 wherein said m is 8 and said n is 2.

42. A display device according to claim 39 wherein said m is 12 and said n is 4.

43. A rear projector comprising three of the display devices according to claim 39.

44. A front projector comprising three of the display devices according to claim 39.

45. A single plate type rear projector comprising a display device according to claim 39.

46. A goggle type display comprising two of the display device according to claim 39.

47. A portable information terminal comprising a display device according to claim 39.

48. A notebook type personal computer comprising a display device according to claim 39.

49. An EL display comprising a display device according to claim 39.

50. A mobile telephone comprising a display device according to claim 39.

51. A video camera comprising a display device according to claim 39.

52. A mobile computer comprising a display device according to claim 39.

53. A portable electronic book comprising a display device according to claim 39.

54. A personal computer comprising a display device according to claim 39.

55. An electronic game equipment comprising a display device according to claim 39.

56. An image reproduction device comprising a display device according to claim 39.

57. A digital camera comprising a display device according to claim 39.

58. A display device comprising:

a plurality of pixels disposed in matrix over a substrate;

an active matrix circuit comprising a plurality of pixels TFT over said substrate, a source driver and a gate driver which drive said active matrix circuit, wherein n bit information out of m bit digital video data inputted from an external is used for a voltage gray scale method and (m−n) bit information is used for a time ratio gray scale method, where said m and n are integers equal to or larger than 2 and satisfy m>n, wherein each step of a voltage level for said voltage gray scale method is designated as (VH−VL)2n, where VH is the highest voltage level of voltages inputted to DA converter circuit, and VL is the lowest level of voltage inputted to said D/A converter circuit and wherein one frame period comprises 2 to the m−n sub-frame periods, and wherein an image is displayed by an image gray scale of (2 to the m−((2 to the m−n)−1) patterns.

59. A display device according to claim 58 wherein said display device comprises thresholdless antiferroelectric mixed liquid crystal indicating electro-optical characteristic of V-shape.

60. A display device according to claim 58 wherein said m is 8 and said n is 2.

61. A display device according to claim 58 wherein said m is 12 and said n is 4.

62. A rear projector comprising three of the display devices according to claim 58.

63. A front projector comprising three of the display devices according to claim 58.

64. A single plate type rear projector comprising a display device according to claim 58.

65. A goggle type display comprising two of the display device according to claim 58.

66. A portable information terminal comprising a display device according to claim 58.

67. A notebook type personal computer comprising a display device according to claim 58.

68. An EL display comprising a display device according to claim 58.

69. A mobile telephone comprising a display device according to claim 58.

70. A video camera comprising a display device according to claim 58.

71. A mobile computer comprising a display device according to claim 58.

72. A portable electronic book comprising a display device according to claim 58.

73. A personal computer comprising a display device according to claim 58.

74. An electronic game equipment comprising a display device according to claim 58.

75. An image reproduction device comprising a display device according to claim 58.

76. A digital camera comprising a display device according to claim 58.

77. A display device comprising:

a plurality of pixels disposed in matrix over a substrate;

an active matrix circuit comprising a plurality of pixels TFT over said substrate, each of said pixel comprising at least first and second thin film transistors and a pixel electrode wherein a gate electrode of the first thin film transistor is electrically connected to a gate line and a gate electrode of the second thin film transistor is electrically connected to a drain region of the film thin transistor, and the pixel electrode is electrically connected to one of source and drain regions of the second thin film transistor;

a source driver and a gate driver which drive said active matrix circuit over said substrate; and a circuit which converts m bit digital video data inputted from an external into n bit digital video data and provides said n bit digital video data to said source driver, where said m and said n are integers equal to or larger than 2 and satisfy m>n, wherein said circuit is formed over substrate;

wherein each step of a voltage level for said voltage gray scale method is designated as (VH−VL)2n, where VH is the highest voltage level of voltages inputted to DA converter circuit, and VL is the lowest level of voltage inputted to said D/A converter circuit, and wherein an image is displayed by and image gray scale of (2 to the m−((2 to the m−n)−1) patterns.

78. A display device according to claim 77 wherein said display device comprises thresholdless antiferroelectric mixed liquid crystal indicating electro-optical characteristic of V-shape.

79. A display device according to claim 77 wherein said m is 8 and said n is 2.

80. A display device according to claim 77 wherein said m is 12 and said n is 4.

81. A rear projector comprising three of the display devices according to claim 77.

82. A front projector comprising three of the display devices according to claim 77.

83. A single plate type rear projector comprising a display device according to claim 77.

84. A goggle type display comprising two of the display device according to claim 77.

85. A portable information terminal comprising a display device according to claim 77.

86. A notebook type personal computer comprising a display device according to claim 77.

87. An EL display comprising a display device according to claim 77.

88. A mobile telephone comprising a display device according to claim 77.

89. A video camera comprising a display device according to claim 77.

90. A mobile computer comprising a display device according to claim 77.

91. A portable electronic book comprising a display device according to claim 77.

92. A personal computer comprising a display device according to claim 77.

93. An electronic game equipment comprising a display device according to claim 77.

94. An image reproduction device comprising a display device according to claim 77.

95. A digital camera comprising a display device according to claim 77.

96. A display device comprising:

a plurality of pixels disposed in matrix over a substrate;

an active matrix circuit comprising a plurality of pixels TFT over said substrate, a source driver and a gate driver which drive said active matrix circuit over said substrate; and a circuit which converts m bit digital video data inputted from an external into n bit digital video data and provides said n bit digital video data to said source driver, where said m and said n are integers equal to or larger than 2 and satisfy m>n, wherein said circuit is formed over substrate;

wherein each step of a voltage level for said voltage gray scale method is designated as (VH−VL)2n, where VH is the highest voltage level of voltages inputted to DA converter circuit, and VL is the lowest level of voltage inputted to said D/A converter circuit, and wherein one frame period comprises 2 to the m−n sub-frame periods and wherein an image is displayed by an image gray scale of (2 to the m−((2 to the m−n)−1) patterns.

97. A display device according to claim 96 wherein said display device comprises thresholdless antiferroelectric mixed liquid crystal indicating electro-optical characteristic of V-shape.

98. A display device according to claim 96 wherein said m is 8 and said n is 2.

99. A display device according to claim 96 wherein said m is 12 and said n is 4.

100. A rear projector comprising three of the display devices according to claim 96.

101. A front projector comprising three of the display devices according to claim 96.

102. A single plate type rear projector comprising a display device according to claim 96.

103. A goggle type display comprising two of the display device according to claim 96.

104. A portable information terminal comprising a display device according to claim 96.

105. A notebook type personal computer comprising a display device according to claim 96.

106. An EL display comprising a display device according to claim 96.

107. A mobile telephone comprising a display device according to claim 96.

108. A video camera comprising a display device according to claim 96.

109. A mobile computer comprising a display device according to claim 96.

110. A portable electronic book comprising a display device according to claim 96.

111. A personal computer comprising a display device according to claim 96.

112. An electronic game equipment comprising a display device according to claim 96.

113. An image reproduction device comprising a display device according to claim 96.

114. A digital camera comprising a display device according to claim 96.

* * * * *